United States Patent [19]

Evans et al.

[11] Patent Number: 4,504,570

[45] Date of Patent: Mar. 12, 1985

[54] DIRECT REVERSAL EMULSIONS AND PHOTOGRAPHIC ELEMENTS USEFUL IN IMAGE TRANSFER FILM UNITS

[75] Inventors: Francis J. Evans, Richmansworth, England; Richard L. Daubendiek, Rochester; Ronald G. Raleigh, Brockport, both of N.Y.

[73] Assignee: Eastman Kodak Company, Rochester, N.Y.

[21] Appl. No.: 564,976

[22] Filed: Dec. 23, 1983

Related U.S. Application Data

[63] Continuation-in-part of Ser. No. 431,912, Sep. 30, 1982, abandoned, which is a continuation-in-part of Ser. No. 320,891, Nov. 12, 1981, abandoned.

[51] Int. Cl.[3] ..... G03C 1/36; G03C 5/54

[52] U.S. Cl. ..... 430/217; 430/219; 430/598; 430/567; 430/599; 430/605; 430/604; 430/608; 430/570; 430/580; 430/581; 430/591; 430/592; 430/589; 430/545; 430/642; 430/542; 430/547; 430/550; 430/503; 430/505; 430/223; 430/940

[58] Field of Search ..... 430/598, 567, 599, 605, 430/604, 608, 570, 580, 581, 591, 592, 589, 545, 642, 542, 547, 550, 503, 505, 217, 223, 940, 219

[56] References Cited

U.S. PATENT DOCUMENTS

| | | |
|---|---|---|
| 2,456,953 | 8/1947 | Knott . |
| 2,592,250 | 4/1952 | Davey et al. . |
| 3,206,313 | 9/1965 | Porter et al. . |
| 3,227,552 | 1/1966 | Whitmore . |
| 3,615,615 | 10/1971 | Lincoln . |
| 3,719,494 | 3/1973 | Kurtz . |
| 3,734,738 | 5/1973 | Kurtz . |
| 3,759,901 | 9/1973 | Lincoln . |
| 3,761,276 | 9/1973 | Evans . |
| 3,894,871 | 7/1975 | Land . |
| 3,923,513 | 12/1975 | Evans . |
| 4,030,925 | 6/1977 | Leone . |
| 4,035,185 | 7/1977 | Atwell et al. . |
| 4,063,951 | 12/1977 | Bogg . |
| 4,067,739 | 1/1978 | Lewis . |

(List continued on next page.)

FOREIGN PATENT DOCUMENTS

| | | |
|---|---|---|
| 2905655 | 2/1979 | Fed. Rep. of Germany . |
| 2921077 | 5/1979 | Fed. Rep. of Germany . |
| 2011391 | 7/1979 | United Kingdom . |
| 2012443 | 7/1979 | United Kingdom . |
| 1570581 | 7/1980 | United Kingdom . |

OTHER PUBLICATIONS

Zelikman and Levi, *Making and Coating Photographic Emulsions,* Focal Press, 1964, p. 223.

deCugnac and Chateau, "Evolution of the Morphology of Silver Bromide Crystals During Physical Ripening", *Science et Industries Photographiques,* vol. 33, No. 2, (1962), pp. 121-125.

Duffin, *Photographic Emulsion Chemistry,* Focal Press, 1966, pp. 66-72.

Trivelli and Smith, "The Effect of Silver Iodide Upon the Structure of Bromo-Iodide Precipitation Series", *The Photographic Journal,* vol. LXXX, Jul. 1940, pp. 285-288.

Gutoff, "Nucleation and Growth Rates During the Precipitation of Silver Halide Photographic Emulsions", *Photographic Sciences and Engineering,* vol. 14, No. 4, Jul.-Aug. 1970, pp. 248-257.

Kofron et al., U.S. Ser. No. 429,407, 3-84.

*Primary Examiner*—Won H. Louie

*Attorney, Agent, or Firm*—Carl O. Thomas

[57] ABSTRACT

High aspect ratio tabular grain direct reversal silver halide emulsions are disclosed. The emulsions can be incorporated in photographic elements, such as multicolor photographic elements. Image transfer film units incorporating these direct reversal emulsions are specifically disclosed.

60 Claims, 2 Drawing Figures

U.S. PATENT DOCUMENTS 4,080,207 3/1978 Leone .
4,115,122 9/1978 Adachi .
4,139,387 2/1979 vonKonig .
4,150,994 4/1979 Maternaghan .
4,184,877 1/1980 Maternaghan .
4,184,878 1/1980 Maternaghan .
4,276,364 6/1981 Leone .
4,306,016 12/1981 Baralle et al. .
4,306,017 12/1981 Baralle et al. .
4,315,986 2/1982 Baralle et al. .
4,386,156 5/1983 Mignot .
4,395,478 7/1983 Hoyen .
4,399,215 8/1983 Wey .
4,414,304 11/1983 Dickerson .
4,414,310 11/1983 Daubendiek et al. .
4,425,425 1/1984 Abbott et al. .
4,433,048 2/1984 Solberg et al. .
4,434,226 2/1984 Wilgus et al. .

DIRECT REVERSAL EMULSIONS AND PHOTOGRAPHIC ELEMENTS USEFUL IN IMAGE TRANSFER FILM UNITS

This invention relates to novel direct reversal emulsions and to photographic elements incorporating these emulsions. Further, the invention relates to image transfer film units incorporating these emulsions.

BACKGROUND OF THE INVENTION

The most commonly employed photographic elements are those containing one or more radiation-sensitive silver halide emulsion layers. Their widespread use is attributable to the excellent quality images they are capable of producing and to their high speed, allowing them to be employed in hand-held cameras under a variety of lighting conditions.

Nevertheless, silver halide photographic elements have historically exhibited two significant limitations in terms of viewing the photographic image. First, imagewise exposure of the silver halide emulsion layer does not produce an immediately viewable photographic image. Exposure produces an invisible latent image in the silver halide emulsion. Processing of the latent image is required to produce a viewable image. Historically this has meant removing the photographic element from the camera and processing in one or more aqueous solutions to obtain a viewable image. Second, in most instances the first viewable image obtained is a negative image, and a second exposure through the negative image of an additional photographic element and processing thereof is required to produce a viewable positive of the image initially photographed. The first limitation can be overcome by employing image transfer techniques, and the second limitation can be overcome by employing direct-positive imaging, particularly direct reversal imaging.

a. Direct reversal imaging

Photographic elements which produce images having an optical density directly related to the radiation received on exposure are said to be negative-working. A positive photographic image can be formed by producing a negative photographic image and then forming a second photographic image which is a negative of the first negative—that is, a positive image. A direct-positive image is understood in photography to be a positive image that is formed without first forming a negative image. Positive dye images which are not direct-positive images are commonly produced in color photography by reversal processing in which a negative silver image is formed and a complementary positive dye image is then formed in the same photographic element. The term "direct reversal" has been applied to direct-positive photographic elements and processing which produces a positive dye image without forming a negative silver image. Direct-positive photography in general and direct reversal photography in particular are advantageous in providing a more straight-forward approach to obtaining positive photographic images.

A conventional approach to forming direct-positive images is to use photographic elements employing internal latent image-forming silver halide grains. After imagewise exposure, the silver halide grains are developed with a surface developer—that is, one which will leave the latent image sites within the silver halide grains substantially unrevealed. Simultaneously, either by uniform light exposure or by the use of a nucleating agent, the silver halide grains are subjected to development conditions that would cause fogging of a surface latent image-forming photographic element. The internal latent image-forming silver halide grains which received actinic radiation during imagewise exposure develop under these conditions at a slow rate as compared to the internal latent image-forming silver halide grains not imagewise exposed. The result is a direct-positive silver image. In color photography, the oxidized developer that is produced during silver development is used to produce a corresponding positive, direct reversal dye image. Multicolor direct reversal photographic images have been extensively investigated in connection with image transfer photography.

It has been found advantageous to employ nucleating agents in preference to uniform light exposure in the process described above. The term "nucleating agent" is employed herein in its art-recognized usage to mean a fogging agent capable of permitting the selective development of internal latent image-forming silver halide grains which have not been imagewise exposed in preference to the development of silver halide grains having an internal latent image formed by imagewise exposure.

While nucleating agents have been long known to the photographic art, recent interest has focused on identifying nucleating agents that are effective in relatively low concentration levels and that can be incorporated directly into silver halide emulsions. Exemplary of known incorporated nucleating agents are those disclosed by Whitmore U.S. Pat. No. 3,227,552, Lincoln et al. U.S. Pat. No. 3,615,615, Kurtz et al. U.S. Pat. Nos. 3,719,494 and 3,734,738, Lincoln et al. U.S. Pat. No. 3,759,901, Leone et al. U.S. Pat. Nos. 4,030,925, 4,080,207, and 4,276,364, Adachi et al. U.S. Pat. No. 4,115,122, von Konig et al. U.S. Pat. No. 4,139,387, and U.K. Pat. Nos. 2,011,391 and 2,012,443. Nucleating agents particularly adapted for use in direct reversal photographic elements intended to be processed at lower pH levels are disclosed by Baralle et al. U.S. Pat. Nos. 4,306,016, 4,306,017, and 4,315,986.

Direct reversal emulsions useful with adsorbed nucleating agents include emulsions capable of forming latent image centers primarily in the interior of the silver halide grains as opposed to their surface—hereinafter also referred to as internal latent image-forming emulsions. Such emulsions can take the form of halide-conversion type emulsions, such as illustrated by Knott et al. U.S. Pat. No. 2,456,953 and Davey et al. U.S. Pat. No. 2,592,250, and core-shell emulsions, such as illustrated by Porter et al U.S. Pat. No. 3,206,313, Evans U.S. Pat. Nos. 3,761,276 and 3,923,513, and Atwell et al U.S. Pat. No. 4,035,185.

Direct reversal emulsions exhibit art-recognized disadvantages as compared to negative-working emulsions. Although Evans, cited above, has been able to increase photographic speeds by properly balancing internal and surface sensitivities, direct reversal emulsions have not achieved photographic speeds equal to the faster surface latent image-forming emulsions. Second, direct reversal emulsions are limited in their permissible exposure latitude. When exposure is extended rereversal occurs. That is, in areas receiving extended exposure a negative image is produced This is a significant limitation to in-camera use of direct reversal photographic elements, since candid photography does not always permit control of exposure conditions. For example, a very high contrast scene can lead to rereversal in some image areas.

A schematic illustration of rereversal is provided in FIG. 1, which plots density versus exposure. A characteristic curve 1 (stylized to exaggerate curve features for simplicity of discussion) is shown for a direct reversal emulsion. When the emulsion is coated as a layer on a support, exposed, and processed, a density is produced. The characteristic curve is the result of plotting various levels of exposure versus the corresponding density produced on processing. At exposures below level A underexposure occurs and a maximum density is obtained which does not vary as a function of exposure. At exposure levels between A and B useful direct reversal imaging can be achieved, since density varies inversely with exposure. If exposure occurs between the levels indicated by B and C, overexposure results. That is, density ceases to vary as a function of exposure in this range of exposures. If a subject to be photographed varies locally over a broad range of reflected light intensities, a photographic element containing the direct reversal emulsion can be simultaneously exposed in different areas at levels less than A and greater than B. The result may, however, still be aesthetically pleasing, although highlight and shadow detail of the subject are both lost. If it is attempted to increase exposure for this subject, however, to pick up shadow detail, the result can be to increase highlight exposure to levels above C. When this occurs, rereversal is encountered. That is, the areas overexposed beyond exposure level C appear as highly objectionable negative images, since density is now increasing directly with exposure. Useful exposure latitude can be increased by more widely separating exposure levels A and B, but this is objectionable to the extent that it reduces contrast below optimum levels for most subjects. Therefore reduction in rereversal is most profitably directed to increasing the separation between exposure levels B and C so that overexposed areas are less likely to produce negative images. (In actual practice the various segments of the characteristic curve tend to merge more smoothly than illustrated.)

b. Image transfer photography

Image transfer photography has made it possible to reduce the delay between imagewise exposure and obtaining a viewable image. Immediately after imagewise exposing the radiation-sensitive silver halide emulsion layer or layers, a processing solution can be brought into contact therewith. As silver halide development occurs, a black-and-white transferred silver image or a transferred dye image can be formed in a receiving layer for viewing. In this way, visual access to the photographic image can occur in minutes or even seconds.

Still, though measured in seconds, the delay in providing visual access remains an important limitation in silver halide image transfer photography. Subject opportunities can be fleeting, and the photographer needs as nearly an instantaneous visual verification of an acceptable photographic image as can be offerred.

Although image transfer has reduced the time required for image access in silver halide photography, this advantage has not been achieved without other sacrifices. One significant long term concern of image transfer photography relates to consumption of silver. Multicolor silver halide photographic elements which are conventionally processed and dye image transfer film units both employ relatively high silver coverages to obtain maximum photographic speed. Typically about 1000 milligrams per square meter of silver is required to form each of the blue, green, and red exposure records. In oonventionally processed multicolor photographic elements the image produced contains no silver and all of the silver present in the photographic element is, in theory, recoverable. On the other hand, in image transfer photography silver is seldom recovered, and in integral format image transfer film units all of the silver remains with the photographic film units forming the viewable image.

Another disadvantage, inherent in image transfer photography, is the reduction in image sharpness attributable to diffusion. As the image forming materials diffuse from the silver halide emulsion layer or an adjacent dye releasing layer, diffusion occurs both in the direction of the receiving layer and laterally, leading to image spreading and loss of sharpness. Sharpness can be improved by decreasing the length of the diffusion path to the receiving layer. This is controlled by the number and thickness of the layers to be traversed. Unfortunately, the minimum thickness of the silver halide emulsion layers is limited by the size of the silver halide grains and the weight ratio of gelatin to silver halide. Further, in multicolor image transfer film units employing three superimposed dye-providing layer units, intervening dye-providing layer units and separating interlayers must be penetrated by diffusing dyes migrating to the receiving layer.

Another consideration that arises in image transfer photography is image density variance as a function of temperature differences. Since subject opportunities are presented under a variety of temperature conditions and since the primary advantage of image transfer photography is ready image access, it follows that the ability of image transfer photographic elements to produce acceptable images at a variety of temperatures is also important. Image transfer photography is much different than conventional photography in this respect, since in the latter processing is rarely undertaken without control of temperature.

A number of imaging limitations are encountered in producing transferred images with dyes. For example, both the high silver coverages noted above and larger than stoichiometrically predicted amounts of dye-image-providing materials are required to obtain transferred dye images of acceptable maximum densities. To the extent that the efficiency of dye transfer declines from stoichiometrically predicted levels, more dye-image-providing materials must be incorporated in the photographic elements and the layer thicknesses must be increased to incorporate added amounts of these materials. Further, the rate of release of dyes for transfer can affect the time required to produce a viewable image. When the development reaction product is relied upon to preclude dye transfer, as in the case of many conventional positive-working dye-image-forms, the rate of silver halide development also limits the maximum rate at which image dye can become available for transfer, since too rapid release of image dye in relation to the rate of silver halide development can result in the loss of image discrimination. Improvements of any one or a combination of these characteristics can, of course, significantly improve dye image transfer.

Silver halide image transfer film units are generally well known in the art of photography and require no detailed description. Broad discussions of image transfer elements and processes (including process solutions) can be found in Chapter 12, "One Step Photography", *Neblette's Handbook of Photography and Reprography Materials, Processes and Systems*, 7th Ed. (1977), in Chapter 16, "Diffusion Transfer and Monobaths", T. H.

James, *The Theory of the Photographic Process,* 4th Ed. (1977), and A. Rott and E. Weyde, *Photographic Silver Halide Diffusion Processes,* Focal Press, (1972). Patents relating to silver halide image transfer are collected in U.S. Patent and Trademark Office Class 430 RADIATION IMAGERY CHEMISTRY—PROCESS, COMPOSITION OR PRODUCT, subclasses 199 through 255.

Class 430, cited above, subclass 217 (Silver halide identified-grain, identified emulsion binder other than nominal gelatin, or identified sensitizer or identified desensitizer containing) contains a collection of patents directed to silver halide image transfer photography, many of which disclose specific silver halide grain structures.

c. Tabular silver halide grains

A great variety of regular and irregular grain shapes have been observed in silver halide photographic emulsions intended for imaging applications. Regular grains are often cubic or octahedral. Grain edges can exhibit rounding due to ripening effects, and in the presence of strong ripening agents, such as ammonia, the grains may even be spherical or near spherical thick platelets, as described, for example by Land U.S. Pat. No. 3,894,871 and Zelikman and Levi *Making and Coating Photographic Emulsions,* Focal Press, 1964, page 223. Rods and tabular grains in varied portions have been frequently observed mixed in among other grain shapes, particularly where the pAg (the negative logarithm of silver ion concentration) of the emulsions has been varied during precipitation, as occurs, for example in single-jet precipitations.

Tabular grains (those areally extended in two dimensions as compared to their thickness) have been extensively studied, often in macro-sizes having no photographic utility. Tabular grains are herein defined as those having two substantially parallel crystal faces, each of which is substantially larger than any other single crystal face of the grain. The term "substantially parallel" as used herein is intended to include surfaces that appear parallel on direct or indirect visual inspection at 10,000 times magnification. A discussion of tabular bromoiodide grains appears in Duffin, *Photographic Emulsion Chemistry,* Focal Press, 1966, pp. 66–72, and Trivelli and Smith, "The Effect of Silver Iodide Upon the Structure of Silver Bromo-Iodide Precipitation Series", *The Photographic Journal,* Vol. LXXX, July 1940, pp. 285–288. Trivelli and Smith observed a pronounced reduction in both grain size and aspect ratio with the introduction of iodide. Tabular silver bromide emulsions are discussed by de Cugnac and Chateau, "Evolution of the Morphology of Silver Bromide Crystals During Physical Ripening", *Science et Industries Photographiques,* Vol. 33, No. 2 (1962), pp. 121–125. Sulfur sensitized tabular grain silver bromide emulsions having an average aspect ratio of from about 5 to 7:1 wherein the tabular grains account for greater than 50% of the projected area of the total grain population were incorporated in a direct X-ray radiographic product, No Screen X-Ray Code 5133 sold by Eastman Kodak Company from 1937 until the 1950's. Gutoff, "Nucleation and Growth Rates During the Precipitation of Silver Halide Photographic Emulsions", *Photographic Science and Engineering,* Vol. 14, No. 4, July–August 1970, pp. 248–257, reports preparing silver bromide and silver bromoiodide emulsions of the type prepared by single-jet precipitations using a continuous precipitation apparatus.

Bogg, Lewis, and Maternaghan have recently published specific procedures for preparing emulsions in which a major proportion of the silver halide is present in the form of tabular grains. Bogg U.S. Pat. No. 4,063,951 teaches forming silver halide crystals of tabular habit bounded by {100} cubic faces and having an aspect ratio (based on edge length) of from 1.5 to 7:1. The tabular grains exhibit square and rectangular major surfaces characteristic of {100} crystal faces. Lewis U.S. Pat. No. 4,067,739 teaches the preparation of silver halide emulsions wherein most of the crystals are of the twinned octahedral type by forming seed crystals causing the seed crystals to increase in size by Ostwald ripening in the presence of a silver halide solvent, and completing grain growth without renucleation or Ostwald ripening while controlling pBr (the negative logarithm of bromide ion concentration). Maternaghan U.S. Pat. Nos. 4,150,994 and 4,184,877, teach the formation of silver halide grains of flat twinned octahedral configuration by employing seed crystals which are at least 90 mole percent iodide. (Except as otherwise indicated, all references to halide percentages are based on silver present in the corresponding emulsion, grain, or grain region being discussed; e.g., a grain consisting of silver bromiodide containing 40 mole percent iodide also contains 60 mole percent bromide.) Lewis and Maternaghan report increased covering power. Maternaghan states that the emulsions are useful in camera films, both black-and-white and color. Bogg specifically reports an upper limit on aspect ratios of 7:1, but, from the very low aspect ratios obtained by the examples, the 7:1 aspect ratio appears unrealistically high. It appears from repeating examples and viewing the photomicrographs published that the aspect ratios realized by Lewis and Maternaghan were also less than 7:1.

Maternaghan U.S. Pat. No. 4,184,878 (with which U.K. Pat. No. 1,570,581 and German OLS publications Nos. 2,905,655 and 2,921,077 are considered essentially cumulative) teaches the formation of direct-positive images by preparing a tabular grain emulsion essentially similarly as described by Maternaghan U.S. Pat. No. 4,184,877, but with the incorporation of an internal sensitizer and processing in a developer containing a nucleating agent.

Wilgus and Haefner U.S. Ser. No. 429,420, filed Sept. 30, 1982 and commonly assigned, titled HIGH ASPECT RATIO SILVER BROMOIODIDE EMULSIONS AND PROCESSES FOR THEIR PREPARATION, which is a continuation-in-part of U.S. Ser. No. 320,904, filed Nov. 12, 1981, now abandoned, discloses high aspect ratio silver bromoiodide emulsions and a process for their preparation.

Daubendiek and Strong U.S. Pat. No. 4,414,310, titled AN IMPROVED PROCESS FOR THE PREPARATION OF HIGH ASPECT RATIO SILVER BROMOIODIDE EMULSIONS, discloses an improvement on the processes of Maternaghan whereby high aspect ratio tabular grain silver bromoiodide emulsions can be prepared.

Solberg, Piggin, and Wilgus U.S. Ser. No. 431,913, filed Sept. 30, 1982 and commonly assigned, titled RADIATION-SENSITIVE SILVER BROMOIODIDE EMULSIONS, PHOTOGRAPHIC ELEMENTS, AND PROCESSES FOR THEIR USE, which is a continuation-in-part of U.S. Ser. No. 320,909, filed Nov. 12, 1981, now abandoned, discloses high aspect ratio tabular grain silver bromoiodide emulsions wherein a higher concentration of iodide is present in an annular region than in a central region of the tabular grains.

Wey U.S. Pat. No. 4,399,215, titled IMPROVED DOUBLE-JET PRECIPITATION PROCESSES AND PRODUCTS THEREOF, discloses a process of preparing tabular silver chloride grains which are substantially internally free of both silver bromide and silver iodide. The emulsions have an average aspect ratio of greater than 8:1.

Kofron et al U.S. Ser. No. 429,407, filed Sept. 30, 1982 and commonly assigned, titled SENSITIZED HIGH ASPECT RATIO SILVER HALIDE EMULSIONS AND PHOTOGRAPHIC ELEMENTS, which is a continuation-in-part of U.S. Ser. No. 320,905, filed Nov. 12, 1981, now abandoned, discloses chemically and spectrally sensitized high aspect ratio tabular grain silver halide emulsions and photographic elements incorporating these emulsions.

Mignot U.S. Pat. No. 4,386,156, titled SILVER BROMIDE EMULSIONS OF NARROW GRAIN SIZE DISTRIBUTION AND PROCESSES FOR THEIR PREPARATION, discloses high aspect ratio tabular grain silver bromide emulsions wherein the tabular grains are square or rectangular.

Dickerson U.S. Pat. No. 4,414,304, titled FOREHARDENED PHOTOGRAPHIC ELEMENTS AND PROCESSES FOR THEIR USE, discloses producing silver images of high covering power by employing photographic elements containing forehardened high aspect ratio tabular grain silver halide emulsions.

Abbott and Jones U.S. Ser. No. 430,222, filed Sept. 30, 1982 and commonly assigned, titled RADIOGRAPHIC ELEMENTS EXHIBITING REDUCED CROSSOVER, which is a continuation-in-part of U.S. Ser. No. 320,907, filed Nov. 12, 1981, now abandoned, discloses the use of high aspect ratio tabular grain silver halide emulsions in radiographic elements coated on both major surfaces of a radiation transmitting support to control crossover.

Jones and Hill U.S. Ser. No. 553,911, filed Nov. 21, 1983 and commonly assigned, titled PHOTOGRAPHIC IMAGE TRANSFER FILM UNIT, which is a continuation-in-part of U.S. Ser. No. 430,092 filed Sept. 30, 1982, which is in turn a continuation-in-part of U.S. Ser. No. 320,911, filed Nov. 12, 1981, now abandoned, discloses image transfer film units containing tabular grain silver halide emulsions.

Hoyen U.S. Pat. No. 4,395,478, titled DIRECT-POSITIVE CORE-SHELL EMULSIONS AND PHOTOGRAPHIC ELEMENTS AND PROCESSES FOR THEIR USE, discloses the use of divalent or trivalent metal ion dopants in the shell of core-shell emulsions to reduce rereversal.

SUMMARY OF THE INVENTION

In one aspect this invention is directed to a radiation-sensitive emulsion particularly adapted to forming a direct-positive image comprised of a dispersing medium, silver halide grains capable of forming an internal latent image, and a nucleating agent. At least 50 percent of the total projected area of the silver halide grains is provided by tabular grains which have an average thickness of less than 0.5 micron and an average aspect ratio of greater than 8:1.

In another aspect, this invention is directed to a photographic element comprised of a support and at least one radiation-sensitive emulsion layer comprised of a radiation-sensitive emulsion as described above.

In an additional aspect, this invention is directed to a photographic image transfer film unit comprising a support, at least one emulsion layer on the support containing a dispersing medium, radiation-sensitive silver halide grains capable of forming an internal latent image, and a nucleating agent adsorbed to the surface of said silver halide grains. At least 50 percent of the total projected area of the silver halide grains is provided by tabular grains which have an average aspect ratio of greater than 8:1.

It is an advantage of the present invention that direct-positive and, more specifically, direct reversal images can be produced while realizing also the advantages of tabular grain emulsions. The emulsions of the present invention exhibit improved stability and less image dependence on temperature as compared to nontabular direct reversal emulsions. Further, the emulsions of the present invention in certain preferred embodiments permit wider exposure latitude without encountering rereversal.

Kofron et al, cited above, discloses significant advantages in speed-granularity relationship, sharpness, and blue and minus blue sensitivity differences for chemically and spectrally sensitized high aspect ratio tabular grain emulsions. The high aspect ratio tabular grain emulsions enhance sharpness of underlying emulsion layers when they are positioned to receive light that is free of significant scattering. These emulsions are particularly effective in this respect when they are located in the emulsion layers nearest the source of exposing radiation. When spectrally sensitized outside the blue portion of the spectrum, the high aspect ratio tabular grain silver bromide and bromoiodide emulsions exhibit a large separation in their sensitivity in the blue region of the spectrum as compared to the region of the spectrum to which they are spectrally sensitized. Minus blue sensitized high aspect ratio tabular grain silver bromide and bromoiodide emulsions are much less sensitive to blue light than to minus blue light and do not require filter protection to provide acceptable minus blue exposure records when exposed in neutral light, such as daylight at 5500° K. The high aspect ratio tabular grain silver bromoiodide emulsions exhibit improved speed-granularity relationships as compared to previously known tabular grain emulsions and as compared to the best speed-granularity relationships heretofore achieved with silver bromoiodide emulsions generally. Very large increases in blue speed of high aspect ratio tabular grain silver bromide and bromoiodide emulsions have been realized as compared to their native blue speed when blue spectral sensitizers are employed. These advantages can also be realized by the present invention.

Jones and Hill, cited above, teaches that photographic image transfer film units containing one or more high aspect ratio tabular grain emulsion layers are capable of producing viewable images with less time elapsed after the commencement of processing. Further, the image transfer film units are capable of producing images of improved sharpness. They are particularly advantageous as applied to multicolor dye image formation, permitting reduction in silver coverages, more efficient use of dye image formers, more advantageous layer order arrangements, and elimination or reduction of yellow filter materials. These advantages can also be realized by the image transfer film units of this invention.

BRIEF DESCRIPTION OF THE DRAWINGS

The invention can be better understood by reference to the following detailed description of preferred embodiments considered in conjunction with the drawings, in which.

DESCRIPTION OF PREFERRED EMBODIMENTS

Figure 1:
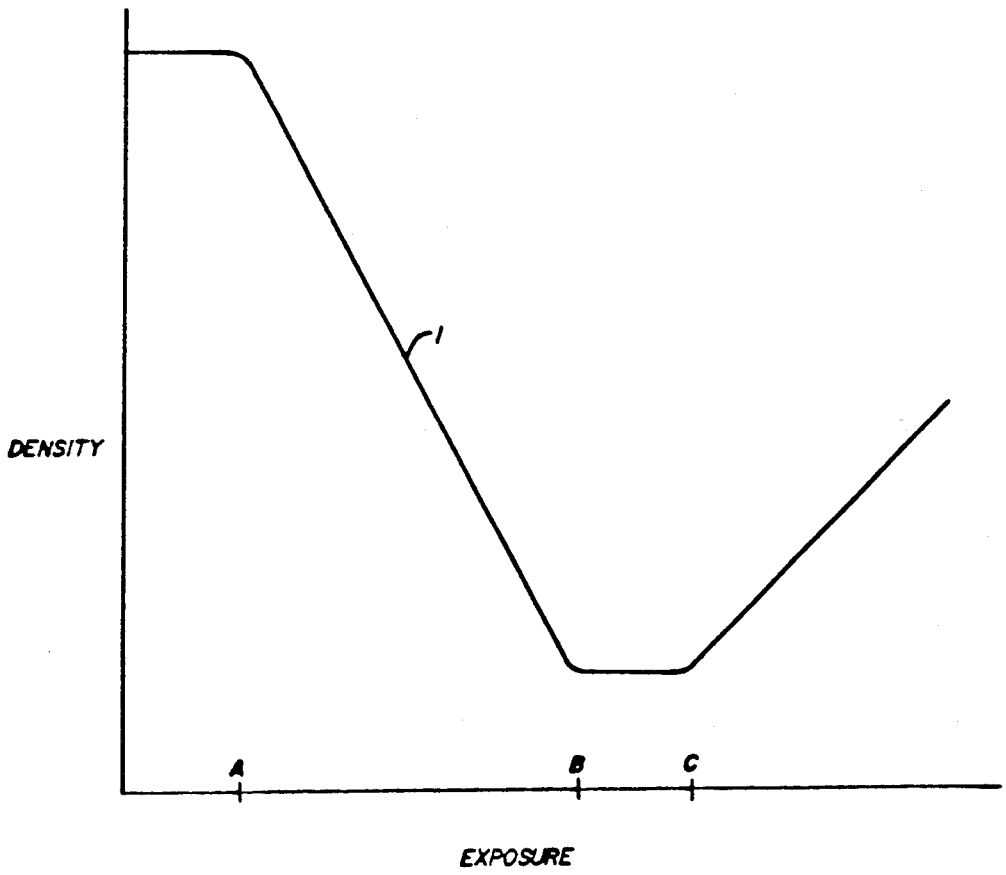
FIG. 1 is a stylized characteristic curve of a direct reversal emulsion.

This invention relates to high aspect ratio tabular grain direct-positive silver halide emulsions and to photographic elements which incorporate one or more of these emulsions. In one specific aspect this invention is directed to photographic image transfer film units comprised of a photographic support, one or more high aspect ratio tabular grain direct reversal emulsions, and a receiving layer for providing a viewable transferred image following imagewise exposure and processing of the silver halide emulsion.

Although the invention is described below employing topic headings for convenience, it is intended that the description be read and interpreted as a whole to appreciate the invention fully.

Tabular Internal Latent Image-Forming Emulsions

The emulsions employed in the practice of this invention are high aspect ratio tabular grain internal latent image-forming emulsions. The emulsions are comprised of a dispersing medium, silver halide grains capable of forming an internal latent image, and a nucleating agent. As applied to the emulsions of the present invention the term "high aspect ratio" is herein defined as requiring that the silver halide grains of the emulsion have an average aspect ratio of greater than 8:1 and account for at least 50 percent of the total projected area of the silver halide grains.

As employed herein the term "aspect ratio" refers to the ratio of the diameter of the grain to its thickness. The "diameter" of the grain is in turn defined as the diameter of a circle having an area equal to the projected area of the grain as viewed in a photomicrograph of an emulsion sample. The internal latent image-forming tabular grains of the present invention have an average aspect ratio of greater than 8:1 and preferably have an average aspect ratio of greater than 10:1. Under optimum conditions of preparation aspect ratios of 50:1 or even 100:1 are contemplated. As will be apparent, the thinner the grains, the higher their aspect ratio for a given diameter. Typically grains of desirable aspect ratios are those having an average thickness of less than 0.5 micron, preferably less than 0.3 micron, and optimally less than 0.2 micron. Typically the tabular grains have an average thickness of at least 0.03 micron, although even thinner tabular grains can in principle be employed—e.g., as low as 0.01 micron, depending on halide content. In a preferred form of the invention the tabular grains account for at least 70 percent and optimally at least 90 percent of the total projected area of the silver halide grains.

Both the average aspect ratios of the tabular grains and the percentage of the total projected area of the silver halide grains present can be determined by procedures well known to those skilled in the art. From shadowed electron micrographs of emulsion samples it is possible to visually identify the tabular grains. These grains have large, substantially planar opposed major surfaces. The opposed major crystal faces of each tabular grain are much larger than any remaining single crystal face of the grain. By measuring the shadow length cast by each tabular grain it is possible to determine its thickness. This can be compared to its diameter to determine its aspect ratio. In practice it is usually simpler to obtain an average thickness and an average diameter of the tabular grains and to calculate the average aspect ratio as the ratio of these two averages. Whether the averaged individual aspect ratios or the averages of thickness and diameter are used to determine the average aspect ratio, within the tolerances of grain measurements contemplated, the average aspect ratios obtained do not significantly differ. The projected areas of the tabular silver halide grains can be summed, the projected areas of the remaining silver halide grains in the photomicrograph can be summed separately, and from the two sums the percentage of the total projected area of the silver halide grains provided by the tabular grains can be calculated. The term "projected area" is used in the same sense as the terms "projection area" and "projective area" commonly employed in the art; see, for example, James and Higgins, *Fundamentals of Photographic Theory,* Morgan and Morgan, New York, p. 15.

The high aspect ratio tabular grain internal latent image-forming emulsions of this invention can be prepared merely by modifying the processes for preparing high aspect ratio tabular grain emulsions such as those taught by Wilgus and Haefner, Daubendiek and Strong, Solberg et al, Wey, and Wey and Wilgus, cited above, to favor the formation of internal latent image centers on exposure. This can be accomplished by employing techniques similar to those demonstrated in the examples of Porter et al. U.S. Pat. No. 3,206,313, Evans U.S. Pat. Nos. 3,761,276 and 3,923,513, and Atwell et al. U.S. Pat. No. 4,035,185, cited above to illustrate conventional direct reversal emulsions and here incorporated by reference. Typically internal latent image-forming silver halide grains prepared by such techniques have an average diameter of at least 0.6 micron, and the preferred tabular grains of this invention also exhibit an average diameter of at least 0.6 micron. Since the tabular quality of high aspect ratio grains is degraded by high levels of halide conversion, the use of halide conversion techniques, such as illustrated by Knott et al and Davey et al, cited above, is not preferred in the practice of this invention. Specific preferred techniques for modifying high aspect ratio tabular grain emulsions during their preparation to favor the formation of internal latent image centers are described below.

Perhaps the simplest manipulative approach to favoring internal latent image formation is to incorporate a metal dopant within the tabular grains as they are being formed. The metal dopant can be placed in the reaction vessel in which grain formation occurs prior to the introduction of silver salt. Alternately the metal dopant can be introduced during silver halide grain growth at any stage of precipitation, with or without interrupting silver and/or halide salt introduction.

Iridium is specifically contemplated as a metal dopant. It is preferably incorporated within the silver halide grains in concentrations of from about $10^{-8}$ to $10^{-4}$ mole per mole of silver. The iridium can be conveniently incorporated into the reaction vessel as a water soluble salt, such as an alkali metal salt of a halogen-iridium coordination complex, such as sodium or potassium hexachloroiridate or hexabromoiridate. Specific examples of incorporating an iridium dopant are provided by Berriman U.S. Pat. No. 3,367,778.

Lead is also a specifically contemplated metal dopant for promoting the formation of internal latent image centers. Lead is a common dopant in direct print and printout emulsions and can be employed in the practice of this invention in similar concentration ranges. It is generally preferred that the lead dopant be present in a concentration of at least $10^{-4}$ mole per mole of silver. Concentrations up to about $5\times10^{-2}$, preferably $2\times10^{-2}$, mole per mole of silver are contemplated. Lead dopants can be introduced similarly as iridium dopants in the form of water soluble salts, such as lead acetate, lead nitrate, and lead cyanide. Lead dopants are particularly illustrated by McBride U.S. Pat. No. 3,287,136 and Bacon U.S. Pat. No. 3,531,291.

Another technique for promoting the formation of internal latent image centers is to stop silver halide grain precipitation after a grain nucleus or core has been produced and to sensitize chemically the surface of the core. Thereafter additional precipitation of silver halide produces a shell surrounding the core. Particularly advantageous chemical sensitizers for this purpose are middle chalcogen sensitizers—i.e., sulfur, selenium, and/or tellurium sensitizers. Middle chalcogen sensitizers are preferably employed in concentrations in the range of from about 0.05 to 15 mg per silver mole. Preferred concentrations are from about 0.1 to 10 mg per silver mole. Further advantages can be realized by employing a gold sensitizer in combination. Gold sensitizers are preferably employed in concentrations ranging from 0.5 to 5 times that of the middle chalcogen sensitizers. Preferred concentrations of gold sensitizers typically range from about 0.01 to 40 mg per mole of silver, most preferably from about 0.1 to 20 mg per mole of silver. Controlling contrast by controlling the ratio of middle chalcogen to gold sensitizer is particularly taught by Atwell et al U.S. Pat. No. 4,035,185, cited above and here incorporated by reference specifically for this teaching. Evans, cited above, provides specific examples of middle chalcogen internal sensitizations.

Although it is usually preferred to produce internal sensitization sites by the occlusion of foreign (i.e., other than silver and halogen) materials within the tabular grains, this is not required. Sensitization sites formed by the occlusion of foreign materials are hereinafter referred to as internal chemical sensitization sites to distinguish them from internal physical sensitization sites. It is possible to incorporate internal physical sensitization sites by providing irregularities in the crystal lattice for capturing photolytically generated electrons. Such internal irregularities can be created by discontinuities in silver halide grain precipitation or by abrupt changes in the halide content of the tabular grains. For example, it has been observed that the precipitation of a tabular silver bromide core followed by shelling with silver bromoiodide of greater than 5 mole percent iodide requires no internal chemical sensitization to produce a direct reversal image.

Silver halide surrounds the internal sensitization sites within the tabular grains. The minimum amount of overlying silver halide is just that required to prevent access of the developer employed in processing to the internal latent image. This will vary as a function of the ability of the developer to dissolve the silver halide grains during development. For developers having very low silver halide solvency the latent image centers can be located only a few crystal lattice planes below the surface of the tabular silver halide grains. If the internal latent image center forms at or near the center of the grain, as where a metal dopant is present in the reaction vessel at the start of silver halide precipitation, then all or most of the silver halide forming the grain will lie between the latent image center and the grain surface. On the other hand, if a tabular silver halide grain is precipitated to substantially its final size and aspect ratio before internal sensitization, the addition of only a small amount of additional silver halide is needed to protect the sensitization sites from a surface or sub-surface developer. The placement of internal sensitization sites in silver halide grains is particularly illustrated by Morgan U.S. Pat. No. 3,917,485 and *Research Disclosure*, Vol. 181, May 1979, Item 18155. Since grain nuclei formation is critical to obtaining tabular grains of high aspect ratio, it is generally preferred to delay internal sensitization until at least the commencement of the growth stage of tabular grain formation. When internal sensitization is delayed until the tabular grains have substantially achieved their desired size and aspect ratio, then additional silver halide can be precipitated onto the tabular grains by any conventional silver halide precipitation technique, including Ostwald ripening of a blended shell emulsion as taught by Porter et al U.S. Pat. Nos. 3,206,313 and 3,317,322.

The amount of overexposure which can be tolerated without encountering rereversal can be increased by incorporating into the tabular silver halide grains metal dopants for this purpose. Hoyen, cited above and here incorporated by reference, discloses the use of divalent and trivalent metal ions as dopants in the shell of core-shell emulsions to reduce rereversal. Preferred metal dopants for this purpose are cationic cadmium, zinc, lead, and erbium. These dopants are generally effective at concentration levels below about $5\times10^{-4}$, preferably below $5\times10^{-5}$, mole per mole of silver. Dopant concentrations of at least $10^{-6}$, preferably at least $5\times10^{-6}$, mole per silver mole, should be present in the reaction vessel during silver halide precipitation. The rereversal modifying dopant is effective if introduced at any stage of silver halide precipitation. If the tabular silver halide grains are viewed as being comprised of a core and a shell, the rereversal modifying dopant can be incorporated in either or both of the core and shell. It is preferred that the dopant be introduced during the latter stages of precipitation (e.g., confined to the shell) for reasons previously noted. The metal dopants can be introduced into the reaction vessel as water soluble metal salts, such as divalent and trivalent metal halide salts. Zinc, lead, and cadmium dopants for silver halide in similar concentrations, but to achieve other modifying effects, are disclosed by McBride U.S. Pat. No. 3,287,136, Mueller et al. U.S. Pat. No. 2,950,972, Iwaosa et al. U.S. Pat. No. 3,901,711, and Atwell U.S. Pat. No. 4,269,927. Other techniques for improving rereversal characteristics discussed below can be employed independently or in combination with the metal dopants described.

Preferred high aspect ratio internal latent image-forming tabular grain emulsions according to this invention are silver bromide and bromoiodide emulsions. Subject to modifications to produce internal sensitization sites and incorporate metal dopants as described above, high aspect ratio tabular grain silver bromoiodide emulsions can be prepared by a precipitation process which forms a part of the Wilgus and Haefner invention. Into a conventional reaction vessel for silver halide precipitation equipped with an efficient stirring mechanism is introduced a dispersing medium. Typically the dispersing medium initially introduced into the reaction vessel is at least about 10 percent, preferably 20 to 80 percent, by weight based on total weight of the dispersing medium present in the silver bromoiodide emulsion at the conclusion of grain precipitation. Since dispersing medium can be removed from the reaction vessel by ultrafiltration during silver bromoiodide grain precipitation, as taught by Mignot U.S. Pat. No. 4,334,012, here incorporated by reference, it is appreciated that the volume of dispersing medium initially present in the reaction vessel can equal or even exceed the volume of the silver bromoiodide emulsion present in the reaction vessel at the conclusion of grain precipitation. The dispersing medium initially introduced into the reaction vessel is preferably water or a dispersion of peptizer in water, optionally containing other ingredients, such as one or more silver halide ripening agents and/or metal dopants, more specifically described below. Where a peptizer is initially present, it is preferably employed in a concentration of at least 10 percent, most preferably at least 20 percent, of the total peptizer present at the completion of silver bromoiodide precipitation. Additional dispersing medium is added to the reaction vessel with the silver and halide salts and can also be introduced through a separate jet. It is common practice to adjust the proportion of dispersing medium, particularly to increase the proportion of peptizer, after the completion of the salt introductions.

In employing precipitation procedures as taught by Wilgus and Haefner, cited above, a minor portion, typically less than 10 percent, of the bromide salt employed in forming the silver bromoiodide grains is initially present in the reaction vessel to adjust the bromide ion concentration of the dispersing medium at the outset of silver bromoiodide precipitation. Also, the dispersing medium in the reaction vessel is initially substantially free of iodide ions, since the presence of iodide ions prior to concurrent introducton of silver and bromide salts favors the formation of thick and nontabular grains. As employed herein, the term "substantially free of iodide ions" as applied to the contents of the reaction vessel means that there are insufficient iodide ions present as compared to bromide ions to precipitate as a separate silver iodide phase. It is preferred to maintain the iodide concentration in the reaction vessel prior to silver salt introduction at less than 0.5 mole percent of the total halide ion concentration present. If the pBr of the dispersing medium is initially too high, the tabular silver bromoiodide grains produced will be comparatively thick and therefore of low aspect ratios. It is contemplated to maintain the pBr of the reaction vessel initially at or below 1.6, preferably below 1.5. On the other hand, if the pBr is too low, the formation of nontabular silver bromoiodide grains is favored. Therefore, it is contemplated to maintain the pBr of the reaction vessel at or above 1.1. As herein employed, pBr is defined as the negative logarithm of bromide ion concentration. pH, pI, and pAg are similarly defined for hydrogen, iodide, and silver ion concentrations, respectively.

During precipitation silver, bromide, and iodide salts are added to the reaction vessel by techniques well known in the precipitation of silver bromoiodide grains. Typically an aqueous silver salt solution of a soluble silver salt, such as silver nitrate, is introduced into the reaction vessel concurrently with the introduction of the bromide and iodide salts. The bromide and iodide salts are also typically introduced as aqueous salt solutions, such as aqueous solutions of one or more soluble ammonium, alkali metal (e.g., sodium or potassium), or alkaline earth metal (e.g., magnesium or calcium) halide salts. The silver salt is at least initially introduced into the reaction vessel separately from the bromide and iodide salts. The iodide and bromide salts are added to the reaction vessel separately or as a mixture.

With the introduction of silver salt into the reaction vessel the nucleation stage of grain formation is initiated. A population of grain nuclei are formed which are capable of serving as precipitation sites for silver bromide and silver iodide as the introduction of silver, bromide, and iodide salts continues. The precipitation of silver bromide and silver iodide onto existing grain nuclei constitutes the growth stage of grain formation. The aspect ratios of the tabular grains formed according to this invention are less affected by iodide and bromide concentrations during the growth stage than during the nucleation stage. It is therefore possible to increase the permissible latitude of pBr during concurrent introduction of silver, bromide, and iodide salts above 0.6, preferably in the range of from about 0.6 to 2.2, most preferably from about 0.8 to about 1.6. It is, of course, possible and, in fact, preferred to maintain the pBr within the reaction vessel throughout silver and halide salt introduction within the initial limits, described above prior to silver salt introduction. This is particularly preferred where a substantial rate of grain nuclei formation continues throughout the introduction of silver, bromide, and iodide salts, such as in the preparation of highly polydispersed emulsions. Raising pBr values above 2.2 during tabular grain growth results in thickening of the grains, but can be tolerated in many instances while still realizing an average aspect ratio of greater than 8:1.

As an alternative to the introduction of silver, bromide, and iodide salts as aqueous solutions, it is specifically contemplated to introduce the silver, bromide, and iodide salts, initially or in the growth stage, in the form of fine silver halide grains suspended in dispersing medium. The grains are sized so that they are readily Ostwald ripened onto larger grain nuclei, if any are present, once introduced into the reaction vessel. The maximum useful grain sizes will depend on the specific conditions within the reaction vessel, such as temperature and the presence of solubilizing and ripening agents. Silver bromide, silver iodide, and/or silver bromoiodide grains can be introduced. (Since bromide and/or iodide are precipitated in preference to chloride, it is also possible to employ silver chlorobromide and silver chlorobromoiodide grains.) The silver halide grains are preferably very fine—e.g., less than 0.1 micron in mean diameter.

Subject to the pBr requirements set forth above, the concentrations and rates of silver, bromide, and iodide salt introductions can take any convenient conventional form. The silver and halide salts are preferably introduced in concentrations of from 0.1 to 5 moles per liter, although broader conventional concentration ranges, such as from 0.01 mole per liter to saturation, for example, are contemplated. Specifically preferred precipitation techniques are those which achieve shortened precipitation times by increasing the rate of silver and halide salt introduction during the run. The rate of silver and halide salt introduction can be increased either by increasing the rate at which the dispersing medium and the silver and halide salts are introduced or by increasing the concentrations of the silver and halide salts within the dispersing medium being introduced. It is specifically preferred to increase the rate of silver and halide salt introduction, but to maintain the rate of introduction below the threshold level at which the formation of new grain nuclei is favored—i.e., to avoid renucleation, as taught by Irie U.S. Pat. No. 3,650,757, Kurz U.S. Pat. No. 3,672,900, Saito U.S. Pat. No. 4,242,445, Wilgus German OLS No. 2,107,118, Teitscheid et al European Patent Application No. 80102242, and Wey "Growth Mechanism of AgBr Crystals in Gelatin Solution", *Photographic Science and Engineering*, Vol. 21, No. 1, January/February 1977, p. 14, et. seq. By avoiding the formation of additional grain nuclei after passing into the growth stage of precipitation, relatively monodispersed tabular silver bromoiodide grain Populations can be obtained. Emulsions having coefficients of variation of less than about 30 percent can be prepared. (As employed herein the coefficient of variation is defined 100 times as the standard deviation of the grain diameter divided by the average grain diameter.) By intentionally favoring renucleation during the growth stage of precipitation, it is, of course, possible to produce poly-dispersed emusions of substantially higher coefficients of variation.

The concentration of iodide in the silver bromoiodide emulsions of this invention can be controlled by the introduction of iodide salts. Any conventional iodide concentration can be employed. Even very small amounts of iodide—e.g., as low as 0.05 mole percent—are recognized in the art to be beneficial. In their preferred form the emulsions of the present invention incorporate at least about 0.1 mole percent iodide. Silver iodide can be incorporated into the tabular silver bromoiodide grains up to its solubility limit in silver bromide at the temperature of grain formation. Thus, silver iodide concentrations of up to about 40 mole percent in the tabular silver bromoiodide grains can be achieved at precipitation temperatures of 90° C. In practice precipitation temperatures can range down to near ambient room temperatures—e.g., about 30° C. It is generally preferred that precipitation be undertaken at temperatures in the range of from 40° to 80° C. For most photographic applications it is preferred to limit maximum iodide concentrations to about 20 mole percent, with optimum iodide concentrations being up to about 15 mole percent.

The relative proportion of iodide and bromide salts introduced into the reaction vessel during precipitation can be maintained in a fixed ratio to form a substantially uniform iodide profile in the tabular silver bromoiodide grains or varied to achieve differing photographic effects. Solberg et al, cited above, has recognized that advantages in photographic speed and/or grain result from increasing the proportion of iodide in annular regions of high aspect ratio tabular grain silver bromoiodide emulsions as compared to central regions of the tabular grains. Solberg et al teaches iodide concentrations in the central regions of the tabular grains of from 0 to 5 mole percent, with at least one mole percent higher iodide concentrations in the laterally surrounding annular regions up to the solubility limit of silver iodide in silver bromide, preferably up to about 20 mole percent and optimally up to about 15 mole percent. In a variant form it is specifically contemplated to terminate iodide or bromide and iodide salt addition to the reaction vessel prior to the termination of silver salt addition so that excess bromide reacts with the silver salt. This results in a shell of silver bromide being formed on the tabular silver bromoiodide grains. Thus, it is apparent that the tabular silver bromoiodide grains of the present invention can exhibit substantially uniform or graded iodide concentration profiles and that the gradation can be controlled, as desired, to favor higher iodide concentrations internally or at or near the surfaces of the tabular silver bromoiodide grains.

It has been discovered quite unexpectedly that increased exposure latitude prior to rereversal can be achieved by employing higher iodide concentrations in outer grain regions than in central grain regions. For example, if the grain is viewed as a core surrounded by one or more shells, it has been observed that incorporating at least two mole percent more iodide in one or more shells than is present in the grain core increases the exposure level required to produce rereversal. It is preferred that at least one shell have an iodide content that is at least 6 mole percent, optimally at least 10 mole percent, greater than the iodide content of the core. In a specifically contemplated form the core can be substantially free of iodide. Preferably the iodide content of the core and shell are related similar as the central and annular regions discussed above. It is specifically contemplated to employ two, three, or even more shells, each increasing in iodide content with respect to silver halide located internally thereof.

Although the preparation of the high aspect ratio tabular grain silver bromoiodide emulsions has been described by reference to the process of Wilgus and Haefner, which produces neutral or nonammoniacal emulsions, the emulsions of the present invention and their utility are not limited by any particular process for their preparation. A process of preparing high aspect ratio tabular grain silver bromoiodide emulsions discovered subsequent to that of the present invention is described by Daubendiek and Strong, cited above and here incorporated by reference. Daubendiek and Strong teaches an improvement over the processes of Maternaghan, cited above, wherein in a preferred form the silver iodide concentration in the reaction vessel is reduced below 0.05 mole per liter and the maximum size of the silver iodide grains initially present in the reaction vessel is reduced below 0.05 micron.

High aspect ratio tabular grain silver bromide emulsions lacking iodide can be prepared by the process described by Wilgus and Haefner modified to exclude iodide. High aspect ratio tabular grain silver bromide emulsions can alternatively be prepared following a procedure similar to that employed by Cugnac and Chateau, cited above and here incorporated by reference. High aspect ratio silver bromide emulsions containing square and rectangular grains can be prepared as taught by Mignot U.S. Pat. No. 4,386,156, cited above. In this process cubic seed grains having an edge length of less than 0.15 micron are employed. While maintaining the pAg of the seed grain emulsion in the range of from 5.0 to 8.0, the emulsion is ripened in the substantial absence of nonhalide silver ion complexing agents to produce tabular silver bromide grains having an average aspect ratio of at least 8.5:1. Still other preparations of high aspect ratio tabular grain silver bromide emulsions lacking iodide are illustrated in the examples.

To illustrate other high aspect ratio tabular grain silver halide emulsions which can be employed in the practice of this invention, attention is directed to Wey, cited above and here incorporated by reference, which discloses a process of preparing tabular silver chloride grains which are substantially internally free of both silver bromide and silver iodide. Wey employs a double-jet precipitation process wherein chloride and silver salts are concurrently introduced into a reaction vessel containing dispersing medium in the presence of ammonia. During chloride salt introduction the pAg within the dispersing medium is in the range of from 6.5 to 10 and the pH in the range of from 8 to 10. The presence of ammonia and higher temperatures tends to cause thick grains to form, therefore precipitation temperatures are limited to up to 60° C. The process can be optimized to produce high aspect ratio tabular grain silver chloride emulsions.

Maskasky U.S. Pat. No. 4,400,463, titled SILVER CHLORIDE EMULSIONS OF MODIFIED CRYSTAL HABIT AND PROCESSES FOR THEIR PREPARATION, here incorporated by reference, discloses a process of preparing tabular grains of at least 50 mole percent chloride having opposed crystal faces lying in {111} crystal planes and, in one preferred form, at least one peripheral edge lying parallel to a <211> crystallographic vector in the plane of one of the major surfaces. Such tabular grain emulsions can be prepared by reacting aqueous silver and chloride-containing halide salt solutions in the presence of a crystal habit modifying amount of an aminoazaindene and a peptizer having a thioether linkage.

Wey and Wilgus, U.S. Pat. No. 4,414.306, titled NOVEL SILVER CHLOROBROMIDE EMULSIONS AND PROCESSES FOR THEIR PREPARATION, discloses tabular grain emulsions wherein the silver halide grains contain silver chloride and silver bromide in at least annular grain regions and preferably throughout. The tabular grain regions containing silver chloride and bromide are formed by maintaining a molar ratio of chloride and bromide ions of from 1.6 to about 260:1 and the total concentration of halide ions in the reaction vessel in the range of from 0.10 to 0.90 normal during introduction of silver, chloride, bromide, and, optionally, iodide salts into the reaction vessel. The molar ratio of silver chloride to silver bromide in the tabular grains can range from 1:99 to 2:3.

The individual silver and halide salts can be added to the reaction vessel through surface or subsurface delivery tubes by gravity feed or by delivery apparatus for maintaining control of the rate of delivery and the pH, pBr, and/or pAg of the reaction vessel contents, as illustrated by Culhane et al U.S. Pat. No. 3,821,002, Oliver U.S. Pat. No. 3,031,304 and Claes et al, *Photographische Korrespondenz,* Band 102, Number 10, 1967, p. 162. In order to obtain rapid distribution of the reactants within the reaction vessel, specially contructed mixing devices can be employed, as illustrated by Audran U.S. Pat. No. 2,996,287, McCrossen et al U.S. Pat. No. 3,342,605, Frame et al U.S. Pat. No. 3,415,650, Porter et al U.S. Pat. No. 3,785,777, Finnicum et al U.S. Pat. No. 4,147,551, Verhille et al U.S. Pat. No. 4,171,224, Calamur U.K. Patent application No. 2,022,431A, Saito et al German OLS Nos. 2,555,364 and 2,556,885, and *Research Disclosure,* Volume 166, February 1978, Item 16662.

In forming the tabular grain emulsions peptizer concentrations of from 0.2 to about 10 percent by weight, based on the total weight of emulsion components in the reaction vessel, can be employed. It is common practice to maintain the concentration of the peptizer in the reaction vessel in the range of below about 6 percent, based on the total weight, prior to and during silver halide formation and to adjust the emulsion vehicle concentration upwardly for optimum coating characteristics by delayed, supplemental vehicle additions. It is contemplated that the emulsion as initially formed will contain from about 5 to 50 grams of peptizer per mole of silver halide, preferably about 10 to 30 grams of peptizer per mole of silver halide. Additional vehicle can be added later to bring the concentration up to as high as 1000 grams per mole of silver halide. Preferably the concentration of vehicle in the finished emulsion is above 50 grams per mole of silver halide. When coated and dried in forming a photographic element the vehicle preferably forms about 30 to 70 percent by weight of the emulsion layer.

Vehicles (which include both binders and peptizers) can be chosen from among those conventionally employed in silver halide emulsions. Preferred peptizers are hydrophilic colloids, which can be employed alone or in combination with hydrophobic materials. Suitable hydrophilic materials include both naturally occurring substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, agar-agar, arrowroot, albumin and the like as described in Yutzy et al U.S. Pat. Nos. 2,614,928 and '929, Lowe et al U.S. Pat. Nos. 2,691,582, 2,614,930, '931, 2,327,808 and 2,448,534, Gates et al U.S. Pat. No. 2,787,545 and 2,956,880, Himmelmann et al U.S. Pat. No. 3,061,436, Farrell et al U.S. Pat. No. 2,816,027, Ryan U.S. Pat. Nos. 3,132,945, 3,138,461 and 3,186,846, Dersch et al U.K. Pat. No. 1,167,159 and U.S. Pat. Nos. 2,960,405 and 3,436,220, Geary U.S. Pat. No. 3,486,896, Gazzard U.K. Pat. No. 793,549, Gates et al U.S. Pat. Nos. 2,992,213, 3,157,506, 3,184,312 and 3,539,353, Miller et al U.S. Pat. No. 3,227,571, Boyer et al U.S. Pat. No. 3,532,502, Malan U.S. Pat. No. 3,551,151, Lohmer et al U.S. Pat. No. 4,018,609, Luciani et al U.K. Pat. No. 1,186,790, Hori et al U.K. Pat. No. 1,489,080 and Belgian Pat. No. 856,631, U.K. Pat. No. 1,490,644, U.K. Pat. No. 1,483,551, Arase et al U.K. Pat. No. 1,459,906, Salo U.S. Pat. Nos. 2,110,491 and 2,311,086, Fallesen U.S. Pat. No. 2,343,650, Yutzy U.S. Pat. No. 2,322,085, Lowe U.S. Pat. No. 2,563,791, Talbot et al U.S. Pat. No. 2,725,293, Hilborn U.S. Pat. No. 2,748,022, DePauw et al U.S. Pat. No. 2,956,883, Ritchie U.K. Pat. No. 2,095, DeStubner U.S. Pat. No. 1,752,069, Sheppard et al U.S. Pat. No. 2,127,573, Lierg U.S. Pat. No. 2,256,720, Gaspar U.S. Pat. No. 2,361,936, Farmer U.K. Pat. No. 15,727, Stevens U.K. Pat. No. 1,062,116 and Yamamoto et al U.S. Pat. No. 3,923,517.

Other materials commonly employed in combination with hydrophilic colloid peptizers as vehicles (including vehicle extenders—e.g., materials in the form of latices) include synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like as described in Hollister et al U.S. Pat. Nos. 3,679,425, 3,706,564 and 3,813,251, Lowe U.S. Pat. Nos. 2,253,078, 2,276,322, '323, 2,281,703, 2,311,058 and 2,414,207, Lowe et al U.S. Pat. Nos. 2,484,456, 2,541,474 and 2,632,704, Perry et al U.S. Pat. No. 3,425,836, Smith et al U.S. Pat. Nos. 3,415,653 and 3,615,624, Smith U.S. Pat. No. 3,488,708, Whiteley et al U.S. Pat. Nos. 3,392,025 and 3,511,818, Fitzgerald U.S. Pat. Nos. 3,681,079, 3,721,565, 3,852,073, 3,861,918 and 3,925,083, Fitzgerald et al U.S. Pat. No. 3,879,205, Nottorf U.S. Pat. No. 3,142,568, Houck et al U.S. Pat. Nos. 3,062,674 and 3,220,844, Dann et al U.S. Pat. No. 2,882,161, Schupp U.S. Pat. No. 2,579,016, Weaver U.S. Pat. No. 2,829,053, Alles et al U.S. Pat. No. 2,698,240, Priest et al U.S. Pat. No. 3,003,879, Merrill et al U.S. Pat. No. 3,419,397, Stonham U.S. Pat. No. 3,284,207, Lohmer et al U.S. Pat. No. 3,167,430, Williams U.S. Pat. No. 2,957,767, Dawson et al U.S. Pat. No. 2,893,867, Smith et al U.S. Pat. Nos. 2,860,986 and 2,904,539, Ponticello et al U.S. Pat. Nos. 3,929,482 and 3,860,428, Ponticello U.S. Pat. No. 3,939,130, Dykstra U.S. Pat. No. 3,411,911 and Dykstra et al Canadian Pat. No. 774,054, Ream et al U.S. Pat. No. 3,287,289, Smith U.K. Pat. No. 1,466,600, Stevens U.K. Pat. No. 1,062,116, Fordyce U.S. Pat. No. 2,211,323, Martinez U.S. Pat. No. 2,284,877, Watkins U.S. Pat. No. 2,420,455, Jones U.S. Pat. No. 2,533,166, Bolton U.S. Pat. No. 2,495,918, Graves U.S. Pat. No. 2,289,775, Yackel U.S. Pat. No. 2,565,418, Unruh et al U.S. Pat. Nos. 2,865,893 and 2,875,059, Rees et al U.S. Pat. No. 3,536,491, Broadhead et al U.K. Pat. No. 1,348,815, Taylor et al U.S. Pat. No. 3,479,186, Merrill et al U.S. Pat. No. 3,520,857, Bacon et al U.S. Pat. No. 3,690,888, Bowman U.S. Pat. No. 3,748,143, Dickinson et al U.K. Pat. Nos. 808,227 and '228, Wood U.K. Pat. No. 822,192 and Iguchi et al U.K. Pat. No. 1,398,055. These additional materials need not be present in the reaction vessel during silver halide precipitation, but rather are conventionally added to the emulsion prior to coating. The vehicle materials, including particularly the hydrophilic colloids, as well as the hydrophobic materials useful in combination therewith can be employed not only in the emulsion layers of the photographic elements of this invention, but also in other layers, such as overcoat layers, interlayers and layers positioned beneath the emulsion layers.

It is specifically contemplated that grain ripening can occur during the preparation of silver halide emulsions according to the present invention, and it is preferred that grain ripening occur within the reaction vessel during at least silver bromoiodide grain formation. Known silver halide solvents are useful in promoting ripening. For example, an excess of bromide ions, when present in the reaction vessel, is known to promote ripening. It is therefore apparent that the bromide salt solution run into the reaction vessel can itself promote ripening. Other ripening agents can also be employed and can be entirely contained within the dispersing medium in the reaction vessel before silver and halide salt addition, or they can be introduced into the reaction vessel along with one or more of the halide salt, silver salt, or peptizer. In still another variant the ripening agent can be introduced independently during halide and silver salt additions. Although ammonia is a known ripening agent, it is not a preferred ripening agent for the silver bromoiodide emulsions of this invention exhibiting the highest realized speed-granularity relationships.

Among preferred ripening agents are those containing sulfur. Thiocyanate salts can be used, such as alkali metal, most commonly sodium and potassium, and ammonium thiocyanate salts. While any conventional quantity of the thiocyanate salts can be introduced, preferred concentrations are generally from about 0.1 to 20 grams of thiocyanate salt per mole of silver halide. Illustrative prior teachings of employing thiocyanate ripening agents are found in Nietz et al, U.S. Pat. No. 2,222,264, cited above; Lowe et al U.S. Pat. No. 2,448,534 and Illingsworth U.S. Pat. No. 3,320,069; the disclosures of which are here incorporated by reference. Alternatively, conventional thioether ripening agents, such as those disclosed in McBride U.S. Pat. No. 3,271,157, Jones U.S. Pat. No. 3,574,628, and Rosecrants et al U.S. Pat. No. 3,737,313, here incorporated by reference, can be employed.

The high aspect ratio tabular grain emulsions are preferably washed to remove soluble salts. The soluble salts can be removed by chill setting and leaching, as illustrated by Craft U.S. Pat. No. 2,316,845 and McFall et al U.S. Pat. No. 3,396,027; by coagulation washing, as illustrated by Hewitson et al U.S. Pat. No. 2,618,556, Yutzy et al U.S. Pat. No. 2,614,928, Yackel U.S. Pat. No. 2,565,418, Hart et al U.S. Pat. No. 3,241,969, Waller et al U.S. Pat. No. 2,489,341, Klinger U.K. Pat. No. 1,305,409 and Dersch et al U.K. Pat. No. 1,167,159; by centrifugation and decantation of a coagulated emulsion, as illustrated by Murray U.S. Pat. No. 2,463,794, Ujihara et al U.S. Pat. No. 3,707,378, Audran U.S. Pat. No. 2,996,287 and Timson U.S. Pat. No. 3,498,454; by employing hydrocyclones alone or in combination with centrifuges, as illustrated by U.K. Pat. No. 1,336,692, Claes U.K. Pat. No. 1,356,573 and Ushomirskii et al *Soviet Chemical Industry.* Vol. 6, No. 3, 1974, pp. 181–185; by diafiltration with a semipermeable membrane, as illustrated by *Research Disclosure,* Vol. 102, October 1972, Item 10208, Hagemaier et al *Research Disclosure,* Vol. 131, March 1975, Item 13122, Bonnet *Research Disclosure,* Vol. 135, July 1975, Item 13577, Berg et al German OLS No. 2,436,461, Bolton U.S. Pat. No. 2,495,918, and Mignot U.S. Pat. No. 4,334,012, cited above, or by employing an ion exchange resin, as illustrated by Maley U.S. Pat. No. 3,782,953 and Noble U.S. Pat. No. 2,827,428. The emulsions, with or without sensitizers, can be dried and stored prior to use as illustrated by *Research Disclosure,* Vol. 101, September 1972, Item 10152. In the present invention washing is particularly advantageous in terminating ripening of the tabular grains after the completion of precipitation to avoid increasing their thickness and reducing their aspect ratio.

Although the procedures for preparing tabular silver halide grains described above will produce high aspect ratio tabular grain emulsions in which the tabular grains account for at least 50 percent of the total projected area of the total silver halide grain population, it is recognized that advantages can be realized by increasing the proportion of such tabular grains present. Preferably at least 70 percent (optimally at least 90 percent) of the total projected area is provided by tabular silver halide grains. While minor amounts of nontabular grains are fully compatible with many photographic applications, to achieve the full advantages of tabular grains the proportion of tabular grains can be increased. Larger tabular silver halide grains can be mechanically separated from smaller, nontabular grains in a mixed population of grains using conventional separation techniques—e.g., by using a centrifuge or hydrocyclone. An illustrative teaching of hydrocyclone separation is provided by Audran et al U.S. Pat. No. 3,326,641.

The high aspect ratio tabular grain internal latent image-forming emulsions of the present invention are preferably intentionally surface chemically sensitized to increase their photographic speed. Useful surface chemical sensitizations are taught by Evans U.S. Pat. No. 3,761,276 and 3,923,513 and Atwell et al U.S. Pat. No. 4,035,185, each previously cited and here incorporated by reference for their specific teaching. Any type of surface chemical sensitization known to be useful with corresponding surface latent image-forming silver halide emulsions can be employed, but the degree of surface chemical sensitization is limited to that which will increase the reversal speed of the internal latent image-forming emulsion, but which will not compete with the internal sensitization sites to the extent of causing the location of latent image centers formed on exposure to shift from the interior to the surface of the tabular grains.

Thus, a balance between internal and surface sensitization is preferably maintained for maximum speed, but with the internal sensitization predominanting. Tolerable levels of surface chemical sensitization can be readily determined by the following test: A sample of the high aspect ratio tabular grain internal latent image-forming silver halide emulsion of the present invention is coated on a transparent film support at a silver coverage of 4 grams per square meter. The coated sample is then exposed to a 500 watt tungsten lamp for times ranging from 0.01 to 1 second at a distance of 0.6 meter. The exposed coated sample is then developed for 5 minutes at 20° C. in Developer Y below (an "internal type" developer, note the incorporation of iodide to provide access to the interior of the grain), fixed, washed, and dried. The procedure described above is repeated with a second sample identically coated and exposed. Processing is also identical, except that Developer X below (a "surface type" developer) is substituted for Developer Y. To satisfy the requirements of the present invention as being a useful internal latent image-forming emulsion the sample developed in the internal type developer, Developer Y, must exhibit a maximum density at least 5 times greater than the sample developed in the surface type developer, Developer X. This difference in density is a positive indication that the latent image centers of the silver halide grains are forming predominantly in the interior of the grains and are for the most part inaccessible to the surface type developer.

| Developer X | Grams |
|---|---|
| N—methyl-p-aminophenol sulfate | 2.5 |
| Ascorbic acid | 10.0 |
| Potassium metaborate | 35.0 |
| Potassium bromide | 1.0 |

-continued

| Developer X | Grams |
|---|---|
| Water to 1 liter. | |

| Developer Y | Grams |
|---|---|
| N—methyl-p-aminophenol sulfate | 2.0 |
| Sodium sulfite, desiccated | 90.0 |
| Hydroquinone | 8.0 |
| Sodium carbonate, monohydrate | 52.5 |
| Potassium bromide | 5.0 |
| Potassium iodide | 0.5 |
| Water to 1 liter. | |

The high aspect ratio tabular grain internal latent image-forming silver halide emulsions of the present invention can be surface chemically sensitized with active gelatin, as illustrated by T. H. James, *The Theory of the Photographic Process,* 4th Ed., Macmillan, 1977, pp. 67–76, or with sulfur, selenium, tellurium, gold, platinum, palladium, iridium, osmium, rhodium, rhenium, or phosphorus sensitizers or combinations of these sensitizers, such as at pAg levels of from 5 to 10, pH levels of from 5 to 8 and temperatures of from 30 to 80° C., as illustrated by *Research Disclosure,* Vol. 120, April 1974, Item 12008, *Research Disclosure,* Vol. 134, June 1975, Item 13452, Sheppard et al U.S. Pat. No. 1,623,499, Matthies et al U.S. Pat. No. 1,673,522, Waller et al U.S. Pat. No. 2,399,083, Damschroder et al U.S. Pat. No. 2,642,361, McVeigh U.S. Pat. No. 3,297,447, Dunn U.S. Pat. No. 3,297,446, McBride U.K. Pat. No. 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415 and Simons U.K. Pat. No. 1,396,696; chemical sensitization being optionally conducted in the presence of thiocyanate compounds, as described in Damschroder U.S. Pat. No. 2,642,361, and sulfur containing compounds of the type disclosed in Lowe et al U.S. Pat. No. 2,521,926, Williams et al U.S. Pat. No. 3,021,215, and Bigelow U.S. Pat. No. 4,054,457. It is specifically contemplated to sensitize chemically in the presence of finish (chemical sensitization) modifiers—that is, compounds known to suppress fog and increase speed when present during chemical sensitization, such as azaindenes, azapyridazines, azapyrimidines, benzothiazolium salts, and sensitizers having one or more heterocyclic nuclei. Exemplary finish modifiers are described in Brooker et al U.S. Pat. No. 2,131,038, Dostes U.S. Pat. No. 3,411,914, Kuwabara et al U.S. Pat. No. 3,554,757, Oguchi et al U.S. Pat. No. 3,565,631, Oftedahl U.S. Pat. No. 3,901,714, Walworth Canadian Pat. No. 778,723, and Duffin *Photographic Emulsion Chemistry,* Focal Press (1966), New York, pp. 138–143. Additionally or alternatively, the emulsions can be reduction sensitized—e.g., with hydrogen, as illustrated by Janusonis U.S. Pat. No. 3,891,446 and Babcock et al U.S. Pat. No. 3,984,249, by low pAg (e.g., less than 5) and/or high pH (e.g., greater than 8) treatment or through the use of reducing agents, such as stannous chloride, thiourea dioxide, polyamines and amineboranes, as illustrated by Allen et al U.S. Pat. No. 2,983,609, Oftedahl et al *Research Disclosure,* Vol. 136, August 1975, Item 13654, Lowe et al U.S. Pat. Nos. 2,518,698 and 2,739,060, Roberts et al U.S. Pat. Nos. 2,743,182 and '183, Chambers et al U.S. Pat. No.

guide in selecting useful blue sensitizers. Generally the shorter the methine chain, the shorter the wavelength of the sensitizing maximum. Nuclei also influence absorption. The addition of fused rings to nuclei tends to favor longer wavelengths of absorption. Substituents can also alter absorption characteristics.

Among useful spectral sensitizing dyes for sensitizing silver halide emulsions are those found in U.K. Pat. No. 742,112, Brooker U.S. Pat. Nos. 1,846,300, '301, '302, '303, '304, 2,078,233 and 2,089,729, Brooker et al U.S. Pat. Nos. 2,165,338, 2,213,238, 2,231,658, 2,493,747, '748, 2,526,632, 2,739,964 (U.S. Pat. No. Re. 24,292), 2,778,823, 2,917,516, 3,352,857, 3,411,916 and 3,431,111, Wilmanns et al U.S. Pat. No. 2,295,276, Sprague U.S. Pat. Nos. 2,481,698 and 2,503,776, Carroll et al U.S. Pat. Nos. 2,688,545 and 2,704,714, Larive et al U.S. Pat. No. 2,921,067, Jones U.S. Pat. No. 2,945,763, Nys et al U.S. Pat. No. 3,282,933, Schwan et al U.S. Pat. No. 3,397,060, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349. Examples of useful dye combinations, including supersensitizing dye combinations, are found in Motter U.S. Pat. No. 3,506,443 and Schwan et al U.S. Pat. No. 3,672,898. As examples of supersensitizing combinations of spectral sensitizing dyes and nonlight absorbing addenda, it is specifically contemplated to employ thiocyanates during spectral sensitization, as taught by Leermakers U.S. Pat. No. 2,221,805; bis-triazinylaminostilbenes, as taught by McFall et al U.S. Pat. No. 2,933,390; sulfonated aromatic compounds, as taught by Jones et al U.S. Pat. No. 2,937,089; mercapto-substituted heterocycles as taught by Riester U.S. Pat. No. 3,457,078; iodide, as taught by U.K. Pat. No. 1,413,826; and still other compounds, such as those disclosed by Gilman, "Review of the Mechanisms of Supersensitization", cited above.

Conventional amounts of dyes can be employed in spectrally sensitizing the emulsion layers containing nontabular or low aspect ratio tabular silver halide grains. To realize the full advantages of this invention it is preferred to adsorb spectral sensitizing dye to the grain surfaces of the high aspect ratio tabular grain emulsions in a substantially optimum amount—that is, in an amount sufficient to realize at least 60 percent of the maximum photographic speed attainable from the grains under contemplated conditions of exposure. The quantity of dye employed will vary with the specific dye or dye combination chosen as well as the size and aspect ratio of the grains. It is known in the photographic art that optimum spectral sensitization is obtained with organic dyes at about 25 percent to 100 percent or more of monolayer coverage of the total available surface area of surface sensitive silver halide grains, as disclosed, for example, in West et al, "The Adsorption of Sensitizing Dyes in Photographic Emulsions", *Journal of Phys. Chem.*, Vol 56, p. 1065, 1952, Spence et al, "Desensitization of Sensitizing Dyes", *Journal of Physical and Colloid Chemistry*, Vol. 56, No. 6, June 1948, pp. 1090–1103; and Gilman et al U.S. Pat. No. 3,979,213. Optimum dye concentration levels can be chosen by procedures taught by Mees, *Theory of the Photographic Process*, pp. 1067–1069.

Spectral sensitization can be undertaken at any stage of emulsion preparation heretofore known to be useful. Most commonly spectral sensitization is undertaken in the art subsequent to the completion of chemical sensitization. However, it is specifically recognized that spectral sensitization can be undertaken alternatively concurrently with chemical sensitization, can entirely precede chemical sensitization, and can even commence prior to the completion of silver halide grain precipitation, as taught by Philippaerts et al U.S. Pat. No. 3,628,960, and Locker et al U.S. Pat. No. 4,225,666. As taught by Locker et al, it is specifically contemplated to distribute introduction of the spectral sensitizing dye into the emulsion so that a portion of the spectral sensitizing dye is present prior to chemical sensitization and a remaining portion is introduced after chemical sensitization. Unlike Locker et al, it is specifically contemplated that the spectral sensitizing dye can be added to the emulsion after 80 percent of the silver halide has been precipitated. Sensitization can be enhanced by pAg adjustment, including cycling, during chemical and/or spectral sensitization. A specific example of pAg adjustment is provided by *Research Disclosure*, Vol. 181, May 1979, Item 18155.

It has been discovered quite unexpectedly by Kofron et al, cited above, that high aspect ratio tabular grain silver halide emulsions can exhibit improved speed-granularity relationships when chemically and spectrally sensitized than have been heretofore realized using tabular grain silver halide emulsions and have been heretofore realized using silver halide emulsions of the highest known speed-granularity relationships. Best results have been achieved using minus blue (red and/or green) spectral sensitizing dyes.

Although not required to realize all of their advantages, the emulsions of the present invention are preferably, in accordance with prevailing manufacturing practices, substantially optimally chemically and spectrally sensitized. That is, they preferably achieve speeds of at least 60 percent of the maximum log speed attainable from the grains in the spectral region of sensitization under the contemplated conditions of use and processing. Log speed is herein defined as 100 (1−log E), where E is measured in meter-candle-seconds at a density of 0.1 below maximum density. Once the silver halide grains of an emulsion have been characterized, it is possible to estimate from further product analysis and performance evaluation whether an emulsion layer of a product appears to be substantially optimally chemically and spectrally sensitized in relation to comparable commercial offerings of other manufacturers.

Nucleating Agents

The high aspect ratio tabular grain internal latent image-forming emulsions of this invention incorporate a nucleating agent to promote the formation of a direct-positive image upon processing. The nucleating agent can be incorporated in the emulsion during processing, but is preferably incorporated in manufacture of the photographic element, usually prior to coating. This reduces the quantities of nucleating agent required. The quantities of nucleating agent required can also be reduced by restricting the mobility of the nucleating agent in the photographic element. Large organic substituents capable of performing at least to some extent a ballasting function are commonly employed. Nucleating agents which include one or more groups to promote adsorption to the surface of the silver halide grains have been found to be effective in extremely low concentrations.

A preferred general class of nucleating agents for use in the practice of this invention are aromatic hydrazides. Particularly preferred aromatic hydrazides are those in which the aromatic nucleus is substituted with one or more groups to restrict mobility and, preferably, promote adsorption of the hydrazide to silver halide grain surfaces. More specifically, preferred hydrazides are those embraced by formula (I) below:

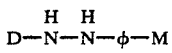

(I)

wherein

D is an acyl group;

$\phi$ is a phenylene or substituted (e.g., halo-, alkyl-, or alkoxy-substituted) phenylene group; and M is a moiety capable of restricting mobility, such as an adsorption promoting moiety.

A particularly preferred class of phenylhydrazides are acylhydrazinophenylthioureas represented by formula (II) below.

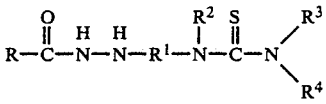

(II)

wherein

R is hydrogen or an alkyl, cycloalkyl, haloalkyl, alkoxyalkyl, or phenylalkyl substituent or a phenyl nucleus having a Hammett sigma-value-derived electron-withdrawing characteristic more positive than −0.30;

$R^1$ is a phenylene or alkyl, halo-, or alkoxy-substituted phenylene group;

$R^2$ is hydrogen, benzyl, alkoxybenzyl, halobenzyl, or alkylbenzyl;

$R^3$ is a alkyl, haloalkyl, alkoxyalkyl, or phenylalkyl substituent having from 1 to 18 carbon atoms, a cycloalkyl substituent, a phenyl nucleus having a Hammett sigma value-derived electron-withdrawing characteristic less positive than +0.50, or naphthyl, $R^4$ is hydrogen or independently selected from among the same substituents as $R^3$; or $R^3$ and $R^4$ together form a heterocyclic nucleus forming a 5- or 6-membered ring, wherein the ring atoms are chosen from the class consisting of nitrogen, carbon, oxygen, sulfur, and selenium atoms;

with the proviso that at least one of $R^2$ and $R^4$ must be hydrogen and the alkyl moieties, except as otherwise noted, in each instance include from 1 to 6 carbon atoms and the cycloalkyl moieties have from 3 to 10 carbon atoms.

As indicated by R in formula (II), preferred acylhydrazinophenylthioureas employed in the practice of this invention contain an acyl group which is the residue of a carboxylic acid, such as one of the acyclic carboxylic acids, including formic acid, acetic acid, propionic acid, butyric acid, higher homologues of these acids having up to about 7 carbon atoms, and halogen, alkoxy, phenyl and equivalent substituted derivatives thereof. In a preferred form, the acyl group is formed by an unsubstituted acyclic aliphatic carboxylic acid having from 1 to 5 carbon atoms. Specifically preferred acyl groups are formyl and acetyl. As between compounds which differ solely in terms of having a formyl or an acetyl group, the compound containing the formyl group exhibits higher nucleating agent activity. The alkyl moieties in the substituents to the carboxylic acids are contemplated to have from 1 to 6 carbon atoms, preferably from 1 to 4 carbon atoms.

In addition to the acyclic aliphatic carboxylic acids, it is recognized that the carboxylic acid can be chosen so that R is a cyclic aliphatic group having from about 3 to 10 carbon atoms, such as, cyclopropyl, cyclobutyl, cyclopentyl, cyclohexyl, methylcyclohexyl, cyclooctyl, cyclodecyl, and bridged ring variations, such as, bornyl and isobornyl groups. Cyclohexyl is a specifically preferred cycloalkyl substituent. The use of alkoxy, cyano, halogen, and equivalent substituted cycloalkyl substituents is contemplated.

As indicated by $R^1$ in formula (II), preferred acylhydrazinophenylthioureas employed in the practice of this invention contain a phenylene or substituted phenylene group. Specifically preferred phenylene groups are m- and p-phenylene groups. Exemplary of preferred phenylene substituents are alkoxy substituents having from 1 to 6 carbon atoms, alkyl substituents having from 1 to 6 carbon atoms, fluoro-, chloro-, bromo-, and iodo-substituents. Unsubstituted p-phenylene groups are specifically preferred. Specifically preferred alkyl moieties are those which have from 1 to 4 carbon atoms. While phenylene and substituted phenylene groups are preferred linking groups, other functionally equivalent divalent aryl groups, such as naphthalene groups, can be employed.

In one form $R^2$ represents an unsubstituted benzyl group or substituted equivalents thereof, such as alkyl, halo-, or alkoxy-substituted benzyl groups. In the preferred form no more than 6 and, most preferably, no more than 4 carbon atoms are contributed by substituents to the benzyl group. Substituents to the benzyl group are preferably para-substituents. Specifically preferred benzyl substituents are formed by unsubstituted, 4-halo-substituted, 4-methoxy-substituted, and 4-methyl-substituted benzyl groups. In another specifically preferred form $R^2$ represents hydrogen.

Referring again to formula (II), it is apparent that $R^3$ and $R^4$ can independently take a variety of forms. One specifically contemplated form can be an alkyl group or a substituted alkyl group, such as a haloalkyl group, alkoxyalkyl group, phenylalkyl group, or equivalent group, having a total of up to 18, preferably up to 12, carbon atoms. Specifically $R^3$ and/or $R^4$ can take the form of a methyl, ethyl, propyl, butyl, pentyl, hexyl, heptyl, octyl, nonyl, decyl or higher homologue group having up to 18 total carbon atoms; a fluoro-, chloro-, bromo-, or iodo-substituted derivative thereof; a methoxy, ethoxy, propoxy, butoxy or higher homologue alkoxy-substituted derivative thereof, wherein the total number of carbon atoms are necessarily at least 2 up to 18; and a phenyl-substituted derivative thereof, wherein the total number of carbon atoms is necessarily at least 7, as in the case of benzyl, up to about 18. In a specific preferred form $R^3$ and/or $R^4$ can take the form of an alkyl or phenylalkyl substituent, wherein the alkyl moieties are in each instance from 1 to 6 carbon atoms.

In addition to the acyclic aliphatic and aromatic forms discussed above, it is also contemplated that R'and/or $R^4$ can take the form of a cyclic aliphatic substituent, such as a cycloalkyl substituent having from 3 to 10 carbon atoms. The use of cyclopropyl, cyclobutyl, cyclopentyl, cyclohexyl, methylcyclohexyl, cyclooctyl, cyclodecyl and bridged ring variations, such as, bornyl and isobornyl groups, is contemplated. Cyclohexyl is a preferred cycloalkyl substituent. The use of alkoxy, cyano, halogen and equivalent substituted cycloalkyl substituents is contemplated.

$R^3$ and/or $R^4$ can also be an aromatic substituent, such as, phenyl or naphthyl (i.e., 1-naphthyl or 2-naphthyl) or an equivalent aromatic group, e.g., 1-, 2-, or 9-anthryl, etc. As indicated in formula (II) $R^3$ and/or $R^4$ can take the form of a phenyl nucleus which is either electron-donating or electron-withdrawing, however phenyl nuclei which are highly electron-withdrawing may produce inferior nucleating agents.

The electron-withdrawing or electron-donating characteristic of a specific phenyl nucleus can be assessed by reference to Hammett sigma values. The phenyl nucleus can be assigned a Hammett sigma value-derived electron-withdrawing characteristic which is the algebraic sum of the Hammett sigma values of its substituents (i.e., those of the substituents, if any, to the phenyl group). For example, the Hammett sigma values of any substituents to the phenyl ring of the phenyl nucleus can be determined algebraically simply by determining from the literature the known Hammett sigma values for each substituent and obtaining the algebraic sum thereof. Electron-withdrawing substituents are assigned positive sigma values, while electron-donating substituents are assigned negative sigma values.

Exemplary meta- and para-sigma values and procedures for their determination are set forth by J. Hine in *Physical Organic Chemistry,* second edition, page 87, published in 1962, H. VanBekkum, P. E. Verkade and B. M. Wepster in *Rec. Trav. Chim.,* Volume 78, page 815, published in 1959, P. R. Wells in *Chem. Revs.,* Volume 63, page 171, published in 1963, by H. H. Jaffe in *Chem. Revs.,* Volume 53, page 191, published in 1953, by M. J. S. Dewar and P. J. Grisdale in *J. Amer. Chem. Soc.,* Volume 84, page 3548, published in 1962, and by Barlin and Perrin in *Quart. Revs.,* Volume 20, page 75 et seq, published in 1966. For the purposes of this invention, ortho-substituents to the phenyl ring can be assigned to the published para-sigma values.

It is preferred that $R^2$ and/or $R^3$ be a phenyl nucleus having a Hammett sigma value-derived electron-withdrawing characteristic less positive than +0.50. It is specifically contemplated that $R^2$and/or $R^3$ be chosen from among phenyl nuclei having cyano, fluoro-, chloro-, bromo-, iodo-, alkyl groups having from 1 to 6 carbon atoms, and alkoxy groups having from 1 to 6 carbon atoms, as phenyl ring substituents. Phenyl ring substituents are preferred in the para- or 4-ring position.

Rather than being independently chosen $R^3$ and $R^3$ can together form, along with the 3-position nitrogen atom of the thiourea, a heterocyclic nucleus forming a 5- or 6-membered ring. The ring atoms can be chosen from among nitrogen, carbon, oxygen, sulfur and selenium atoms. The ring necessarily contains at least one nitrogen atom. Exemplary rings include morpholino, piperidino, pyrrolidinyl, pyrrolinyl, thiomorpholino, thiazolidinyl, 4-thiazolinyl, selenazolidinyl, 4-selenazolinyl, imidazolidinyl, imidazolinyl, oxazolidinyl and 4-oxazolinyl rings. Specifically preferred rings are saturated or otherwise constructed to avoid electron withdrawal from the 3-position nitrogen atom Acylhydrazinophenylthiourea nucleating agents and their synthesis are more specifically disclosed in Leone U.S. Pat. Nos. 4,030,925 and 4,276,364, here incorporated by reference. Variants of the acylhydrazinophenylthiourea nucleating agents described above are disclosed in von Konig U.S. Pat. No. 4,139,387 and Adachi et al U.K. Patent application No. 2,012,443A.

Another preferred class of phenylhydrazide nucleating agents are N-(acylhydrazinophenyl)thioamide nucleating agents, such as those indicated by formula (III) below:

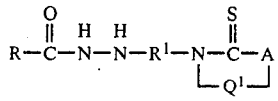

(III)

wherein

R and $R^1$ are as defined in formula (II);

A is $=N-R^2$, —S— or —O—;

$Q^1$ represents the atoms necessary to complete a five-membered heterocyclic nucleus;

$R^2$ is independently chosen from hydrogen, phenyl, alkyl, alkylphenyl, and phenylalkyl; and the alkyl moieties in each instance include from 1 to 6 carbon atoms.

These compounds embrace those having a five-membered heterocyclic thioamide nucleus, such as a 4-thiazoline-2-thione, thiazolidine-2-thione, 4-oxazoline-2-thione, oxazolidine-2-thione, 2-pyrazoline-5-thione, pyrazolidine-5-thione, indoline-2-thione, 4-imidazoline-2-thione, etc. A specifically preferred subclass of heterocyclic thioamide nuclei is formed when $Q^1$ is as indicated in formula (IV) below

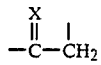

(IV)

wherein

X is =S or =O.

Specifically preferred illustrations of such values of $Q^1$ are 2-thiohydantoin, rhodanine, isorhodanine, and 2-thio-2,4-oxazolidinedione nuclei. It is believed that some six-membered nuclei, such as thiobarbituric acid, may be equivalent to five-membered nuclei embraced within formula (III).

Another specifically preferred subclass of heterocyclic thioamide nuclei is formed when $Q^1$ is as indicated in formula (V)

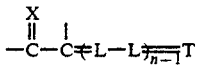

(V)

wherein

L is a methine group;

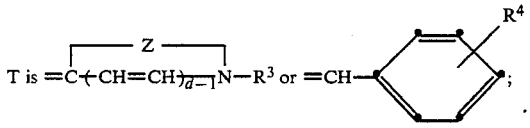

$R^3$ is an alkyl substituent;

$R^4$ is hydrogen; an alkyl,

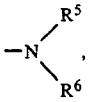

or an alkoxy substituent;

Z represents the nonmetallic atoms necessary to complete a basic heterocyclic nucleus of the type found in cyanine dyes;

n and d are independently chosen from the integers 1 and 2;

$R^5$ and $R^6$ are independently chosen from hydrogen, phenyl, alkyl, alkylphenyl, and phenylalkyl; and the alkyl moieties in each instance include from 1 to 6 carbon atoms.

The formula (V) values for $Q^1$ provide a heterocyclic thioamide nucleus corresponding to a methine substituted form of the nuclei present above in formula (IV) values for $Q^1$. In a specifically preferred form the heterocyclic thioamide nucleus is preferably a methine substituted 2-thiohydantoin, rhodanine, isorhodanine, or 2-thio-2,4-oxazolidinedione nucleus. The heterocyclic thioamide nucleus of formula (V) is directly, or through an intermediate methine linkage, substituted with a basic heterocyclic nucleus of the type employed in cyanine dyes or a substituted benzylidene nuclues. Z preferably represents the nonmetallic atoms necessary to complete a basic 5- or 6-membered heterocyclic nucleus of the type found in cyanine dyes having ring-forming atoms chosen from the class consisting of carbon, nitrogen, oxygen, sulfur, and selenium.

N-(acylhydrazinophenyl)thioamide nucleating agents and their synthesis are more specifically disclosed in Leone et al U.S. Pat. No. 4,080,207.

Still another preferred class of phenylhydrazide nucleating agents are triazole-substituted phenylhydrazide nucleating agents. More specifically, preferred triazole-substituted phenylhydrazide nucleating agents are those represented by formula VI below:

$$R-\overset{O}{\overset{\|}{C}}-\overset{H}{N}-\overset{H}{N}-R^1-A^1-A^2-A^3 \qquad \text{(VI)}$$

wherein

R and $R^1$ are as defined in formula (II);

$A^1$ is alkylene or oxalkylene;

$$-\overset{O}{\overset{\|}{C}}-\overset{H}{N}- \text{ or } -\underset{\underset{O}{\|}}{\overset{O}{\overset{\|}{S}}}-N-;$$

and $A^3$ is a triazolyl or benzotriazolyl nucleus;

the alkyl and alkylene moieties in each instance including from 1 to 6 carbon atoms.

Still more specifically preferred triazole-substituted phenylhydrazide nucleating agents are those represented by formula (VII) below:

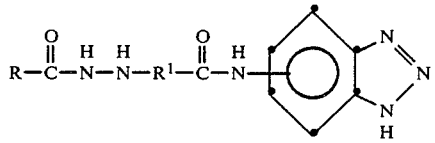

(VII)

wherein

R is hydrogen or methyl;

$R^1$ is

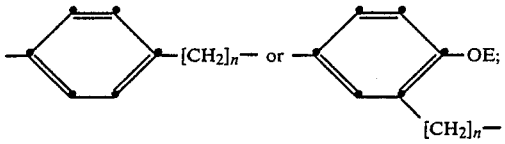

n is an integer of 1 to 4; and

E is alkyl of from 1 to 4 carbon atoms.

Triazole-substituted phenylhydrazide nucleating agents and their synthesis are disclosed by Sidhu et al U.S. Pat. No. 4,278,748, here incorporated by reference. Comparable nucleating agents having a somewhat broader range of adsorption promoting groups are disclosed in corresponding U.K. Patent application No. 2,011,391A.

The aromatic hydrazides represented by formulas (II), (III), and (VI) each contain adsorption promoting substituents. In many instances it is preferred to employ in combination with these aromatic hyrazides additional hydrazides or hydrazones which do not contain substituents specifically intended to promote adsorption to silver halide grain surfaces. Such hyrazides or hydrazones, however, often contain substituents to reduce their mobility when incorporated in photographic elements. These hydrazide or hydrazones can be employed as the sole nucleating agent, if desired.

Such hydrazides and hydrazones include those represented by formula (VIII) and (IX) below:

$$T-\overset{H}{N}-\overset{H}{N}-T^1 \qquad \text{(VII)}$$

and $$T-\overset{H}{N}-N=T^2 \qquad \text{(IX)}$$

wherein T is an aryl radical, including a substituted aryl radical, $T^1$ is an acyl radical, and $T^2$ is an alkylidene radical and including substituted alkylidene radicals. Typical aryl radicals for the substitutent T have the formula M-$T^3$-, wherein $T^3$ is an aryl radical (such as, phenyl, 1-naphthyl, 2-naphthyl, etc.) and M can be such substituents as hydrogen, hydroxy, amino, alkyl, alkylamino, arylamino, heterocyclidc amino (amino containing a heterocyclic moiety), alkoxy, aryloxy, acyloxy, arylcarbonamido, alkylcarbonamido, heterocyclic carbonamido (carbonamido containing a heterocyclic moiety), arylsulfonamido, alkylsulfonamido, and heterocyclic sulfonamido (sulfonamido containing a heterocyclic moiety). Typical acyl radicals for the substituent $T^1$ have the formula $$-\underset{\underset{O}{\|}}{\overset{O}{\overset{\|}{S}}}-Y \text{ or } -\overset{O}{\overset{\|}{C}}-G$$

wherein Y can be such substituents as alkyl, aryl, and heterocyclic radicals, G can represent a hydrogen atom or the same substituent as Y as well as radicals having the formula $$-\overset{O}{\overset{\|}{C}}-O-A$$

to form oxalyl radicals wherein A is an alkyl, aryl, or a heterocyclic radical. Typical alkylidene radicals for the substituent $T^2$ have the formula =CH—D wherein D can be a hydrogen atom or such radicals as alkyl, aryl, and heterocyclic radicals. Typical aryl substituents for the above-described hydrazides and hydrazones include phenyl, naphthyl, diphenyl, and the like. Typical heterocyclic substituents for the above-described hydrazides and hydrazones include azoles, azines, furan, thiophene, quinoline, pyrazole, and the like. Typical alkyl (or alkylidene) substituents for the above-described hydrazides and hydrazones have 1 to 22 carbon atoms including methyl, ethyl, isopropyl, n-propyl, isobutyl, n-butyl, t-butyl, amyl, n-octyl, n-decyl, n-dodecyl, n-octadecyl, n-eicosyl, and n-docosyl.

The hydrazides and hydrazones represented by formulas (VIII) and (IX) as well as their synthesis are disclosed by Whitmore U.S. Pat. No. 3,227,552, here incorporated by reference.

A secondary preferred general class of nucleating agents for use in the practice of this invention are N-substituted cycloammonium quaternary salts. A particularly preferred species of such nucleating agents is represented by formula (X) below:

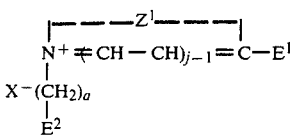

(X)

wherein $Z^1$ represents the atoms necessary to complete a heterocyclic nucleus containing a heterocyclic ring of 5 to 6 atoms including the quaternary nitrogen atoms, with the additional atoms of said heterocyclic ring being selected from carbon, nitrogen, oxygen, sulfur, and selenium;

j represents a positive integer of from 1 to 2;

a represents a positive integer of from 2 to 6;

$X^-$ represents an acid anion;

$E^2$ represents a member selected from (a) a formyl radical, (b) a radical having the formula

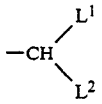

wherein each of $L^1$ and $L^2$, when taken alone, represents a member selected from an alkoxy radical and an alkylthio radical, and $L^1$ and $L^2$, when taken together, represent the atoms necessary to complete a cyclic radical selected from cyclic oxyacetals and cyclic thioacetals having from 5 to 6 atoms in the heterocyclic acetal ring, and (c) a 1-hydrazonoalky radical; and $E^1$ represents either a hydrogen atom, an alkyl radical, an aralkyl radical, an alkylthio radical, or an aryl radical such as phenyl and naphthyl, and including substituted aryl radicals.

The N-substituted cycloammonium quaternary salt nucleating agents of formula (X) and their synthesis are disclosed by Lincoln and Heseltine U.S. Pat. Nos. 3,615,615 and 3,759,901. In a variant form $E^1$ can be a divalent alkylene group of from 2 to 4 carbon atoms joining two substituted heterocyclic nuclei as shown in formula (X). Such nucleating agents and their synthesis are disclosed by Kurtz and Harbison U.S. Pat. No. 3,734,738.

The substituent to the quaternized nitrogen atom of the heterocyclic ring can, in another variant form, itself form a fused ring with the heterocyclic ring. Such nucleating agents are illustrated by dihydroaromatic quanternary salts comprising a 1,2-dihydroaromatic heterocyclic nucleus including a quaternary nitrogen atom. Particularly advantageous 1,2-dihydroaromatic nuclei include such nuclei as a 1,2-dihydropyridinium nucleus. Especially preferred dihydroaromatic quaternary salt nucleating agents include those represented by formula (XI) below:

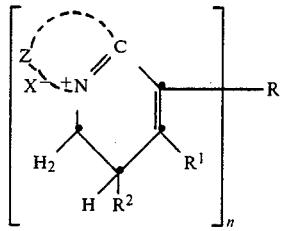

(XI)

wherein

Z represents the nonmetallic atoms necessary to complete a heterocyclic nucleus containing a heterocyclic ring of from 5 to 6 atoms including the quaternary nitrogen atom, with the additional atoms of said heterocyclic ring being selected from either carbon, nitrogen, oxygen, sulfur, or selenium;

n represents a positive integer having a value of from 1 to 2;

when n is 1, R represents a member selected from the group consisting of a hydrogen atom, an alkyl radical, an alkoxy radical, an aryl radical, an aryloxy radical, and a carbamido radical and, when n is 2, R represents an alkylene radical having from 1 to 4 carbon atoms;

each of $R^1$ and $R^2$ represents a member selected from the group consisting of a hydrogen atom, an alkyl radical, and an aryl radical; and $X^-$ represents an anion.

Dihydroaromatic quaternary salt nucleating agents and their synthesis are disclosed by Kurtz and Heseltine U.S. Pat. Nos. 3,719,494, here incorporated by reference.

A specifically preferred class of N-substituted cycloammonium quaternary salt nucleating agents are those which include one or more alkynyl substituents. Such nucleating agents include compounds within the generic structural definition set forth in formula (XII) below:

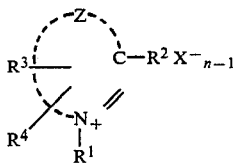

(XII)

wherein Z represents an atomic group necessary for forming a 5- or 6-membered heterocyclic nucleus, $R^1$ represents an aliphatic group, $R^2$ represents a hydrogen atom or an aliphatic group, $R^3$ and $R^4$, which may be the same or different, each represents a hydrogen atom, a halogen atom, an aliphatic group, an alkoxy group, a hydroxy group, or an aromatic group, at least one of $R^1$, $R^2$, $R^3$ and $R^4$ being a propargyl group, a butynyl group, or a substituent containing a propargyl or butynyl group, $X^-$ represents an anion, n is 1 or 2, with n being 1 when the compound forms an inner salt.

Such alkynyl-substituted cycloammonium quaternary salt nucleating agents and their synthesis are illustrated by Adachi et al U.S. Pat. No. 4,115,122, here incorporated by reference.

The specific choice of nucleating agents can be influenced by a variety of factors. The nucleating agents of Leone cited above are particularly preferred for many applications, since they are effective at very low concentrations. Minimum concentrations as low as 0.1 mg of nucleating agent per mole of silver, preferably at least 0.5 mg per silver mole, and optimally at least 1 mg per silver mole are disclosed by Leone. The nucleating agents of Leone are particularly advantageous in reducing speed loss and in some instances permitting speed gain with increasing processing temperatures. When the nucleating agents of Leone are employed in combination with those of Whitmore speed variations as a function of temperature of processing can be minimized.

The aromatic hydrazide nucleating agents are generally preferred for use in photographic elements intended to be processed at comparatively high levels of pH, typically above 13. The alkynyl-substituted cycloammonium quaternary salt nucleating agents are particularly useful for processing at a pH of 13 or less. Adachi et al teaches these nucleating agents to be useful in processing within the pH range of from 10 to 13, preferably 11 to 12.5.

In addition to the nucleating agents described above additional nucleating agents have been identified which are useful in processing at pH levels in the range of from about 10 to 13. An N-substituted cycloammonium quaternary salt nucleating agent which can contain one or more alkynyl substituents is illustrative of one class of nucleating agents useful in processing below pH 13. Such nucleating agents are illustrated by formula (XIII) below:

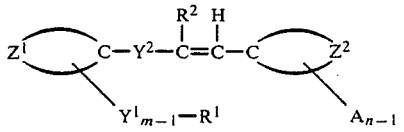

(XIII)

wherein $Z^1$ represents the atoms completing an aromatic carbocyclic nucleus of from 6 to 10 carbon atoms;

$Y^1$ and $Y^2$ are independently selected from among a divalent oxygen atom, a divalent sulfur atom, and $$-\overset{|}{N}-R^3;$$

$Z^2$ represents the atoms completing a heterocylclic nucleus of the type found in cyanine dyes;

A is an adsorption promoting moiety;

m and n are 1 or 2; and $R^1$, $R^2$, and $R^3$ are independently chosen from the group consisting of hydrogen, alkyl, aryl, alkaryl, and aralkyl and $R^1$ and $R^3$ are additionally independently chosen from the group consisting of acyl, alkenyl, and alkynyl, the aliphatic moieties containing up to 5 carbon atoms and the aromatic moieties containing 6 to 10 carbon atoms. A preferred processing pH when these nucleating agents are employed is in the range of from 10.2 to 12.0.

Nucleating agents of the type represented by formula (XIII) and their synthesis are disclosed by Baralle et al U.S. Pat. No. 4,306,016, cited above, and here incorporated by reference.

Another class of nucleating agents effective in the pH range of from 10 to 13, preferably 10.2 to 12, are dihydrospiropyran bis-condensation products of salicylic aldehyde and at least one heterocyclic ammonium salt. In a preferred form such nucleating agents are represented by formula (XIV) below:

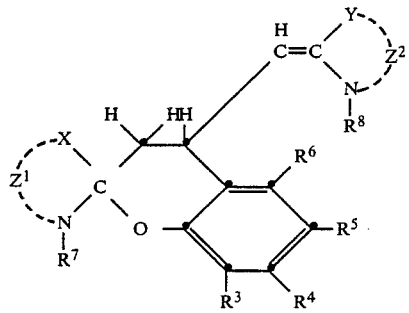

(XIV)

wherein

X and Y each independently represent a sulfur atom, a selenium atom or a $-C(R^1R^2)-$ radical, $R^1$ and $R^2$ independently represent lower alkyl of from 1 to 5 carbon atoms or together represent an alkylene radical of 4 or 5 carbon atoms, $R^3$, $R^4$, $R^5$, and $R^6$ each represent hydrogen, a hydroxy radical or a lower alkyl or alkoxy radical of from 1 to 5 carbon atoms, $Z^1$ and $Z^2$ each represents the nonmetallic atoms completing a nitrogen-containing heterocyclic nucleus of the type found in cyanine dyes and $R^7$ and $R^8$ each represent a ring nitrogen substituent of the type found in cyanine dyes.

$Z^1$ and $Z^2$ in a preferred form each completes a 5- or 6-membered ring, preferably fused with at least one benzene ring, containing in the ring structure carbon atoms, a single nitrogen atom and, optionally, a sulfur or selenium atom.

Nucleating agents of the type represented by formula (XIV) and their synthesis are disclosed by Baralle et al U.S. Pat. No. 4,306,017, cited above, and here incorporated by reference.

Still another class of nucleating agents effective in the pH range of from 10 to 13, preferably 10.2 to 12, are diphenylmethane nucleating agents. Such nucleating agents are illustrated by formula (XV) below:

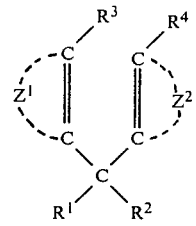

(XV)

wherein $Z^1$ and $Z^2$ represent the atoms completing a phenyl nucleus;

$R^1$ represents hydrogen or alkyl of from 1 to 6 carbon atoms; and $R^2$, $R^3$, and $R^4$ are independently selected from among hydrogen, halogen, alkyl, hydroxy, alkoxy, aryl, alkaryl, and aralkyl or $R^3$ and $R^4$ together form a covalent bond, a divalent chalcogen linkage, or

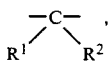

wherein each alkyl moiety contains from 1 to 6 carbon atoms and each aryl moiety contains 6 to 10 carbon atoms.

Nucleating agents of the type represented by formula (XV) and their synthesis are disclosed by Baralle et al U.S. Pat. No. 4,315,986, cited above, and here incorporated by reference.

Silver Imaging

Once high aspect ratio tabular grain internal latent image-forming emulsions have been generated by precipitation procedures, washed, and sensitized, as described above, their preparation can be completed by the incorporation of nucleating agents, described above, and conventional photographic addenda, and they can be usefully applied to photographic applications requiring a silver image to be produced—e.g., conventional black-and-white photography.

Dickerson, cited above and here incorporated by reference, discloses that hardening photographic elements according to the present invention intended to form silver images to an extent sufficient to obviate the necessity of incorporating additional hardener during processing permits increased silver covering power to be realized as compared to photographic elements similarly hardened and processed, but employing nontabular or less than high aspect ratio tabular grain emulsions. Specifically, it is taught to harden the high aspect ratio tabular grain emulsion layers and other hydrophilic colloid layers of black-and-white photographic elements in an amount sufficient to reduce swelling of the layers to less than 200 percent, percent swelling being determined by (a) incubating the photographic element at 38° C. for 3 days at 50 percent relative humidity, (b) measuring layer thickness, (c) immersing the photographic element in distilled water at 21° C. for 3 minutes, and (d) measuring change in layer thickness. Although it is specifically preferred to harden the photographic elements intended to form silver images to such an extent that hardeners need not be incorporated in processing solutions, it is recognized that the emulsions of the present invention can be hardened to any conventional level. It is further specifically contemplated to incorporate hardeners in processing solutions, as illustrated, for example, by *Research Disclosure,* Vol. 184, August 1979, Item 18431, Paragraph K, relating particularly to the processing of radiographic materials.

Typical useful incorporated hardeners (forehardeners) include formaldehyde and free dialdehydes, such as succinaldehyde and glutaraldehyde, as illustrated by Allen et al U.S. Pat. No. 3,232,764; blocked dialdehydes, as illustrated by Kaszuba U.S. Pat. No. 2,586,168, Jeffreys U.S. Pat. No. 2,870,013, and Yamamoto et al U.S. Pat. No. 3,819,608; α-diketones, as illustrated by Allen et al U.S. Pat. No. 2,725,305; active esters of the type described by Burness et al U.S. Pat. No. 3,542,558; sulfonate esters, as illustrated by Allen et al U.S. Pat. Nos. 2,725,305 and 2,726,162; active halogen compounds, as illustrated by Burness U.S. Pat. No. 3,106,468, Silverman et al U.S. Pat. No. 3,839,042, Ballantine et al U.S. Pat. No. 3,951,940 and Himmelmann et al U.S. Pat. No. 3,174,861; s-triazines and diazines, as illustrated by Yamamoto et al U.S. Pat. No. 3,325,287, Anderau et al U.S. Pat. No. 3,288,775 and Stauner et al U.S. Pat. No. 3,992,366; epoxides, as illustrated by Allen et al U.S. Pat. No. 3,047,394, Burness U.S. Pat. No. 3,189,459 and Birr et al German Pat. No. 1,085,663; aziridines, as illustrated by Allen et al U.S. Pat. No. 2,950,197, Burness et al U.S. Pat. No. 3,271,175 and Sato et al U.S. Pat. No. 3,575,705; active olefins having two or more active vinyl groups (e.g. vinylsulfonyl groups), as illustrated by Burness et al U.S. Pat. Nos. 3,490,911, 3,539,644 and 3,841,872 (U.S. Pat. No. Re. 29,305), Cohen U.S. Pat. No. 3,640,720, Kleist et al German Pat. No. 872,153 and Allen U.S. Pat. No. 2,992,109; blocked active olefins, as illustrated by Burness et al U.S. Pat. No. 3,360,372 and Wilson U.S. Pat. No. 3,345,177; carbodiimides, as illustrated by Blout et al German Pat. No. 1,148,446; isoxazolium salts unsubstituted in the 3-position, as illustrated by Burness et al U.S. Pat. No. 3,321,313; esters of 2-alkoxy-N-carboxydihydroquinoline, as illustrated by Bergthaller et al U.S. Pat. No. 4,013,468; N-carbamoyl and N-carbamoyloxypyridinium salts, as illustrated by Himmelmann U.S. Pat. No. 3,880,665; hardeners of mixed function, such as halogen-substituted aldehyde acids (e.g., mucochloric and mucobromic acids), as illustrated by White U.S. Pat. No. 2,080,019, 'onium substituted acroleins, as illustrated by Tschopp et al U.S. Pat. No. 3,792,021, and vinyl sulfones containing other hardening functional groups, as illustrated by Sera et al U.S. Pat. No. 4,028,320; and polymeric hardeners, such as dialdehyde starches, as illustrated by Jeffreys et al U.S. Pat. No. 3,057,723, and copoly(acrolein-methacrylic acid), as illustrated by Himmelmann et al U.S. Pat. No. 3,396,029.

The use of forehardeners in combination is illustrated by Sieg et al U.S. Pat. No. 3,497,358, Dallon et al U.S. Pat. Nos. 3,832,181 and 3,840,370 and Yamamoto et al U.S. Pat. No. 3,898,089. Hardening accelerators can be used, as illustrated by Sheppard et al U.S. Pat. No. 2,165,421, Kleist German Pat. No. 881,444, Riebel et al U.S. Pat. No. 3,628,961 and Ugi et al U.S. Pat. No. 3,901,708. The patents illustrative of hardeners and hardener combinations are here incorporated by reference.

Instability which decreases maximum density in direct-positive emulsion coatings can be protected against by incorporation of stabilizers, antifoggants, antikinking agents, latent image stabilizers and similar addenda in the emulsion and contiguous layers prior to coating. A variety of such addenda are disclosed in *Research Disclosure,* Vol. 176, December 1978, Item 17643, Paragraph VI. Many of the antifoggants which are effective in emulsions can also be used in developers and can be classified under a few general headings, as illustrated by C. E. K. Mees, *The Theory of the Photographic Process,* 2nd Ed., Macmillan, 1954, pp. 677–680.

In some applications improved results can be obtained when the direct-positive emulsions are processed in the presence of certain antifoggants, as disclosed in Stauffer U.S. Pat. No. 2,497,917, here incorporated by reference. Typical useful antifoggants of this type include benzotriazoles, such as benzotriazole, 5-methylbenzotriazole, and 5-ethylbenzotriazole; benzimidazoles such as 5-nitrobenzimidazole; benzothiazoles such as 5-nitrobenzothiazole and 5-methylbenzothiazole; heterocyclic thiones such as 1-methyl-2-tetrazoline-5-thione; triazines such as 2,4-dimethylamino-6-chloro-5-triazine; benzoxazoles such as ethylbenzoxazole; and pyrroles such as 2,5-dimethylpyrrole.

In certain embodiments, good results are obtained when the elements are processed in the presence of high levels of the antifoggants mentioned above. When antifoggants such as benzotriazoles are used, good results can be obtained when the processing solution contains up to 5 grams per liter and preferably 1 to 3 grams per liter; when they are incorporated in the photographic element, concentrations of up to 1,000 mg per mole of silver and preferably concentrations of 100 to 500 mg per mole of silver are employed.

In addition to sensitizers, hardeners, and antifoggants and stabilizers, a variety of other conventional photographic addenda can be present. The specific choice of addenda depends upon the exact nature of the photographic application and is well within the capability of the art. A variety of useful addenda are disclosed in *Research Disclosure,* Vol. 176, December 1978, Item 17643, here incorporated by reference. Optical brighteners can be introduced, as disclosed by Item 17643 at Paragraph V. Absorbing and scattering materials can be employed in the emulsions of the invention and in separate layers of the photographic elements, as described in Paragraph VIII. Coating aids, as described in Paragraph XI, and plasticizers and lubricants, as described in Paragraph XII, can be present. Antistatic layers, as described in Paragraph XIII, can be present. Methods of addition of addenda are described in Paragraph XIV. Matting agents can be incorporated, as described in Paragraph XVI. Developing agents and development modifiers can, if desired, be incorporated, as described in Paragraphs XX and XXI. When the photographic elements of the invention are intended to serve radiographic applications, emulsion and other layers of the radiographic element can take any of the forms specifically described in *Research Disclosure,* Item 18431, cited above, here incorporated by reference. The emulsions of the invention, as well as other, conventional silver halide emulsion layers, interlayers, overcoats, and subbing layers, if any, present in the photographic elements can be coated and dried as described in Item 17643, Paragraph XV.

It is specifically contemplated to blend the high aspect ratio tabular grain internal latent image-forming emulsions of the present invention with each other or with conventional emulsions to satisfy specific emulsion layer requirements. For example, two or more emulsions according to the present invention, but differing in average grain diameter can be blended. It is specifically contemplated to employ in blending internal latent image-forming grains of similar grain size distribution to minimize migration of addenda between different grain populations. When separate emulsions of similar grain size distribution are employed in combination, their performance can be differentiated by differences in surface sensitization levels, differences relating to adsorbed nucleating agents, or differences in proportions of internal sensitizeres (taught by Atwell et al U.S. Pat. No. 4,035,185). Silverman et al U.S. Ser. Nos. 418,313, titled PHOTOGRAPHIC ELEMENTS CONTAINING DIRECT POSITIVE EMULSIONS AND PROCESSES FOR THEIR USE, and 418,314, titled BLENDED DIRECT-POSITIVE EMULSIONS, PHOTOGRAPHIC ELEMENTS, AND PROCESSES OF USE, both filed Sept. 15, 1982, commonly assigned, and here incorporated by reference, disclose that the blending or double coating of core-shell emulsions in a weight ratio of from 1:5 to 5:1, wherein a first emulsion exhibits a coefficient of variation of less than 20% and a second emulsion has an average grain diameter less than 65% that of the first emulsion, can result in unexpected increase in silver covering power. A speed increase can also be realized, even at reduced coating levels. The ratio of the first emulsion to the second emulsion is preferably 1:3 to 2:1, based on weight of silver, and the average diameter of the grains of the second emulsion is preferably less than 50%, optimally less than 40% the average diameter of the grains of the first emulsion. The second emulsion can be any conventional internal latent image-forming emulsion, but is preferably substantially free of surface chemical sensitization.

In their simplest form photographic elements according to the present invention employ a single silver halide emulsion layer containing a high aspect ratio tabular grain emulsion according to the present invention and a photographic support. It is, of course, recognized that more than one silver halide emulsion layer as well as overcoat, subbing, and interlayers can be usefully included. Instead of blending emulsions as described above the same effect can frequently be achieved by coating the emulsions to be blended as separate layers. Coating of separate emulsion layers to achieve exposure latitude is well known in the art, as illustrated by Zelikman and Levi, *Making and Coating Photographic Emulsions,* Focal Press, 1964, pp. 234–238; Wycoff U.S. Pat. No. 3,662,228; and U.K. Pat. No. 923,045. It is further well known in the art that increased photographic speed can be realized when faster and slower silver halide emulsions are coated in separate layers as opposed to blending. Typically the faster emulsion layer is coated to lie nearer the exposing radiation source than the slower emulsion layer. This approach can be extended to three or more superimposed emulsion layers. Such layer arrangements are specifically contemplated in the practice of this invention.

The layers of the photographic elements can be coated on a variety of supports. Typical photographic supports include polymeric film, wood fiber—e.g., paper, metallic sheet and foil, glass and ceramic supporting elements provided with one or more subbing layers to enhance the adhesive, antistatic, dimensional, abrasive, hardness, frictional, antihalation and/or other properties of the support surface.

Typical of useful polymeric film supports are films of cellulose nitrate and cellulose esters such as cellulose triacetate and diacetate, polystyrene, polyamides, homo- and co-polymers of vinyl chloride, poly(vinyl acetal), polycarbonate, homo- and co-polymers of olefins, such as polyethylene and polypropylene, and polyesters of dibasic aromatic carboxylic acids with divalent alcohols, such as poly(ethylene terephthalate).

Typical of useful paper supports are those which are partially acetylated or coated with baryta and/or a polyolefin, particularly a polymer of an $\alpha$-olefin containing 2 to 10 carbon atoms, such as polyethylene, polypropylene, copolymers of ethylene and propylene and the like.

Polyolefins, such as polyethylene, polypropylene and polyallomers—e.g., copolymers of ethylene with propylene, as illustrated by Hagemeyer et al U.S. Pat. No. 3,478,128, are preferably employed as resin coatings over paper, as illustrated by Crawford et al U.S. Pat. No. 3,411,908 and Joseph et al U.S. Pat. No. 3,630,740, over polystyrene and polyester film supports, as illustrated by Crawford et al U.S. Pat. No. 3,630,742, or can be employed as unitary flexible reflection supports, as illustrated by Venor et al U.S. Pat. No. 3,973,963.

Preferred cellulose ester supports are cellulose triacetate supports, as illustrated by Fordyce et al U.S. Pat. Nos. 2,492,977, '978 and 2,739,069, as well as mixed cellulose ester supports, such as cellulose acetate propionate and cellulose acetate butyrate, as illustrated by Fordyce et al U.S. Pat. No. 2,739,070.

Preferred polyester film supports are comprised of linear polyester, such as illustrated by Alles et al U.S. Pat. No. 2,627,088, Wellman U.S. Pat. No. 2,720,503, Alles U.S. Pat. No. 2,779,684 and Kibler et al U.S. Pat. No. 2,901,466. Polyester films can be formed by varied techniques, as illustrated by Alles, cited above, Czerkas et al U.S. Pat. No. 3,663,683 and Williams et al U.S. Pat. No. 3,504,075, and modified for use as photographic film supports, as illustrated by Van Stappen U.S. Pat. No. 3,227,576, Nadeau et al U.S. Pat. No. 3,501,301, Reedy et al U.S. Pat. No. 3,589,905, Babbitt et al U.S. Pat. No. 3,850,640, Bailey et al U.S. Pat. No. 3,888,678, Hunter U.S. Pat. No. 3,904,420 and Mallinson et al U.S. Pat. No. 3,928,697.

The photographic elements can employ supports which are resistant to dimensional change at elevated temperatures. Such supports can be comprised of linear condensation polymers which have glass transition temperatures above about 190° C., Preferably 220° C., such as polycarbonates, polycarboxylic esters, polyamides, polysulfonamides, polyethers, polyimides, polysulfonates and copolymer variants, as illustrated by Hamb U.S. Pat. Nos. 3,634,089 and 3,772,405; Hamb et al U.S. Pat. Nos. 3,725,070 and 3,793,249; Wilson *Research Disclosure,* Vol. 118, February 1974, Item 11833, and Vol. 120, April 1974, Item 12046; Conklin et al *Research Disclosure,* Vol. 120, April 1974, Item 12012; *Product Licensing Index,* Vol. 92, December 1971, Items 9205 and 9207; *Research Disclosure,* Vol. 101, September 1972, Items 10119 and 10148; *Research Disclosure,* Vol. 106, February 1973, Item 10613; *Research Disclosure,* Vol. 117, January 1974, Item 11709, *and Research Disclosure,* Vol. 134, June 1975, Item 13455.

The photographic elements of the present invention can be imagewise exposed in any conventional manner. Attention is directed to *Research Disclosure* Item 17643, cited above, Paragraph XVIII, here incorporated by reference. The present invention is particularly advantageous when imagewise exposure is undertaken with electromagnetic radiation within the region of the spectrum in which the spectral sensitizers present exhibit absorption maxima. When the photographic elements are intended to record blue, green, red, or infrared exposures, spectral sensitizer absorbing in the blue, green, red, or infrared portion of the spectrum is present. For black-and-white imaging applications it is preferred that the photographic elements be orthochromatically or panchromatically sensitized to permit light to extend sensitivity within the visible spectrum. Radiant energy employed for exposure can be either noncoherent (random phase) or coherent (in phase), produced by lasers. Imagewise exposures at ambient, elevated or reduced temperatures and/or pressures, including high or low intensity exposures, continuous or intermittent exposures, exposure times ranging from minutes to relatively short durations in the millisecond to microsecond range, can be employed within the useful response ranges determined by conventional sensitometric techniques, as illustrated by T. H. James, *The Theory of the Photographic Process,* 4th Ed., Macmillan, 1977, Chapters 4, 6, 17, 18, and 23.

The light-sensitive silver halide contained in the photographic elements can be processed following exposure to form a visible image by associating the silver halide with an aqueous alkaline medium in the presence of a developing agent contained in the medium or the element. Processing formulations and techniques are described in L. F. Mason, *Photographic Processing Chemistry,* Focal Press, London, 1966; *Processing Chemicals and Formulas,* Publication J-1, Eastman Kodak Company, 1973; *Photo-Lab Index,* Morgan and Morgan, Inc., Dobbs Ferry, New York, 1977, and *Neblette's Handbook of Photography and Reprography Materials, Processes and Systems,* Van Nostrand Reinhold Company, 7th Ed., 1977.

Included among the processing methods are web processing, as illustrated by Tregillus et al U.S. Pat. No. 3,179,517; stabilization processing, as illustrated by Herz et al U.S. Pat. No. 3,220,839, Cole U.S. Pat. No. 3,615,511, Shipton et al U.K. Pat. No. 1,258,906 and Haist et al U.S. Pat. No. 3,647,453; monobath processing as described in Haist, *Monobath Manual,* Morgan and Morgan, Inc., 1966, Schuler U.S. Pat. No. 3,240,603, Haist et al U.S. Pat. Nos. 3,615,513 and 3,628,955 and Price U.S. Pat. No. 3,723,126; infectious development, as illustrated by Milton U.S. Pat. Nos. 3,294,537, 3,600,174, 3,615,519 and 3,615,524, Whiteley U.S. Pat. No. 3,516,830, Drago U.S. Pat. No. 3,615,488, Salesin et al U.S. Pat. No. 3,625,689, Illingsworth U.S. Pat. No. 3,632,340, Salesin U.K. Pat. No. 1,273,030 and U.S. Pat. No. 3,708,303; hardening development, as illustrated by Allen et al U.S. Pat. No. 3,232,761; roller transport processing, as illustrated by Russell et al U.S. Pat. Nos. 3,025,779 and 3,515,556, Masseth U.S. Pat. No. 3,573,914, Taber et al U.S. Pat. No. 3,647,459 and Rees et al U.K. Pat. No. 1,269,268; alkaline vapor processing, as illustrated by *Product Licensing Index,* Vol. 97, May 1972, Item 9711, Goffe et al U.S. Pat. No. 3,816,136 and King U.S. Pat. No. 3,985,564; metal ion development as illustrated by Price, *Photographic Science and Engineering,* Vol. 19, Number 5, 1975, pp. 283–287 and Vought *Research Disclosure,* Vol. 150, October 1976, Item 15034; and surface application processing, as illustrated by Kitze U.S. Pat. No. 3,418,132.

The silver halide developers employed in processing are surface developers. It is understood that the term "surface developer" encompasses those developers which will reveal the surface latent image centers on a silver halide grain, but will not reveal substantial internal latent image centers in an internal latent image-forming emulsion under the conditions generally used to develop a surface-sensitive silver halide emulsion. The surface developers can generally utilize any of the silver halide developing agents or reducing agents, but the developing bath or composition is generally substantially free of a silver halide solvent (such as water-soluble thiocyanates, water-soluble thioethers, thiosulfates, and ammonia) which will disrupt or dissolve the grain to reveal substantial internal image. Low amounts of excess halide are sometimes desirable in the developer or incorporated in the emulsion as halide-releasing compounds, but high amounts of iodide or iodide-releasing compounds are generally avoided to prevent substantial disruption of the grain.

Typical silver halide developing agents which can be used in the developing compositions of this invention include hydroquinones, catechols, aminophenols, 3-pyrazolidinones, ascorbic acid and its derivatives, reductones, phenylenediamines, or combinations thereof. The developing agents can be incorporated in the photographic elements wherein they are brought into contact with the silver halide after imagewise exposure; however, in certain embodiments they are preferably employed in the developing bath.

Once a silver image has been formed in the photographic element, it is conventional practice to fix the undeveloped silver halide. The high aspect ratio tabular grain emulsions of the present invention are particularly advantageous in allowing fixing to be accomplished in a shorter time period. This allows processing to be accelerated.

Dye Imaging

The photographic elements and the techniques described above for producing silver images can be readily adapted to provide a colored image through the use of dyes. In perhaps the simplest approach to obtaining a projectable color image a conventional dye can be incorporated in the support of the photographic element, and silver image formation undertaken as described above. In areas where a silver image is formed the element is rendered substantially incapable of transmitting light therethrough, and in the remaining areas light is transmitted corresponding in color to the color of the support. In this way a colored image can be readily formed. The same effect can also be achieved by using a separate dye filter layer or element with a transparent support element.

The silver halide photographic elements can be used to form dye images therein through the selective destruction or formation of dyes. The photographic elements described above for forming silver images can be used to form dye images by employing developers containing dye image formers, such as color couplers, as illustrated by U.K. Pat. No. 478,984, Yager et al U.S. Pat. No. 3,113,864, Vittum et al U.S. Pat. Nos. 3,002,836, 2,271,238 and 2,362,598, Schwan et al U.S. Pat. No. 2,950,970, Carroll et al U.S. Pat. No. 2,592,243, Porter et al U.S. Pat. Nos. 2,343,703, 2,376,380 and 2,369,489, Spath U.K. Pat. No. 886,723 and U.S. Pat. No. 2,899,306, Tuite U.S. Pat. No. 3,152,896 and Mannes et al U.S. Pat. Nos. 2,115,394, 2,252,718 and 2,108,602, and Pilato U.S. Pat. No. 3,547,650. In this form the developer contains a color-developing agent (e.g., a primary aromatic amine) which in its oxidized form is capable of reacting with the coupler (coupling) to form the image dye.

The dye-forming couplers can be incorporated in the photographic elements, as illustrated by Schneider et al, *Die Chemie,* Vol. 57, 1944, p. 113, Mannes et al U.S. Pat. No. 2,304,940, Martinez U.S. Pat. No. 2,269,158, Jelley et al U.S. Pat. No. 2,322,027, Frolich et al U.S. Pat. No. 2,376,679, Fierke et al U.S. Pat. No. 2,801,171, Smith U.S. Pat. No. 3,748,141, Tong U.S. Pat. No. 2,772,163, Thirtle et al U.S. Pat. No. 2,835,579, Sawdey et al U.S. Pat. No. 2,533,514, Peterson U.S. Pat. No. 2,353,754, Seidel U.S. Pat. No. 3,409,435 and Chen *Research Disclosure,* Vol. 159, July 1977, Item 15930. The dye-forming couplers can be incorporated in different amounts to achieve differing photographic effects. For example, U.K. Pat. No. 923,045 and Kumai et al U.S. Pat. No. 3,843,369 teach limiting the concentration of coupler in relation to the silver coverage to less than normally employed amounts in faster and intermediate speed emulsion layers.

The dye-forming couplers are commonly chosen to form subtractive primary (i.e., yellow, magenta and cyan) image dyes and are nondiffusible, colorless couplers, such as two and four equivalent couplers of the open chain ketomethylene, pyrazolone, pyrazolotriazole, pyrazolobenzimidazole, phenol and naphthol type hydrophobically ballasted for incorporation in high-boiling organic (coupler) solvents. Such couplers are illustrated by Salminen et al U.S. Pat. Nos. 2,423,730, 2,772,162, 2,895,826, 2,710,803, 2,407,207, 3,737,316 and 2,367,531, Loria et al U.S. Pat. Nos. 2,772,161, 2,600,788, 3,006,759, 3,214,437 and 3,253,924, McCrossen et al U.S. Pat. No. 2,875,057, Bush et al U.S. Pat. No. 2,908,573, Gledhill et al U.S. Pat. No. 3,034,892, Weissberger et al U.S. Pat. Nos. 2,474,293, 2,407,210, 3,062,653, 3,265,506 and 3,384,657, Porter et al U.S. Pat. No. 2,343,703, Greenhalgh et al U.S. Pat. No. 3,127,269, Feniak et al U.S. Pat. Nos. 2,865,748, 2,933,391 and 2,865,751, Bailey et al U.S. Pat. No. 3,725,067, Beavers et al U.S. Pat. No. 3,758,308, Lau U.S. Pat. No. 3,779,763, Fernandez U.S. Pat. No. 3,785,829, U.K. Pat. No. 969,921, U.K. Pat. No. 1,241,069, U.K. Pat. No. 1,011,940, Vanden Eynde et al U.S. Pat. No. 3,762,921, Beavers U.S. Pat. No. 2,983,608, Loria U.S. Pat. Nos. 3,311,476, 3,408,194, 3,458,315, 3,447,928, 3,476,563, Cressman et al U.S. Pat. No. 3,419,390, Young U.S. Pat. No. 3,419,391, Lestina U.S. Pat. No. 3,519,429, U.K. Pat. No. 975,928, U.K. Pat. No. 1,111,554, Jaeken U.S. Pat. No. 3,222,176 and Canadian Pat. No. 726,651, Schulte et al U.K. Pat. No. 1,248,924 and Whitmore et al U.S. Pat. No. 3,227,550. Dye-forming couplers of differing reaction rates in single or separate layers can be employed to achieve desired effects for specific photographic applications.

The dye-forming couplers upon coupling can release photographically useful fragments, such as development inhibitors or accelerators, bleach accelerators, developing agents, silver halide solvents, toners, hardeners, fogging agents, antifoggants, competing couplers, chemical or spectral sensitizers and desensitizers. Development inhibitor-releasing (DIR) couplers are illustrated by Whitmore et al U.S. Pat. No. 3,148,062, Barr et al U.S. Pat. No. 3,227,554, Barr U.S. Pat. No. 3,733,201, Sawdey U.S. Pat. No. 3,617,291, Groet et al U.S. Pat. No. 3,703,375, Abbott et al U.S. Pat. No. 3,615,506, Weissberger et al U.S. Pat. No. 3,265,506, Seymour U.S. Pat. No. 3,620,745, Marx et al U.S. Pat. No. 3,632,345, Mader et al U.S. Pat. No. 3,869,291, U.K. Pat. No. 1,201,110, Oishi et al U.S. Pat. No. 3,642,485, Verbrugghe U.K. Pat. No. 1,236,767, Fujiwhara et al U.S. Pat. No. 3,770,436 and Matsuo et al U.S. Pat. No. 3,808,945. Dye-forming couplers and nondye-forming compounds which upon coupling release a variety of photographically useful groups are described by Lau U.S. Pat. No. 4,248,962. DIR compounds which do not form dye upon reaction with oxidized color-developing agents can be employed, as illustrated by Fujiwhara et al German OLS No. 2,529,350 and U.S. Pat. Nos. 3,928,041, 3,958,993 and 3,961,959, Odenwalder et al German OLS No. 2,448,063, Tanaka et al German OLS No. 2,610,546, Kikuchi et al U.S. Pat. No. 4,049,455 and Credner et al U.S. Pat. No. 4,052,213. DIR compounds which oxidatively cleave can be employed, as illustrated by Porter et al U.S. Pat. No. 3,379,529, Green et al U.S. Pat. No. 3,043,690, Barr U.S. Pat. No. 3,364,022, Duennebier et al U.S. Pat. No. 3,297,445 and Rees et al U.S. Pat. No. 3,287,129. Silver halide emulsions which are relatively light insensitive, such as Lippmann emulsions, have been utilized as interlayers and overcoat layers to prevent or control the migration of development inhibitor fragments as described in Shiba et al U.S. Pat. No. 3,892,572.

The photographic elements can incorporate colored dye-forming couplers, such as those employed to form integral masks for negative color images, as illustrated by Hanson U.S. Pat. No. 2,449,966, Glass et al U.S. Pat. No. 2,521,908, Gledhill et al U.S. Pat. No. 3,034,892, Loria U.S. Pat. No. 3,476,563, Lestina U.S. Pat. No. 3,519,429, Friedman U.S. Pat. No. 2,543,691, Puschel et al U.S. Pat. No. 3,028,238, Menzel et al U.S. Pat. No. 3,061,432 and Greenhalgh U.K. Pat. No. 1,035,959, and/or competing couplers, as illustrated by Murin et al U.S. Pat. No. 3,876,428, Sakamoto et al U.S. Pat. No. 3,580,722, Puschel U.S. Pat. No. 2,998,314, Whitmore U.S. Pat. No. 2,808,329, Salminen U.S. Pat. No. 2,742,832 and Weller et al U.S. Pat. No. 2,689,793.

The photographic elements can include image dye stabilizers. Such image dye stabilizers are illustrated by U.K. Pat. No. 1,326,889, Lestina et al U.S. Pat. Nos. 3,432,300 and 3,698,909, Stern et al U.S. Pat. No. 3,574,627, Brannock et al U.S. Pat. No. 3,573,050, Arai et al U.S. Pat. No. 3,764,337 and Smith et al U.S. Pat. No. 4,042,394.

Dye images can be formed or amplified by processes which employ in combination with a dye-image-generating reducing agent an inert transition metal ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent, as illustrated by Matejec U.S. Pat. No. 3,674,490, *Research Disclosure,* Vol. 116, December 1973, Item 11660, and Bissonette *Research Disclosure,* Vol. 148, August 1976, Items 14836, 14846 and 14847. The photographic elements can be particularly adapted to form dye images by such processes, as illustrated by Dunn et al U.S. Pat. No. 3,822,129, Bissonette U.S. Pat. Nos. 3,834,907 and 3,902,905, Bissonette et al U.S. Pat. No. 3,847,619 and Mowrey U.S. Pat. No. 3,904,413.

The photographic elements can produce dye images through the selective destruction of dyes or dye precursors, such as silver-dye-bleach processes, as illustrated by A. Meyer, *The Journal of Photographic Science,* Vol. 13, 1965, pp. 90–97. Bleachable azo, azoxy, xanthene, azine, phenylmethane, nitroso complex, indigo, quinone, nitro-substituted, phthalocyanine and formazan dyes, as illustrated by Stauner et al U.S. Pat. No. 3,754,923, Piller et al U.S. Pat. No. 3,749,576, Yoshida et al U.S. Pat. No. 3,738,839, Froelich et al U.S. Pat. No. 3,716,368, Piller U.S. Pat. No. 3,655,388, Williams et al U.S. Pat. No. 3,642,482, Gilman U.S. Pat. No. 3,567,448, Loeffel U.S. Pat. No. 3,443,953, Anderau U.S. Pat. Nos. 3,443,952 and 3,211,556, Mory et al U.S. Pat. Nos. 3,202,511 and 3,178,291 and Anderau et al U.S. Pat. Nos. 3,178,285 and 3,178,290, as well as their hydrazo, diazonium and tetrazolium precursors and leuco and shifted derivatives, as illustrated by U.K. Pat. Nos. 923,265, 999,996 and 1,042,300, Pelz et al U.S. Pat. No. 3,684,513, Watanabe et al U.S. Pat. No. 3,615,493, Wilson et al U.S. Pat. No. 3,503,741, Boes et al U.S. Pat. No. 3,340,059, Gompf et al U.S. Pat. No. 3,493,372 and Puschel et al U.S. Pat. No. 3,561,970, can be employed.

It is common practice in forming dye images in silver halide photographic elements to remove the silver which is developed by bleaching. Such removal can be enhanced by incorporation of a bleach accelerator or a precursor thereof in a processing solution or in a layer of the element. In some instances the amount of silver formed by development is small in relation to the amount of dye produced, particularly in dye image amplification, as described above, and silver bleaching is omitted without substantial visual effect. In still other applications the silver image is retained and the dye image is intended to enhance or supplement the density provided by the image silver. In the case of dye enhanced silver imaging it is usually preferred to form a neutral dye or a combination of dyes which together produce a neutral image. Neutral dye-forming couplers useful for this purpose are disclosed by Pupo et al *Research Disclosure,* Vol. 162, October 1977, Item 16226. The enhancement of silver images with dyes in photographic elements intended for thermal processing is disclosed in *Research Disclosure,* Vol. 173, September 1973, Item 17326, and Houle U.S. Pat. No. 4,137,079. It is also possible to form monochromatic or neutral dye images using only dyes, silver being entirely removed from the image-bearing photographic elements by bleaching and fixing, as illustrated by Marchant et al U.S. Pat. No. 3,620,747.

Multicolor Photography

The present invention can be employed to produce multicolor photographic images. Generally any conventional multicolor imaging direct reversal photographic element containing at least one internal latent image-forming silver halide emulsion layer can be improved merely by adding or substituting a high aspect ratio tabular grain internal latent image-forming emulsion according to the present invention.

Significant advantages can be realized by the application of this invention to multicolor photographic elements which produce multicolor images from combinations of subtractive primary imaging dyes. Such photographic elements are comprised of a support and typically at least a triad of super-imposed silver halide emulsion layers for separately recording blue, green, and red light exposures as yellow, magenta, and cyan dye images, respectively. Although the present invention generally embraces any multicolor photographic element of this type including at least one high aspect ratio tabular grain internal latent image-forming emulsion, additional advantages can be realized when high aspect ratio tabular grain internal latent image-forming silver bromide and bromoiodide emulsions are employed. Consequently, the following description is directed to certain preferred embodiments incorporating silver bromide and bromoiodide emulsions, but high aspect ratio tabular grain internal latent image-forming emulsions of any halide composition can be substituted, if desired. Except as specifically otherwise described, the multicolor photographic elements can incorporate the features of the photographic elements described previously.

In a specific preferred form of the invention a minus blue sensitized high aspect ratio tabular grain internal latent image-forming silver bromide or bromoiodide emulsion according to the invention having an average tabular grain thickness of less than 0.3 micron forms at least one of the emulsion layers intended to record green or red light in a triad of blue, green, and red recording emulsion layers of a multicolor photographic element and is positioned to receive during exposure of the photographic element to neutral light at 5500° K. blue light in addition to the light the emulsion is intended to record. The relationship of the blue and minus blue light the layer receives can be expressed in terms of Δ log E, where $$\Delta \log E = \log E_T - \log E_B$$

log $E_T$ being the log of exposure to green or red light the tabular grain emulsion is intended to record and log $E_B$ being the log of concurrent exposure to blue light the tabular grain emulsion also receives. (In each occurrence exposure, E, is in meter-candle-seconds, unless otherwise indicated.)

In the practice of the present invention Δ log E can be less than 0.7 (preferably less than 0.3) while still obtaining acceptable color replication. This is surprising in view of the high proportion of grains present in the emulsions of the present invention having an average diameter of greater than 0.7 micron. If a comparable nontabular or lower aspect ratio tabular grain emulsion of like halide composition and average grain diameter is substituted for a high aspect ratio tabular grain silver bromide or bromoiodide emulsion of the present invention a higher and usually unacceptable level of color falsification will result. It is known in the art that color falsification by green or red sensitized silver bromide and bromoiodide emulsions can be reduced by reduction of average grain diameters, but this results in limiting maximum achievable photographic speeds as well.

The present invention achieves not only advantageous separation in blue and minus blue speeds, but is able to achieve this advantage without any limitation on maximum realizable minus blue photographic speeds. In a specific preferred form of the invention at least the minus blue recording emulsion layers of the triad of blue, green, and red recording emulsion layers are silver bromide or bromoiodide emulsions according to the present invention. It is specifically contemplated that the blue recording emulsion layer of the triad can advantageously also be a high aspect ratio tabular grain emulsion according to the present invention. In a specific preferred form of the invention the tabular grains present in each of the emulsion layers of the triad have an average grain diameter of at least 1.0 micron, preferably at least 2.0 microns, and the emulsion has an average aspect ratio of at least 10:1. In a still further preferred form of the invention the multicolor photographic elements can be assigned an ISO speed index of at least 180.

The multicolor photographic elements of the invention need contain no yellow filter layer positioned between the exposure source and the high aspect ratio tabular grain green and/or red emulsion layers to protect these layers from blue light exposure, or the yellow filter layer, if present, can be reduced in density to less than any yellow filter layer density heretofore employed to protect from blue light exposure red or green recording emulsion layers of photographic elements intended to be exposed in daylight. In one specifically preferred form of the invention no blue recording emulsion layer is interposed between the green and/or red recording emulsion layers of the triad and the source of exposing radiation. Therefore the photographic element is substantially free of blue absorbing material between the green and/or red emulsion layers and incident exposing radiation. If, in this instance, a yellow filter layer is interposed between the green and/or red recording emulsion layers and incident exposing radiation, it accounts for all of the interposed blue density.

Although only one green or red recording high aspect ratio tabular grain silver bromide or bromoiodide emulsion as described above is required, the multicolor photographic element contains at least three separate emulsions for recording blue, green, and red light, respectively. The emulsions other than the required high aspect ratio tabular grain green or red recording emulsion can be internal latent image-forming emulsions of any convenient conventional form. Evans U.S. Pat. Nos. 3,761,276 and 3,923,513 and Atwell et al U.S. Pat. No. 4,035,185, cited above, illustrate preferred nontabular internal latent image-forming emulsions useful in combination with the emulsions of this invention. In a preferred form of the invention all of the emulsion layers contain silver bromide or bromoiodide grains. In a particularly preferred form of the invention at least one green recording emulsion layer and at least one red recording emulsion layer is comprised of a high aspect ratio tabular grain internal latent image-forming emulsion according to this invention. If more than one emulsion layer is provided to record in the green and/or red portion of the spectrum, it is preferred that at least the faster emulsion layer contain high aspect ratio tabular grain emulsion as described above. It is, of course, recognized that all of the blue, green, and red recording emulsion layers of the photographic element can advantageously be tabular as described above, if desired, although this is not required for the practice of this invention.

The present invention is fully applicable to multicolor photographic elements as described above in which the speed and contrast of the blue, green, and red recording emulsion layers vary widely. The relative blue insensitivity of green or red spectrally sensitized high aspect ratio tabular grain silver bromide or silver bromoiodide emulsion layers employed in this invention allow green and/or red recording emulsion layers to be positioned at any location within a multicolor photographic element independently of the remaining emulsion layers and without taking any conventional precautions to prevent their exposure by blue light.

The present invention is particularly applicable to multicolor photographic elements intended to replicate colors accurately when exposed in daylight. Photographic elements of this type are characterized by producing blue, green, and red exposure records of substantially matched contrast and limited speed variation when exposed to a 5500° K. (daylight) source. The term "substantially matched contrast" as employed herein means that the blue, green, and red records differ in contrast by less than 20 (preferably less than 10) percent, based on the contrast of the blue record. The limited speed variation of the blue, green, and red records can be expressed as a speed variation (Δ log E) of less than 0.3 log E, where the speed variation is the larger of the differences between the speed of the green and red records and the speed of the blue record.

The multicolor photographic elements of this invention capable of replicating accurately colors when exposed in daylight offer significant advantages over conventional photographic elements exhibiting these characteristics. In the photographic elements of the invention the limited blue sensitivity of the preferred green and red spectrally sensitized tabular silver bromide or bromoiodide emulsion layers can be relied upon to separate the blue speed of the blue recording emulsion layer and the blue speed of the minus blue recording emulsion layers. Depending upon the specific application, the use of tabular grains in the green and red recording emulsion layers can in and of itself provide a desirably large separation in the blue response of the blue and minus blue recording emulsion layers.

In some applications it may be desirable to increase further blue speed separations of blue and minus blue recording emulsion layers by employing conventional blue speed separation techniques to supplement the blue speed separations obtained by the presence of the high aspect ratio tabular grains. For example, if a multicolor photographic element places the fastest green recording emulsion layer nearest the exposing radiation source and the fastest blue recording emulsion layer farthest from the exposing radiation source, the separation of the blue speeds of the blue and green recording emulsion layers, though a full order of magnitude (1.0 log E) different when the emulsions are separately coated and exposed, may be effectively reduced by the layer order arrangement, since the green recording emulsion layer receives all of the blue light during exposure, but the green recording emulsion layer and other overlying layers may absorb or reflect some of the blue light before it reaches the blue recording emulsion layer. In such circumstance employing a higher proportion of iodide in the blue recording emulsion layer can be relied upon to supplement the tabular grains in increasing the blue speed separation of the blue and minus blue recording emulsion layers. When a blue recording emulsion layer is nearer the exposing radiation source than the minus blue recording emulsion layer, a limited density yellow filter material coated between the blue and minus blue recording emulsion layers can be employed to increase blue and minus blue separation. In no instance, however, is it necessary to make use of any of these conventional speed separation techniques to the extent that they in themselves provide an order of magnitude difference in the blue speed separation or an approximation thereof, as has heretofore been required in the art (although this is not precluded if exceptionally large blue and minus blue speed separation is desired for a specific application). Thus, the present invention achieves the objectives for multicolor photographic elements intended to replicate image colors accurately when exposed under balanced lighting conditions while permitting a much wider choice in element construction than has heretofore been possible.

Multicolor photographic elements are often described in terms of color-forming layer units. Most commonly multicolor photographic elements contain three superimposed color-forming layer units each containing at least one silver halide emulsion layer capable of recording exposure to a different third of the spectrum and capable of producing a complementary subtractive primary dye image. Thus, blue, green, and red recording color-forming layer units are used to produce yellow, magenta, and cyan dye images, respectively. Dye imaging materials need not be present in any color-forming layer unit, but can be entirely supplied from processing solutions. When dye imaging materials are incorporated in the photographic element, they can be located in an emulsion layer or in a layer located to receive oxidized developing or electron transfer agent from an adjacent emulsion layer of the same color-forming layer unit.

To prevent migration of oxidized developing or electron transfer agents between color-forming layer units with resultant color degradation, it is common practice to employ scavengers. The scavengers can be located in the emulsion layers themselves, as taught by Yutzy et al U.S. Pat. No. 2,937,086 and/or in interlayers between adjacent color-forming layer units, as illustrated by Weissberger et al U.S. Pat. No. 2,336,327.

Although each color-forming layer unit can contain a single emulsion layer, two, three, or more emulsion layers differing in photographic speed are often incorporated in a single color-forming layer unit. Where the desired layer order arrangement does not permit multiple emulsion layers differing in speed to occur in a single color-forming layer unit, it is common practice to provide multiple (usually two or three) blue, green, and/or red recording color-forming layer units in a single photographic element.

It is a unique feature of this invention that at least one green or red recording emulsion layer containing tabular silver bromide or bromoiodide grains as described above is located in the multicolor photographic element to receive an increased proportion of blue light during imagewise exposure of the photographic element. The increased proportion of blue light reaching the high aspect ratio tabular grain emulsion layer can result from reduced blue light absorption by an overlying yellow filter layer or, preferably, elimination of overlying yellow filter layers entirely. The increased proportion of blue light reaching the high aspect ratio tabular emulsion layer can result also from repositioning the color-forming layer unit in which it is contained nearer to the source of exposing radiation. For example, green and red recording color-forming layer units containing green and red recording high aspect ratio tabular emulsions, respectively, can be positioned nearer to the source of exposing radiation than a blue recording color-forming layer unit.

The multicolor photographic elements of this invention can take any convenient form consistent with the requirements indicated above. Any of the six possible layer arrangements of Table 27a, p. 211, disclosed by Gorokhovskii, *Spectral Studies of the Photographic Process,* Focal Press, New York, can be employed. To provide a simple, specific illustration, it is possible to add to a conventional multi-color silver halide photographic element during its preparation one or more high aspect ratio tabular grain emulsion layers sensitized to the minus blue portion of the spectrum and positioned to receive exposing radiation prior to the remaining emulsion layers. However, in most instances, it is preferred to substitute one or more minus blue recording high aspect ratio tabular grain emulsion layers for conventional minus blue recording emulsion layers, optionally in combination with layer order arrangement modifications. The invention can be better appreciated by reference to the following preferred illustrative forms.

| Layer Order Arrangement I |
|---|
| Exposure |
| ↓ |
| B |
| IL |
| TG |
| IL |
| TR |

-continued

Layer Order Arrangement II

Exposure
↓
TFB
IL
TFG
IL
TFR
IL
SB
IL
SG
IL
SR

Layer Order Arrangement III

Exposure
↓
TG
IL
TR
IL
B

Layer Order Arrangement IV

Exposure
↓
TFG
IL
TFR
IL
TSG
IL
TSR
IL
B

Layer Order Arrangement V

Exposure
↓
TFG
IL
TFR
IL
TFB
IL
TSG
IL
TSR
IL
SB

Layer Order Arrangement VI

Exposure
↓
TFR
IL
TB
IL
TFG
IL
TFR
IL
SG
IL
SR

Layer Order Arrangement VII

Exposure
↓
TFR
IL
TFG
IL
TB
IL
TFG
IL
TSG
IL
TFR
IL
TSR where

B, G, and R designate blue, green, and red recording color-forming layer units, respectively, of any conventional type;

T appearing before the color-forming layer unit B, G, or R indicates that the emulsion layer or layers contain a high aspect ratio tabular grain silver bromide or bromoiodide emulsions, as more specifically described above, F appearing before the color-forming layer unit B, G, or R indicates that the color-forming layer unit is faster in photographic speed than at least one other color-forming layer unit which records light exposure in the same third of the spectrum in the same Layer Order Arrangement;

S appearing before the color-forming layer unit B, G, or R indicates that the color-forming layer unit is slower in photographic speed than at least one other color-forming layer unit which records light exposure in the same third of the spectrum in the same Layer Order Arrangement; and IL designates an interlayer containing a scavenger, but substantially free of yellow filter material. Each faster or slower color-forming layer unit can differ in photographic speed from another color-forming layer unit which records light exposure in the same third of the spectrum as a result of its position in the Layer Order Arrangement, its inherent speed properties, or a combination of both.

In Layer Order Arrangements I through VII, the location of the support is not shown. Following customary practice, the support will in most instances be positioned farthest from the source of exposing radiation—that is, beneath the layers as shown. If the support is colorless and specularly transmissive—i.e., transparent, it can be located between the exposure source and the indicated layers. Stated more generally, the support can be located between the exposure source and any color-forming layer unit intended to record light to which the support is transparent.

Turning first to Layer Order Arrangement I, it can be seen that the photographic element is substantially free of yellow filter material. However, following conventional practice for elements containing yellow filter material, the blue recording color-forming layer unit lies nearest the source of exposing radiation. In a simple form each color-forming layer unit is comprised of a single silver halide emulsion layer. In another form each color-forming layer unit can contain two, three, or more different silver halide emulsion layers. When a triad of emulsion layers, one of highest speed from each of the color-forming layer units, are compared, they are preferably substantially matched in contrast and the photographic speed of the green and red recording emulsion layers differ from the speed of the blue recording emulsion layer by less than 0.3 log E. When there are two, three, or more different emulsion layers differing in speed in each color-forming layer unit, there are preferably two, three, or more triads of emulsion layers in Layer Order Arrangement I having the stated contrast and speed relationship. The absence of yellow filter material beneath the blue recording color-forming unit increases the photographic speed of this layer.

It is not necessary that the interlayers be substantially free of yellow filter material in Layer Order Arrangement I. Less than conventional amounts of yellow filter material can be located between the blue and green recording color-forming units without departing from the teachings of this invention. Further, the interlayer separating the green and red color-forming layer units can contain up to conventional amounts of yellow filter material without departing from the invention. Where conventional amounts of yellow filter material are employed, the red recording color-forming unit is not restricted to the use of tabular silver bromide or bromoiodide grains, as described above, but can take any conventional form, subject to the contrast and speed considerations indicated.

To avoid repetition, only features that distinguish Layer Order Arrangements II through V from Layer Order Arrangement I are specifically discussed. In Layer Order Arrangement II, rather than incorporate faster and slower blue, red, or green recording emulsion layers in the same color-forming layer unit, two separate blue, green, and red recording color-forming layer units are provided. Only the emulsion layer or layers of the faster color-forming units need contain tabular silver bromide or bromoiodide grains, as described above. The slower green and red recording color-forming layer units because of their slower speeds as well as the overlying faster blue recording color-forming layer unit, are adequately protected from blue light exposure without employing a yellow filter material. The use of high aspect ratio tabular grain silver bromide or bromoiodide emulsions in the emulsion layer or layers of the slower green and/or red recording color-forming layer units is, of course, not precluded. In placing the faster red recording color-forming layer unit above the slower green recording color-forming layer unit, increased speed can be realized, as taught by Eeles et al U.S. Pat. No. 4,184,876, Ranz et al German OLS No. 2,704,797, and Lohman et al German OLS Nos. 2,622,923, 2,622,924, and 2,704,826.

Layer Order Arrangement III differs from Layer Order Arrangement I in placing the blue recording color-forming layer unit farthest from the exposure source. This then places the green recording color-forming layer unit nearest and the red recording color-forming layer unit nearer the exposure source. This arrangement is highly advantageous in producing sharp, high quality multicolor images. The green recording color-forming layer unit, which makes the most important visual contribution to multicolor imaging, as a result of being located nearest the exposure source is capable of producing a very sharp image, since there are no overlying layers to scatter light. The red recording color-forming layer unit, which makes the next most important visual contribution to the multicolor image, receives light that has passed through only the green recording color-forming layer unit and has therefore not been scattered in a blue recording color-forming layer unit. Though the blue recording color-forming layer unit suffers in comparison to Layer Order Arrangement I, the loss of sharpness does not offset the advantages realized in the green and red recording color-forming layer units, since the blue recording color-forming layer unit makes by far the least significant visual contribution to the multicolor image produced.

Layer Order Arrangement IV expands Layer Order Arrangement III to include separate faster and slower high aspect ratio tabular grain emulsion containing green and red recording color-forming layer units. Layer Order Arrangement V differs from Layer Order Arrangement IV in providing an additional blue recording color-forming layer unit above the slower green, red, and blue recording color-forming layer units. The faster blue recording color-forming layer unit employs high aspect ratio tabular grain silver bromide or bromoiodide emulsion, as described above. The faster blue recording color-forming layer unit in this instance acts to absorb blue light and therefore reduces the proportion of blue light reaching the slower green and red recording color-forming layer units. In a variant form, the slower green and red recording color-forming layer units need not employ high aspect ratio tabular grain emulsions.

Layer Order Arrangement VI differs from Layer Order Arrangment IV in locating a tabular grain blue recording color-forming layer unit between the green and red recording color-forming layer units and the source of exposing radiation. As is pointed out above, the tabular grain blue recording color-forming layer unit can be comprised of one or more tabular grain blue recording emulsion layers and, where multiple blue recording emulsion layers are present, they can differ in speed. To compensate for the less favored position the red recording color-forming layer units would otherwise occupy, Layer Order Arrangement VI also differs from Layer Order Arrangement IV in providing a second fast red recording color-forming layer unit, which is positioned between the tabular grain blue recording color-forming layer unit and the source of exposing radiation. Because of the favored location which the second tabular grain fast red recording color-forming layer unit occupies it is faster than the first fast red recording layer unit if the two fast red-recording layer units incorporate identical emulsions. It is, of course, recognized that the first and second fast tabular grain red recording color-forming layer units can, if desired, be formed of the same or different emulsions and that their relative speeds can be adjusted by techniques well known to those skilled in the art. Instead of employing two fast red recording layer units, as shown, the second fast red recording layer unit can, if desired, be replaced with a second fast green recording color-forming layer unit. Layer Order Arrangement VII can be identical to Layer Order Arrangement VI, but differs in providing both a second fast tabular grain red recording color-forming layer unit and a second fast tabular grain green recording color-forming layer unit interposed between the exposing radiation source and the tabular grain blue recording color-forming layer unit.

There are, of course, many other advantageous layer order arrangements possible, Layer Order Arrangements I through VII being merely illustrative. In each of the various Layer Order Arrangements corresponding green and red recording color-forming layer units can be interchanged—i.e., the faster red and green recording color-forming layer units can be interchanged in position in the various layer order arrangements and additionally or alternatively the slower green and red recording color-forming layer units can be interchanged in position.

Although photographic emulsions intended to form multicolor images comprised of combinations of subtractive primary dyes normally take the form of a plurality of superimposed layers containing incorporated dye-forming materials, such as dye-forming couplers, this is by no means required. Three color-forming components, normally referred to as packets, each containing a silver halide emulsion for recording light in one third of the visible spectrum and a coupler capable of forming a complementary subtractive primary dye, can be placed together in a single layer of a photographic element to produce multicolor images. Exemplary mixed packet multicolor photographic elements are disclosed by Godowsky U.S. Pat. Nos. 2,698,794 and 2,843,489. Although discussion is directed to the more common arrangement in which a single color-forming layer unit produces a single subtractive primary dye, relevance to mixed packet multicolor photographic elements will be readily apparent.

It is the relatively large separation in the blue and minus blue sensitivities of the green and red recording color-forming layer units containing tabular grain silver bromide or bromoiodide emulsions that permits reduction or elimination of yellow filter materials and/or the employment of novel layer order arrangements. One technique that can be employed for providing a quantitative measure of the relative response of green and red recording color-forming layer units to blue light in multicolor photographic elements is to expose through a step tablet a sample of a multicolor photographic element according to this invention employing first a neutral exposure source—i.e., light at 5500° K.—and thereafter to process the sample. A second sample is then identically exposed, except for the interposition of a Wratten 98 filter, which transmits only light between 400 and 490 nm, and thereafter identically processed. Using blue, green, and red transmission densities determined according to American Standard PH2.1-1952, as described above, three dye characteristic curves can be plotted for each sample. The difference in blue speed of the blue recording color-forming layer unit(s) and the blue speed of the green or red recording color-forming layer unit(s) can be determined from the relationship:

(A) $(B_{W98}-G_{W98})-(B_N-G_N)$ or (B) $(B_{W98}-R_{W98})-(B_N-R_N)$ where $B_{W98}$ is the blue speed of the blue recording color-forming layer unit(s) exposed through the Wratten 98 filter;

$G_{W98}$ is the blue speed of the green recording color-forming layer unit(s) exposed through the Wratten 98 filter;

$R_{W98}$ is the blue speed of the red recording color-forming layer unit(s) exposed through the Wratten 98 filter;

$B_N$ is the blue speed of the blue recording color-forming layer unit(s) exposed to neutral (5500° K.) light;

$G_N$ is the green speed of the green recording color-forming layer unit(s) exposed to neutral (5500° K.) light; and $R_N$ is the red speed of the red recording color-forming layer unit(s) exposed to neutral (5500° K.) light.

(The above description imputes blue, green, and red densities to the blue, green, and red recording color-forming layer units, respectively, ignoring unwanted spectral absorption by the yellow, magenta, and cyan dyes. Such unwanted spectral absorption is rarely of sufficient magnitude to affect materially the results obtained for the purposes they are here employed.) The preferred multicolor photographic elements of the present invention in the absence of any yellow filter material exhibit a blue speed by the blue recording color-forming layer units which is at least 6 times, preferably at least 8 times, and optimally at least 10 times the blue speed of green and/or red recording color-forming layer units containing high aspect ratio tabular grain emulsions, as described above.

Another measure of the large separation in the blue and minus blue sensitivities of the multicolor photographic elements of the present invention is to compare the green speed of a green recording color-forming layer unit or the red speed of a red recording color-forming layer unit to its blue speed. The same exposure and processing techniques described above are employed, except that the neutral light exposure is changed to a minus blue exposure by interposing a Wratten 9 filter, which transmits only light beyond 490 nm. The quantitative difference being determined is (C) $G_{W9}-G_{W98}$ or (D) $R_{W9}-R_{W98}$ where $G_{W98}$ and $R_{W98}$ are defined above;

$G_{W9}$ is the green speed of the green recording color-forming layer unit(s) exposed through the Wratten 9 filter; and $R_{W9}$ is the red speed of the red recording color-forming layer unit(s) exposed through the Wratten 9 filter. (Again unwanted spectral absorption by the dyes is rarely material and is ignored.) Red and green recording color-forming layer units containing tabular silver bromide or bromoiodide emulsions, as described above, can exhibit a difference between their speed in the blue region of the spectrum and their speed in the portion of the spectrum to which they are spectrally sensitized (i.e., a difference in their blue and minus blue speeds) of at least 10 times (1.0 log E), when the tabular grains have an average thickness of less than 0.3 micron.

In comparing the quantitative relationships A to B and C to D for a single layer order arrangement, the results will not be identical, even if the green and red recording color-forming layer units are identical (except for their w'avelengths of spectral sensitization). The reason is that in most instances the red recording color-forming layer unit(s) will be receiving light that has already passed through the corresponding green recording color-forming layer unit(s). However, if a second layer order arrangement is prepared which is identical to the first, except that the corresponding green and red recording color-forming layer units have been interchanged in position, then the red recording color-forming layer unit(s) of the second layer order arrangement should exhibit substantially identical values for relationships B and D that the green recording color-forming layer units of the first layer order arrangement exhibit for relationships A and C, respectively. Stated more succinctly, the mere choice of green spectral sensitization as opposed to red spectral sensitization does not significantly influence the values obtained by the above quantitative comparisons. Therefore, it is common practice not to differentiate green and red speeds in comparision to blue speed, but to refer to green and red speeds generically as minus blue speeds.

Reduced High Angle Scattering

The high aspect ratio tabular grain emulsions of the present invention are advantageous because of their reduced high angle light scattering as compared to nontabular and lower aspect ratio tabular grain emulsions.

Figure 2:
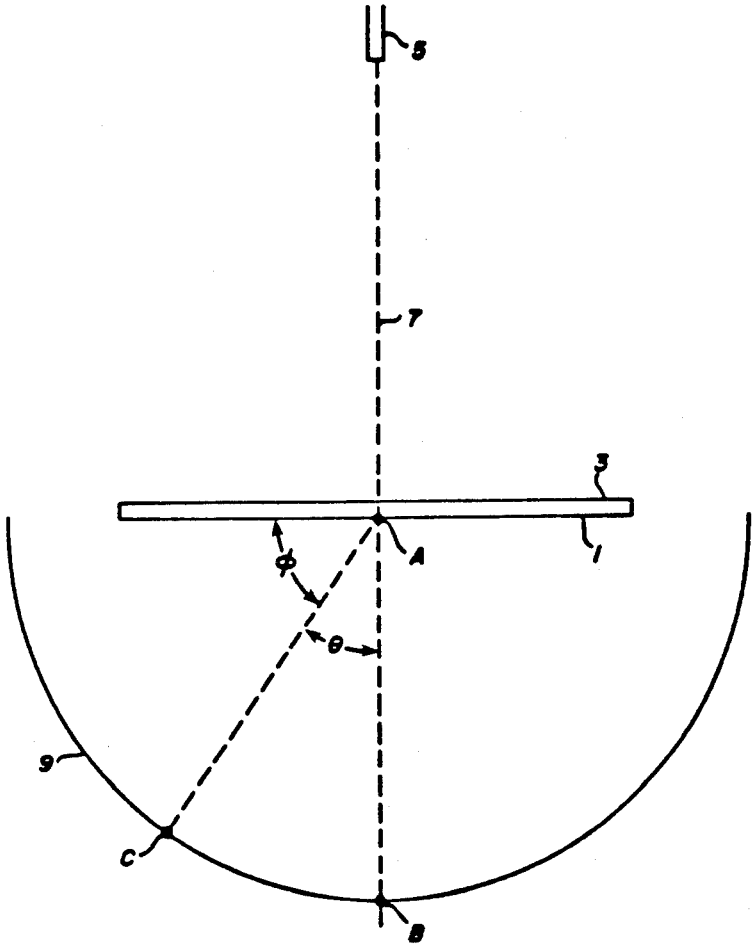
FIG. 2 is a schematic diagram illustrating an arrangement for establishing angular scatter of exposing radiation.

This can be quantitatively demonstrated. Referring to FIG. 2, a sample of an emulsion 1 according to the present invention is coated on a transparent (specularly transmissive) support 3 at a silver coverage of 1.08 g/m$^2$. Although not shown, the emulsion and support are preferably immersed in a liquid having a substantially matched refractive index to minimize Fresnel reflections at the surfaces of the support and the emulsion. The emulsion coating is exposed perpendicular to the support plane by a collimated light source 5. Light from the source following a path indicated by the dashed line 7, which forms an optical axis, strikes the emulsion coating at point A. Light which passes through the support and emulsion can be sensed at a constant distance from the emulsion at a hemispherical detection surface 9. At a point B, which lies at the intersection of the extension of the initial light path and the detection surface, light of a maximum intensity level is detected.

An arbitrarily selected point C is shown in FIG. 2 on the detection surface. The dashed line between A and C forms an angle $\phi$ with the emulsion coating. By moving point C on the detection surface it is possible to vary $\phi$ from 0° to 90°. By measuring the intensity of the light scattered as a function of the angle $\phi$ it is possible (because of the rotational symmetry of light scattering about the optical axis 7) to determine the cumulative light distribution as a function of the angle $\phi$. (For a background description of the cumulative light distribution see DePalma and Gasper, "Determining the Optical Properties of Photographic Emulsions by the Monte Carlo Method", *Photographic Science and Engineering*, Vol. 16, No. 3, May–June 1971, pp. 181–191.)

After determining the cumulative light distribution as a function of the angle $\phi$ at values from 0° to 90° for the emulsion 1 according to the present invention, the same procedure is repeated, but with a conventional emulsion of the same average grain volume coated at the same silver coverage on another portion of support 3. In comparing the cumulative light distribution as a function of the angle $\phi$ for the two emulsions, for values of $\phi$ up to 70° (and in some instances up to 80° and higher) the amount of scattered light is lower with the emulsions according to the present invention. In FIG. 2 the angle $\theta$ is shown as the complement of the angle $\phi$. The angle of scattering is herein discussed by reference to the angle $\theta$. Thus, the high aspect ratio tabular grain emulsions of this invention exhibit less high-angle scattering. Since it is high-angle scattering of light that contributes disproportionately to reduction in image sharpness, it follows that the high aspect ratio tabular grain emulsions of the present invention are in each instance capable of producing sharper images.

As herein defined the term "collection angle" is the value of the angle $\theta$ at which half of the light striking the detection surface lies within an area subtended by a cone formed by rotation of line AC about the polar axis at the angle $\theta$ while half of the light striking the detection surface strikes the detection surface within the remaining area.

While not wishing to be bound by any particular theory to account for the reduced high angle scattering properties of high aspect ratio tabular grain emulsions according to the present invention, it is believed that the large flat major crystal faces presented by the high aspect ratio tabular grains as well as the orientation of the grains in the coating account for the improvements in sharpness observed. Specifically, it has been observed that the tabular grains present in a silver halide emulsion coating are substantially aligned with the planar support surface on which they lie. Thus, light directed perpendicular to the photographic element striking the emulsion layer tends to strike the tabular grains substantially perpendicular to one major crystal face. The thinness of tabular grains as well as their orientation when coated permits the high aspect ratio tabular grain emulsion layers of this invention to be substantially thinner than conventional emulsion coatings, which can also contribute to sharpness. However, the emulsion layers of this invention exhibit enhanced sharpness even when they are coated to the same thicknesses as conventional emulsion layers.

In a specific preferred form of the invention the high aspect ratio tabular grain emulsion layers exhibit a minimum average grain diameter of at least 1.0 micron, most preferably at least 2 microns. Both improved speed and sharpness are attainable as average grain diameters are increased. While maximum useful average grain diameters will vary with the graininess that can be tolerated for a specific imaging application, the maximum average grain diameters of high aspect ratio tabular grain emulsions according to the present invention are in all instances less than 30 microns, preferably less than 15 microns, and optimally no greater than 10 microns.

Although it is possible to obtain reduced high angle scattering with single layer coatings of high aspect ratio tabular grain emulsions according to the present invention, it does not follow that reduced high angle scattering is necessarily realized in multicolor coatings. In certain multicolor coating formats enhanced sharpness can be achieved with the high aspect ratio tabular grain emulsions of this invention, but in other multicolor coating formats the high aspect ratio tabular grain emulsions of this invention can actually degrade the sharpness of underlying emulsion layers.

Referring back to Layer Order Arrangement I, it can be seen that the blue recording emulsion layer lies nearest to the exposing radiation source while the underlying green recording emulsion layer is a tabular emulsion according to this invention. The green recording emulsion layer in turn overlies the red recording emulsion layer. If the blue recording emulsion layer contains grains having an average diameter in the range of from 0.2 to 0.6 micron, as is typical of many nontabular emulsions, it will exhibit maximum scattering of light passing through it to reach the green and red recording emulsion layers. Unfortunately, if light has already been scattered before it reaches the high aspect ratio tabular grain emulsion forming the green recording emulsion layer, the tabular grains can scatter the light passing through to the red recording emulsion layer to an even greater degree than a conventional emulsion. Thus, this particular choice of emulsions and layer arrangement results in the sharpness of the red recording emulsion layer being significantly degraded to an extent greater than would be the case if no emulsions according to this invention were present in the layer order arrangement.

In order to realize fully the sharpness advantages of the present invention in an emulsion layer that underlies a high aspect ratio tabular grain emulsion layer according to the present invention it is preferred that the the tabular grain emulsion layer be positioned to receive light that is free of significant scattering (that is, positioned to receive substantially specularly transmitted light). Stated another way, in the photographic elements of this invention improvements in sharpness in emulsion layers underlying tabular grain emulsion layers are best realized only when the tabular grain emulsion layer does not itself underlie a turbid layer. For example, if a high aspect ratio tabular grain green recording emulsion layer overlies a red recording emulsion layer and underlies a Lippmann emulsion layer and/or a high aspect ratio tabular grain blue recording emulsion layer according to this invention, the sharpness of the red recording emulsion layer will be improved by the presence of the overlying tabular grain emulsion layer or layers. Stated in quantitative terms, if the collection angle of the layer or layers overlying the high aspect ratio tabular grain green recording emulsion layer is less than about 10°, an improvement in the sharpness of the red recording emulsion layer can be realized. It is, of course, immaterial whether the red recording emulsion layer is itself a high aspect ratio tabular grain emulsion layer according to this invention insofar as the effect of the overlying layers on its sharpness is concerned.

In a multicolor photographic element containing superimposed color-forming units it is preferred that at least the emulsion layer lying nearest the source of exposing radiation be a high aspect ratio tabular grain emulsion in order to obtain the advantages of sharpness offerred by this invention. In a specifically preferred form of the invention each emulsion layer which lies nearer the exposing radiation source than another image recording emulsion layer is a high aspect ratio tabular grain emulsion layer. Layer Order Arrangements II, III, IV, V, VI, and VII, described above, are illustrative of multicolor photographic element layer arrangements according to the invention which are capable of imparting significant increases in sharpness to underlying emulsion layers.

Although the advantageous contribution of high aspect ratio tabular grain emulsions to image sharpness in multicolor photographic elements has been specifically described by reference to multicolor photographic elements, sharpness advantages can also be realized in multilayer black-and-white photographic elements intended to produce silver images. It is conventional practice to divide emulsions forming black-and-white images into faster and slower layers. By employing high aspect ratio tabular grain emulsions according to this invention in layers nearest the exposing radiation source the sharpness of underlying emulsion layers will be improved.

Dye Image Transfer

It is possible to construct a dye image transfer film unit according to the present invention capable of producing a monochromatic transferred dye image by locating on a support a single dye-providing layer unit comprised of a tabular silver halide emulsion layer as described above and at least one dye-image-providing material in the emulsion layer itself or in an adjacent layer of the layer unit. In addition, the dye image transfer film unit is comprised of a dye receiving layer capable of mordanting or otherwise immobilizing dye migrating to it. To produce a transferred dye image the tabular grain emulsion is imagewise exposed and contacted with an alkaline processing composition with the dye receiving and emulsion layers juxtaposed. In a particularly advantageous application for monochromatic transferred dye images a combination of dye-image-providing materials is employed to provide a neutral transferred dye image. Monochromatic transferred dye images of any hue can be produced, if desired.

Multicolor dye image transfer film units of this invention employ three dye-providing layer units: (1) a cyan-dye-providing layer unit comprised of a red-sensitive silver halide emulsion having associated therewith a cyan-dye-image-providing material, (2) a magenta-dye-providing layer unit comprised of a green-sensitive silver halide emulsion having associated therewith a magenta-dye-image-providing material, and (3) a yellow-dye-providing layer unit comprised of a blue-sensitive silver halide emulsion having associated therewith a yellow-dye-image-providing material. Each of the dye-providing layer units can contain one, two, three, or more separate silver halide emulsion layers as well as the dye-image-providing material, located in the emulsion layers or in one or more separate layers forming part of the dye-providing layer unit. Any one or combination of the emulsion layers can be high aspect ratio tabular grain silver halide emulsion layers as described above. In a preferred form of the invention at least the fastest emulsion layers in the cyan and magenta-dye-providing layer units are high aspect ratio tabular grain silver halide emulsions as described above. At least the fastest emulsion layer in the yellow-dye-image-providing layer unit is also preferably comprised of a high aspect ratio tabular grain silver halide emulsion as described above, but the use of other, conventional silver halide emulsions in the yellow-dye-providing layer unit together with high aspect ratio tabular grain silver halide emulsions in the cyan and magenta-dye-providing layer units is also specifically contemplated.

Depending upon the dye-image-providing material employed, it can be incorporated in the silver halide emulsion layer or in a separate layer associated with the emulsion layer. The dye-image-providing material can be any of a number known in the art, such as dye-forming couplers, dye developers, and redox dye-releasers, and the particular one employed will depend on the nature of the element or film unit and the type of image desired. Materials useful in diffusion transfer film units contain a dye moiety and a monitoring moiety. The monitoring moiety, in the presence of the alkaline processing composition and as a function of silver halide development, is responsible for a change in mobility of the dye moiety. These dye-image-providing materials can be initially mobile and rendered immobile as a function of silver halide development, as described in Rogers U.S. Pat. No. 2,983,606. Alternatively, they can be initially immobile and rendered mobile, in the presence of an alkaline processing composition, as a function of silver halide development. This latter class of materials include redox dye-releasing compounds. In such compounds, the monitoring group is a carrier from which the dye is released as a direct function of silver halide development or as an inverse function of silver halide development. Compounds which release dye as a direct function of silver halide development are referred to as negative-working release compounds, while compounds which release dye as an inverse function of silver halide development are referred to as positive-working release compounds. Since the internal latent image-forming emulsions of this invention develop in unexposed areas in the presence of a nucleating agent and a surface developer, positive transferred dye images are produced using negative-working release compounds, and the latter are therefore preferred for use in the practice of this invention.

A preferred class of negative-working release compounds are the ortho or para sulfonamidophenols and naphthols described in Fleckenstein U.S. Pat. No. 4,054,312, Koyama et al U.S. Pat. No. 4,055,428, and Fleckenstein et al U.S. Pat. No. 4,076,529. In these compounds the dye moiety is attached to a sulfonamido group which is ortho or para to the phenolic hydroxy group and is released by hydrolysis after oxidation of the sulfonamido compound during development.

Another preferred class of negative-working release compounds are ballasted dye-forming (chromogenic) or nondye-forming (nonchromogenic) couplers having a mobile dye attached to a coupling-off site. Upon coupling with an oxidized color developing agent, such as a para-phenylenediamine, the mobile dye is displaced so that it can transfer to a receiver. The use of such negative-working dye image providing compounds is illustrated by Whitmore et al U.S. Pat. No. 3,227,550, Whitmore U.S. Pat. No. 3,227,552, and Fujiwhara et al U.K. Pat. No. 1,445,797, the disclosures of which are here incorporated by reference.

Since the silver halide emulsions employed in the image transfer film units of the present invention are positive-working, the use of positive-working release compounds will produce negative transferred dye images. Useful positive-working release compounds are nitrobenzene and quinone compounds described in Chasman et al U.S. Pat. No. 4,139,379, the hydroquinones described in Fields et al U.S. Pat. No. 3,980,479 and the benzisoxazolone compounds described in Hinshaw et al U.S. Pat. No. 4,199,354.

Further details regarding the above release compounds, the manner in which they function, and the procedures by which they can be prepared are contained in the patents referred to above, the disclosures of which are incorporated herein by reference.

Any material can be employed as the dye receiving layer in the film units of this invention as long as it will mordant or otherwise immobilize the dye which diffuses to it. The optimum material chosen will, of course, depend upon the specific dye or dyes to be mordanted. The dye receiving layer can also contain ultraviolet absorbers to protect the dye image from fading due to ultraviolet light, brighteners, and similar materials to protect or enhance the dye image. A polyvalent metal, preferably immobilized by association with a polymer, can be placed in or adjacent in the receiving layer to chelate the transferred image dye, as taught by Archie et al U.S. Pat. No. 4,239,849 and Myers et al U.S. Pat. No. 4,241,163. Useful dye receiving layers and materials for their fabrication are disclosed in *Research Disclosure,* Vol. 151, November 1976, Item 15162, and Morgan et al U.S. Pat. No. 4,258,117.

The alkaline processing composition employed in the dye image transfer film units can be an aqueous solution of an alkaline material, such as an alkali metal hydroxide or carbonate (e.g., sodium hydroxide or sodium carbonate) or an amine (e.g., diethylamine). Preferably the alkaline composition has a pH in excess of 11. Suitable materials for use in such compositions are disclosed in *Research Disclosure,* Item 15162, cited above.

A developing agent is preferably contained in the alkaline processing composition, although it can be contained in a separate solution or process sheet, or it can be incorporated in any processing composition penetrable layer of the film unit. When the developing agent is separate from the alkaline processing composition, the alkaline composition serves to activate the developing agent and provide a medium in which the developing agent can contact and develop silver halide.

A variety of silver halide developing agents can be used in processing the film units of this invention. The choice of an optimum developing agent will depend on the type or film unit with which it is used and the particular dye image-providing material employed. Suitable developing agents can be selected from such compounds as hydroquinone, aminophenols (e.g., N-methylaminophenol), 1-phenyl-3-pyrazolidinone, 1-phenyl-4,4-dimethyl-3-pyrazolidinone, 1-phenyl-4-methyl-4-hydroxymethyl-3-pyrazolidinone, and N,N,N',N'-tetramethyl-p-phenylenediamine. The nonchromogenic developers in this list are preferred for use in dye transfer film units, since they have a reduced propensity to stain dye image-receiving layers.

An unexpected advantage attainable with the image transfer film units of the present invention which was first observed without knowledge of any comparable effect in the image transfer film units of Jones and Hill, cited above, is the reduced variance of the transferred image as a function of temperature. This reduced variance in the transferred image is a direct result of employing one or more tabular silver halide emulsion layers, as described above. Without being bound by any particular theory, it is believed that the tabular silver halide grains show less variation in their development rates as a function of temperature. In image transfer systems in which silver halide development is directly related to transferred imaging materials this reduced temperature dependence of tabular silver halide grains results directly in reduced variance in the viewed image. In systems relying also upon competing mechanisms for generation of the viewable image, reduced silver halide development variance as a function of temperature can reduce variance in the transferred image to the extent it is attributable to silver halide development variance and to the extent it complements temperature variances in the competing mechanisms employed in imaging.

It has been surprisingly observed that the dye image transfer film units of the present invention exhibit substantially higher photographic speeds at lower silver coverages than comparable conventional dye image transfer film units. It is well known to those skilled in the art that silver coverages below a threshold level result in reduction of observed photographic speed as determined from a transferred dye image. While speed decreases when the silver coverages of silver halide emulsions are reduced, the speed reduction is much more gradual when high aspect ratio tabular grain emulsions are employed, thereby allowing lower silver coverages.

The image transfer film units also exhibit advantages similar to those observed by Jones and Hill, cited above, (as well as additional, unexpected advantages illustrated in connection with the examples).

One of these advantages is the rapidity with which the transferred image becomes viewable. The rapid accessibility of the viewable transferred image is directly attributable to the presence of one or more high aspect ratio tabular grain silver halide emulsions according to the present invention. Without being bound by any particular theory, it is believed that the geometrical configuration of the tabular silver halide grains accounts for rapid access to the transferred images. Tabular grain geometry provides a very high surface area to the silver halide grains as compared to their volume, and this in turn is believed to influence their rate of development. In image transfer processes it is the imagewise variation in development of the silver halide grains as a function of their imagewise exposure which modulates the transferred image. In some systems, such as those employing negative-working release compounds, described above, silver halide development is directly related to transferred imaging materials. The faster the silver halide develops, the faster the imaging materials are made available for viewing.

The use of tabular grains to reduce the time elapsed between the commencement of processing and obtaining a viewable transferred image—i.e., access time—in no way precludes the use of conventional image transfer film unit features which are known to reduce access time. When the present invention is employed in combination with conventional features for reducing access time at least additive results can be normally expected. In addition, there are still other features unique to the image transfer film units of this invention which can contribute to reduced access time. These additional features are discussed below.

Acceptable photographic speeds in conventional multicolor image transfer film units are commonly obtained by employing silver halide in each of the yellow, magenta, and cyan-dye-providing layer units at silver coverages of about 1000 mg/m$^2$ or higher. It is specifically contemplated to employ substantially lower silver coverages in the practice of this invention. When the silver halide emulsion in the yellow, magenta, or cyan-dye-providing layer unit of the dye image transfer film unit of this invention is tabular as described above, it can be efficiently employed at silver coverages of from about 150 to 750 mg/m$^2$, preferably from about 200 to 700 mg/m$^2$, and optimally from about 300 to 650 mg/m$^2$. At higher and lower silver coverages higher and lower photographic speeds, respectively, will be realized, the stated ranges reflecting an efficient balance of photographic performance and silver coverages for most imaging applications. When the image transfer film unit contains a single dye-providing layer unit containing tabular silver halide grains, then these coverages are applicable to that of a single dye-providing layer unit. When all three dye-providing layer units contain tabular silver halide emulsions, at least additive silver savings can be realized.

The image transfer film units of this invention can employ any layer order arrangement heretofore known to be useful in conventional image transfer film units having one or more radiation-sensitive silver halide emulsion layers. In addition, the distinctive properties of tabular silver halide emulsions make possible highly advantageous layer order arrangements not heretofore known to the art. The following specific layer order arrangements are merely illustrative, many other arrangements being additionally contemplated:

To avoid unnecessary repetition, discussion of each successive layer order arrangement is directed to features which are distinctive as compared to prior layer order arrangements. Stated another way, features and advantages shared by the layer order arrangements are fully discussed only in connection with the first layer order arrangement in which they appear. If a feature or advantage is not shared by a subsequently described layer order arrangement, this is specifically pointed out.

| Image Transfer Film Unit I |
|---|
| A Laminate and Peel-Apart Dye Image Transfer Film Unit<br>Reflective Support<br>Dye Receiving Layer<br>Imagewise Exposure<br>↓<br>Tabular Silver Halide Emulsion Layer<br>With Dye-Image-Providing Material<br>Support |

Image Transfer Film Unit I is illustrative of a conventional laminate and peel-apart image transfer film unit. Upon imagewise exposure, the positive-working tabular silver halide emulsion layer produces a developable latent image at centers located on the interior of exposed grains. The dye receiving layer is laminated and an alkaline processing composition, not shown, is released between the dye receiving layer and emulsion layer following exposure. Upon contact with the alkaline processing composition development of the tabular silver halide grains bearing internal latent image centers occurs much more slowly than the development of silver halide grains which do not contain internal latent image centers. Using a negative-working dye-image-providing material dye is released in those areas in which silver development occurs and migrates to the dye receiving layer where it is held in place by a mordant. A positive transferred dye image is produced in the dye receiving layer. Processing is terminated by peeling the reflective support having the dye receiving layer coated thereon from the remainder of the image transfer film unit.

While the layer order arrangement is conventional and employs conventional materials other than the tabular silver halide emulsion layer, significantly superior results are obtainable. The access time required to produce a viewable dye image in the receiving layer is substantially reduced. It is believed that this can be attributed to distinct advantages offered by internal latent image-forming tabular silver halide grains. Internal latent image-forming tabular silver halide grains according to this invention develop at a faster rate than comparable nontabular internal latent image-forming silver halide grains.

Although development can entirely account for the more rapid image access in Image Transfer Film Unit I, another characteristic of tabular grain emulsions can also be used to further reduce image access times. While high aspect ratio tabular grain emulsion layers can be coated in the same layer thicknesses as conventional emulsions without departing from the teachings of this invention, it is preferred to thin the high aspect ratio tabular grain silver halide emulsion layers as compared to corresponding conventional silver halide emulsion layers. In conventional silver halide emulsions employed in image transfer the emulsion layer thickness is substantially greater than the average grain diameter calculated from the grain projected areas. Further, the thickness of the layer is large enough to accommodate not just the average grains, but the largest grains present. Thus, if the largest nontabular silver halide grains in a silver halide emulsion layer of an image transfer film unit exhibit an average diameter of from 1 to 2 microns, the emulsion layer will be at least 1 to 2 microns in thickness and will usually be substantially greater in thickness. On the other hand, it is possible to employ tabular silver halide grains according to the present invention having diameters based on average projected areas of 1 to 2 microns and often still larger while the thickness of the tabular grains is less than 0.5 or even 0.3 micron. Thus, in an exemplary emulsion in which the tabular grains have an average thickness of 0.1 micron with an average diameter of 1 to 2 microns, the silver halide emulsion layer thickness can easily be reduced substantially below 1 micron. The high aspect ratio tabular grain emulsion layers of this invention are preferably less than 4 times the average thickness of the tabular grains and are optimally less than twice the average thickness of the tabular grains. Significant reductions in the thickness of the high aspect ratio tabular grain silver halide emulsion layers of the invention can contribute to reduction in image access times by reducing the lengths of diffusion paths. Further, reduction of the lengths of diffusion paths can also contribute to improvements in sharpness.

| Image Transfer Film Unit II |
|---|
| An Integral Monochromatic Dye Image Transfer Film Unit |
| View |
| ↓ |
| Transparent Support |
| Dye Receiving Layer |
| Reflective Layer |
| Opaque Layer |
| Tabular Silver Halide Emulsion Layer |
| With Dye-Image Providing Material |
| Alkaline Processing Composition + Opacifier |
| Timing Layer |
| Neutralizing Layer |
| Transparent Support |
| ↑ |
| Imagewise Exposure |

Initially the alkaline processing composition containing opacifier is not present in the location shown. Therefore, upon imagewise exposure light strikes the tabular silver halide emulsion layer. This produces a latent image corresponding to light-struck areas of the emulsion layer. To initiate processing the alkaline processing composition is placed in the position shown. Usually, but not necessarily, the image transfer film unit is removed from the camera in which it is exposed immediately following placement of the alkaline processing composition and opacifier. The opacifier and opaque layer together prevent further exposure of the emulsion layer. Upon development, a mobile dye or dye precursor is released from the emulsion layer. The mobile dye or dye precursor penetrates the opaque layer and the reflective layer and is mordanted or otherwise immobilized in the dye receiving layer to permit viewing through the uppermost transparent support. Processing is terminated by the timing and neutralizing layers.

| Image Transfer Film Unit III |
|---|
| An Integral Multicolor Dye Image Transfer Film Unit |
| Imagewise Exposure |
| ↓ |
| Transparent Support |
| Neutralizing Layer |
| Timing Layer |
| Alkaline Processing Composition + Opacifier |
| Transparent Overcoat |
| Blue-sensitive Tabular Silver Halide Emulsion Layer |
| Yellow Dye-Image-Providing Material Layer |

-continued

| Image Transfer Film Unit III |
|---|
| Interlayer With Scavenger |
| Green-sensitive Tabular Silver Halide Emulsion Layer |
| Magenta Dye-Image-Providing Material Layer |
| Interlayer With Scavenger |
| Red-sensitive Tabular Silver Halide Emulsion Layer |
| Cyan Dye-Image-Providing Material Layer |
| Opaque Layer |
| Reflective Layer |
| Dye Receiving Layer |
| Transparent Support |
| ↑ |
| View |

Image Transfer Film Unit III is essentially similar to Image Transfer Film Unit II, but is modified to contain three separate dye-providing layer units, each comprised of one high aspect ration tabular grain silver halide emulsion layer and one dye-image-providing material layer, instead of the single dye-image-providing material containing high aspect ratio tabular grain silver halide emulsion layer of Image Transfer Film Unit II. (Whether or not the dye-image-providing material is placed in the emulsion layer itself or in an adjacent layer in Image Transfer Film Units II and III is a matter of choice, either arrangement being feasible.)

To prevent color contamination of adjacent dye-providing layer units, an interlayer containing a scavenger is positioned between dye-providing layer units. The use of scavengers in interlayers and/or in the dye-providing layer units themselves is contemplated. In some instances reductions in minimum edge densities can also be realized by incorporating a negative-working silver halide emulsion in the interlayers.

In a modification of Image Transfer Film Unit III it is possible to eliminate the interlayers. Since the high aspect ratio tabular grain silver halide emulsion layers can be quite thin in comparison to conventional silver halide emulsion layers typically employed in multicolor dye image transfer film units, each high aspect ratio tabular grain silver halide emulsion layer can be coated between two magenta dye-image-providing material layers. The two magenta-dye-image providing material layers preferably do not contain scavenger, but can contain scavenger, if desired, depending upon the sensitivity of the imaging application to color contamination and the specific choice of dye-image-providing materials. Providing dye-image-providing layers adjacent both sides of each high aspect ratio tabular grain silver halide emulsion layer provides a close association between the dye-image-providing materials and the silver halide. This arrangement is most advantageous where the dye-image-providing materials of each dye-providing layer unit is initially colorless or at least shifted in hue so that the dye-image-providing material is not adsorbing in the spectral region to which the silver halide is intended to respond.

Where the yellow dye-image-providing material is initially yellow, it acts, together with the blue-sensitive high aspect ratio tabular grain silver halide emulsion layer, to intercept blue light that would otherwise reach the green and red-sensitive high aspect ratio tabular grain silver halide emulsion layers. Where the green and red-sensitive silver halide emulsion layers employ silver bromide or silver bromoiodide grains in a conventional multicolor dye image transfer film unit, it is necessary to intercept blue light to avoid color contamination of the green and red-sensitive emulsion layers. However, where the green and red-sensitive emulsions are high aspect ratio tabular grain internal latent image-forming emulsions according to this invention as specifically described above, it is unnecessary to filter blue light so that it is attenuated before reaching these emulsion layers. Thus, where the yellow dye-image-providing material is initially colorless or at least nonabsorbing in the blue region of the spectrum, it is still possible for accurate color reproduction to occur in the magenta and cyan dye-providing layer units without any necessity of interposing a yellow filter layer. Further, as is more fully described below, the dye-providing color-forming layer units can be located in any desired order.

| Image Transfer Film Unit IV |
|---|
| An Integral Multicolor Dye Image Transfer Film Unit |
| Opaque Support |
| Yellow Dye-Image-Providing Material Layer |
| Blue-sensitive Tabular Silver |
| Halide Emulsion Layer |
| Interlayer With Scavenger |
| Cyan Dye-Image-Providing Material Layer |
| Red-sensitive Tabular Silver |
| Halide Emulsion Layer |
| Interlayer With Scavenger |
| Magenta Dye-Image-Providing Material Layer |
| Green-sensitive Tabular Silver |
| Halide Emulsion Layer |
| Transparent Overcoat |
| Alkaline Processing Composition With |
| Reflective Material and Indicator Dye |
| Dye Receiving Layer |
| Timing Layer |
| Neutralizing Layer |
| Transparent Support |
| ↑ |
| View and Imagewise Exposure |

In Image Transfer Film Unit IV during imagewise exposure the alkaline processing composition containing the reflective material and indicator dye is not in the position shown, but is released to the position shown after exposure to permit processing. The indicator dye exhibits a high density at the elevated levels of pH under which processing occurs. It thereby protects the silver halide emulsion layers from further exposure if the film unit is removed from a camera during processing. Once the neutralizing layer reduces the pH within the film unit to terminate processing, the indicator dye reverts to an essentially colorless form. The alkaline processing composition also contains an opaque reflective material, which provides a white background for viewing the transferred dye image after processing and prevents additional exposure.

Image Transfer Film Unit IV is illustrative of the application of the invention to an integral multicolor dye image transfer film unit format in which imagewise exposure and viewing occur through the same support. Image Transfer Film Unit IV differs from the prior teachings of the art not only in the use of high aspect ratio tabular grain silver halide emulsions, but also in the order in which the dye-providing layer units are arranged. The green-sensitive high aspect ratio tabular grain silver halide emulsion layer is nearest to the exposing radiation source while the blue-sensitive high aspect ratio tabular grain silver halide emulsion layer is farthest removed. This arrangement is possible without color contamination because of the relatively large separations in blue and minus blue response attainable with minus blue spectrally sensitized high aspect ratio tabular grain silver halide emulsions. By placing the magenta-dye-providing layer unit nearest the source of exposing radiation and nearest the dye receiving layer, the sharpness of the magenta dye image is improved and its access time is reduced. The magenta dye image is, of course, the visually most important component of the multicolor dye image. The cyan image is the visually second most important, and its location is also nearer the exposing radiation source and the dye receiving layer than in a corresponding conventional dye image transfer film unit. Thus, significant advantages in terms of reduced image access time and increased image sharpness are attainable with Image Transfer Film Unit IV in addition to those improvements attributable to high aspect ratio tabular grain silver halide grains previously discussed above in connection with other layer order arrangements. While Image Transfer Film Unit IV is useful with all high aspect ratio tabular grain silver halides, it is particularly advantageous with high aspect ratio tabular grain silver bromide or bromoiodide.

Although the invention has been particularly described with reference to certain preferred layer order arrangements, it is appreciated that the high aspect ratio tabular grain silver halide emulsions need not always be present as planar, uninterrupted layers. Rather than being continuous, the layers can be subdivided into discrete laterally displaced portions or segments. In multicolor image transfer film units the layers need not be superimposed, but can be present in the form of interlaid layer segments. It is specifically contemplated to employ high aspect ratio tabular grain silver halide emulsions as herein disclosed in microcellular image transfer film unit arrangements, such as disclosed by Whitmore U.S. Pat. Nos. 4,362,806, 4,375,507, and 4,387,146, here incorporated by reference. The present invention is also fully applicable to microcellular image transfer film units containing microcells which are improvements on Whitmore, such as Gilmour U.S. Pat. No. 4,386,145, titled AN IMPROVEMENT IN THE FABRICATION OF ARRAYS CONTAINING INTERLAID PATTERNS OF MICROCELLS; Blazey et al U.S. Pat. No. 4,307,165; and Gilmour et al U.S. Pat. No. 4,411,973, titled ELEMENTS CONTAINING ORDERED WALL ARRAYS AND PROCESS FOR THEIR FABRICATION, the disclosures of which are here incorporated by reference.

Although all of the advantages attributable to high aspect ratio tabular grain silver halide emulsions can be realized in microcellular image transfer film units, the large minus blue and blue speed separations obtainable with spectrally sensitized high aspect ratio tabular grain silver halide emulsions, most notably silver bromide and bromoiodide emulsions, are particularly advantageous in microcellular image transfer film units intended to produce multicolor images. Since the microcell triads intended to respond to blue, green, and red light are positioned to receive the same incident light, yellow filters are usually interposed when using conventional silver bromide and bromoiodide emulsions to improve minus blue and blue speed separation. This can involve an additional coating or cell filling step and reduce photographic speed. The high aspect ratio tabular grain silver halide emulsions of this invention can be employed in multicolor microcellular image transfer film units without the use of yellow filters, thereby significantly simplifying construction and improving performance.

EXAMPLES

The invention can be better appreciated by reference to the following illustrative examples. In each of the emulsion preparations the contents of the reaction vessel were vigorously stirred during silver salt addition; the term "percent" means percent by weight, unless otherwise indicated; and the tem "M" stands for molar concentrations, unless otherwise indicated. All solutions, unless otherwise indicated, are aqueous solutions.

Emulsion Preparation

The emulsions used in this invention were prepared as follows:

Emulsion A

Core Tabular AgBrI Emulsion

A AgI seed grain emulsion was prepared by a double-jet precipitation technique at pI 2.85 and 35° C. To prepare 0.125 moles of emulsion 5.0M silver nitrate and 5.0M sodium iodide solutions were added over a period of 3.5 minutes to a reaction vessel containing 60 grams of deionized bone gelatin dissolved in 2.5 liters of water. The resulting silver iodide emulsion had a mean grain diameter of 0.027 μm and the crystals were of hexagonal bipyramidal structure.

Then 1.75 moles of silver bromide was precipitated onto $2.4\times10^{-10}$ mole of the silver iodide seed grains by a double-jet technique. 4.0M silver nitrate and 4.0M sodium bromide reagents were added over a 15 minutes period at 80° C. using accelerated flow (6.0X from start to finish). The pBr was maintained at 1.3 during the first 5 minutes, adjusted to a pBr of 2.2 over the next 3 minutes, and maintained at 2.2 for the remainder of the precipitation.

The resulting tabular AgBrI crystals had a mean grain diameter of 1.0 μm, an average thickness of 0.08 μm, and an average aspect ratio of 12.5:1 and account for greater than 90 percent of the total projected area of the silver halide grains.

Emulsion A was then chemically sensitized with 1.9 mg/Ag mole sodium thiosulfate pentahydrate and 2.9 mg/Ag mole potassium tetrachloroaurate for 30 minutes at 80° C.

Emulsion B

Core/Shell Tabular AgBrI Emulsion

The chemically sensitized Emulsion A (0.22 mole) was placed in a reaction vessel at pBr 1.7 at 80° C. Then onto Emulsion A, 5.78 moles of silver bromide were precipitated by a double-jet addition technique. 4.0M silver nitrate and 4.0M sodium bromide solutions were added in an accelerated flow (4.0X from start to finish) over a period of 46.5 minutes while maintaining a pBr of 1.7. The resulting AgBrI crystals had a mean grain diameter of 3.0 μm, an average thickness of 0.25 μm, and average aspect ratio of 12:1.

Emulsion B was chemically sensitized with 1.0 mg/Ag mole sodium thiosulfate pentahydrate for 40 minutes at 74° C. and red spectrally sensitized with 250 mg/Ag mole anhydro-5,5'-dichloro-9-ethyl-3,3'-bis(3-sulfobutyl)thiacarbocyanine hydroxide.

Emulsion C

Cadmium Doped Tabular AgBrI Internal Latent Image-Forming Emulsion

Emulsion C was prepared the same as Emulsion B with the exception that at 8 minutes into the shelling stage of the core/shell precipitation cadmium bromide was added at 0.05 mole percent (based on the moles of silver in the shell).

Emulsion D

Control Emulsion

A 1.8 μm monodispersed internal image octahedral AgBr emulsion similar to that described in Example 7 of Evans U.S. Pat. No. 3,923,513, was used as a control for the above emulsion. The 1.25 μm core emulsion was chemically sensitized with 0.4 mg/Ag mole sodium thiosulfate pentahydrate and 0.6 mg/Ag mole potassium tetrachloroaurate. The shelled emulsion was chemically sensitized with 0.35 mg/Ag mole sodium thiosulfate pentahydrate. The control emulsion was then sensitized with 100 mg/Ag mole anhydro-5,5'-dichloro-9-ethyl-3,3'-bis(3-sulfobutyl)thiacarbocyanine hydroxide.

Emulsion E

Tabular Grain AgBrI Internal Latent Image-Forming Emulsion

A core emulsion was prepared similar to Emulsion A above. The emulsion was chemically sensitized with 2.5 mg/Ag mole sodium thiosulfate pentahydrate and 3.75 mg/Ag mole potassium tetrachloroaurate for 10 minutes at 80° C. Then 0.067 mole of the chemically sensitized emulsion was further precipitated with silver bromide by a double-jet addition technique. 5.0 Molar $AgNO_3$ and 5.0 Molar NaBr reagents were each added for 16.6 minutes at pBr 2.4 at 80° C., precipitating an additional 0.133 mole of silver bromide. The resultant tabular AgBrI (≦0.10 mole percent I) crystals had a mean grain diameter of 1.5 μm, an average thickness of 0.14 μm, and an average aspect ratio of 10.7:1, and account for greater than 85 percent of the total projected surface area of the silver halide grains.

Emulsion F

Tabular Grain AgBrI Internal Latent Image-Forming Emulsion

A core emulsion was prepared and chemically sensitized as described for Emulsion E above. Following chemical sensitization 0.067 mole of the core emulsion was shelled with additional silver bromoiodide in the following manner: 5.0 Molar silver and halide salt reagents were added at a constant flow rate for 11.1 minutes at pBr 2.4 at 80° C. The halide salts consisted of 90 mole percent bromide and 10 mole percent iodide. A total of 0.045 mole of additional AgBrI was added. A second shell was then precipitated identical to the first with the exception that the halide salts consisted of 80 mole Percent bromide and 20 mole percent iodide. Similarly a third shell was precipitated over the second with the exception that the halide salts consisted of 70 mole percent bromide and 30 mole percent iodide. The resultant tabular AgBrI (13.3 mole percent I) crystals had a mean grain diameter of 1.5 μm, an average thickness of 0.14 μm, and an average aspect ratio of 10.7:1, and account for greater than 85 percent of the total projected area of the silver halide grains.

Example 1A

This example shows that a red-sensitized tabular grain internal latent image-forming emulsion, Emulsion B, provides an advantage in developability over an extended temperature range compared to a red-sensitized internal latent image-forming octahedral grain emulsion, Emulsion D, as used in a multicolor image transfer latent element using sulfonamidonaphthol redox dye-release (RDR) chemistry.

An integral imaging receiver (IIR) of the following layer order arrangement was prepared: Coverages are in (g/m$^2$) or [mg/Ag mole]. Chemical structures are shown in the Appendix below.

Layer 16: Overcoat layer: Scavenger VIII (0.11), gelatin (0.89), Bis(vinylsulfonylmethyl)ether hardener at 1 percent of the total gelatin weight Layer 15: Blue-sensitive silver halide layer: The emulsion is similar to the octahedral grain control Emulsion D except that it is blue-sensitized. Silver halide (1.34 Ag), nucleating agent V [13.0], nucleating agent VI [0.41], scavenger VII [4000], gelatin (1.34)

Layer 14: Interlayer: Titanium dioxide (0.27), gelatin (0.65)

Layer 13: Yellow dye-releaser layer: RDR I (0.65), gelatin (0.86)

Layer 12: Interlayer: Negative silver bromide emulsion (0.11 Ag), scavenger VIII (1.1), gelatin (1.3)

Layer 11: Green-sensitive silver halide layer: The emulsion is similar to the octahedral grain control Emulsion D except that it is green-sensitized. Silver halide (1.34 Ag), nucleating agent V [17.0], nucleating agent VI [0.87], scavenger VII [4000], gelatin (1.34)

Layer 10: Interlayer: Titanium dioxide (0.32), gelatin (0.65)

Layer 9: Magenta dye-releaser layer: RDR II (0.43), gelatin (0.86)

Layer 8: Interlayer: Negative silver bromide emulsion (0.05 Ag), scavenger VIII (1.1), gelatin (1.2)

Layer 7: Red-sensitive silver halide layer: Emulsion B (1.34 Ag), nucleating agent V [2.0], scavenger VII [4000], gelatin (1.34)

Layer 6: Gel (0.43) interlayer

Layer 5: Interlayer: Titanium dioxide (0.81), gelatin (0.65)

Layer 4: Cyan dye-releaser layer: RDR III (0.43), gelatin (0.65)

Layer 3: Opaque layer: Carbon (1.9), RDR IV (0.02), scavenger VII (0.03), gelatin (1.2)

Layer 2: Reflecting layer: Titanium dioxide (22.0), gelatin (3.4)

Layer 1: Receiving layer: Mordant IX (4.8), gelatin (2.3)

The layers were coated on a clear polyester support in the order of numbering.

A control integral imaging receiver of the same layer order arrangement was prepared as above except Layer 7 had Emulsion D at 1.4 g Ag/m$^2$.

The following processing pod composition was employed in both units:

| | |
|---|---|
| Potassium hydroxide | 46.8 g/l |
| 4-Methyl-4-hydroxymethyl-1-p-tolyl-3-pyrazolidone | 15.0 g/l |
| 5-Methylbenzotriazole | 5.0 g/l |
| Carboxymethylcellulose | 46.0 g/l |

-continued

| | |
|---|---|
| Potassium fluoride | 10.0 g/l |
| Anionic dispersant (Tamol SN ®) | 6.4 g/l |
| Potassium sulfite (anhydrous) | 3.0 g/l |
| 1,4-Cyclohexanedimethanol | 3.0 g/l |
| Carbon | 191.0 g/l |

Two cover sheets of the following structure were prepared:

Layer 2: Timing layer: 1:1 physical mixture of the following two polymers coated at 3.2 g/m$^2$. Poly(acrylonitrile-co-vinylidene chloride-co-acrylic acid) at a weight ratio of 14:79:7 (isolated as a latex, dried and dispersed in an organic solvent). A carboxy ester lactone was formed by cyclization of a vinyl acetate-maleic anhydride copolymer in the presence of 1-butanol to produce a partial butyl ester with a weight ratio of acid to butyl ester of 15:85 (See Abel U.S. Pat. No. 4,229,516). This layer also contains t-butylhydroquinone monoacetate at 0.22 g/m$^2$ as a competor and 5-(2-cyanoethylthio)-1-phenyltetrazole at 0.11 g/m$^2$ as a blocked inhibitor.

Layer 1: Acid layer: Poly(n-butyl acrylate-co-acrylic acid) 30:70 weight ratio equivalent to 140 meq acid/m$^2$.

The layers were coated on a clear polyester support in the order of numbering.

The above image transfer film units including the processing composition and cover sheet were used in the following manner:

Each multicolor photosensitive integral imaging receiver was exposed for 1/100 second in a sensitometer through a step tablet to 5000° K. illumination (daylight balance-neutral), then processed at a controlled temperature (either 16° C. or 22° C.) using a viscous processing composition contained in a pod. The processing composition was spread between the IIR and the transparent cover sheet using a pair of juxtaposed rollers to provide a processing gap of about 65 μm.

After a period of more than one hour the red density of the stepped image was read. The red minimum density ($D_{min}$) and maximum density ($D_{max}$) values were read from the above produced sensitometric curve.

The data obtained and tabulated below show higher maximum red dye density at both 16° C. and 22° C. processing for the tabular grain emulsion. The difference in red $D_{max}$ at these two temperatures is smaller with the tabular grain emulsion than the octahedral grain check indicating improved processing temperature latitude of the red layer. The speed of the control and example emulsion were essentially equivalent.

| | Red Density | | |
|---|---|---|---|
| Emulsion Type | $D_{max}/D_{min}$ (22° C.) | $D_{max}/D_{min}$ 16° C. | $\Delta D_{max}$ |
| Octahedral (D) (Control) | 1.73/0.22 | 0.99/0.21 | −0.74 (−43%) |
| Tabular (B) (Example) | 1.98/0.36 | 1.37/0.29 | −0.61 (−31%) |

Example 1B

The same improved processing temperature latitude and improved $D_{max}$ at low temperature development are shown in a single color coating with equivalent emulsions.

Coatings similar to those of Example 1A (but Single Color) were made but did not contain layers 15 to 8 (overcoat 16 was coated on top of the red-sensitive silver halide layer, 7). The pod and cover sheet are equivalent to those of Example 1A except the cover sheet had 0.043 g/m$^2$ each of inhibitor and competor.

| Emulsion Type | Red Density $D_{max}/D_{min}$ (22° C.) | $D_{max}/D_{min}$ 16° C. | $\Delta D_{max}$ |
|---|---|---|---|
| Octahedral (D) (Control) | 1.66/0.18 | 0.54/0.18 | −1.12 (−68%) |
| Tabular (B) (Example) | 1.80/0.24 | 1.14/0.21 | −0.66 (−37%) |

Example 2

This example shows that a coating containing red-sensitized internal latent image-forming tabular grain Emulsion B as used in Example 1A has improved room keeping compared to control octahedral grain Emulsion D.

The example single color coating is the same as the example coating of Example 1B. Two control coatings were employed similar to the control of Example 1B except layer 7 contained 1.4 μm and 1.8 μm octahedral emusions, respectively. The pod and cover sheet were similar to those of Example 1B.

The experimental procedure used was the same as Example 1A except processing was done only at room temperature (≈22° C.). To evaluate keeping stability one set of coatings was exposed and processed fresh, while another set was exposed and processed after being stored at room temperature for seven weeks.

The data below show that both control coatings using the octahedral grain emulsions lose considerably more $D_{max}$ after room temperature storage for seven weeks than example Emulsion B. $D_{min}$ changes (and speed changes) are not significantly different.

| Emulsion Type | Red Density $D_{max}/D_{min}$ (Fresh) | $D_{max}/D_{min}$ (After 7 weeks) | $\Delta D_{max}$ |
|---|---|---|---|
| Octahedral (D) 1.4 μm | 1.62/0.21 | 1.17/0.16 | −0.45 (−28%) |
| Octahedral (D) 1.8 μm | 1.50/0.20 | 1.07/0.17 | −0.43 (−28%) |
| Tabular (B) | 1.70/0.28 | 1.50/0.21 | −0.20 (−12%) |

Example 3

This example shows that single color red-sensitized coatings of tabular grain internal latent image-forming emulsions have both improved reversal speed and rereversal separation when cadmium doped.

The control coating contains an emulsion free of cadmium dopant, Emulsion B, the same as used in Example 1B. The example coating contains an equivalent cadmium doped Emulsion C, as outlined above. The coating structure consists of layers 16, and 7 to 1 as described for Example 1B. The pod and cover sheet are equivalent to Example 1B. The experimental procedure is the same as Example 1A except processing is done only at room temperature (≈22° C.). Threshold reversal speeds are read at 0.3 density below $D_{max}$, the reversal/rereversal separation is read at 0.7 density. A difference of 30 relative speed units equals 0.30 log E.

The data below show that the cadmium doped emulsion is 0.20 log E faster and has a net speed reversal/rereversal separation of 0.37 log E more than does the corresponding emulsion free of cadmium doping. It is highly desirable that the reversal speed becomes faster and the rereversal speed slower.

| Emulsion | Relative Reversal Speed (D = 0.7) | Relative Rereversal Speed (D = 0.7) | Δ |
|---|---|---|---|
| B (non CdII doped) | 272 | 77 | 195 |
| C (CdII doped) | 292 | 60 | 232 |
| | | | * (Net gain 37) |

Experimental results have also shown that the surface negative image can be significantly reduced if the shell portion of the tabular grain emulsion is doped with either lead (II) or erbium (III).

Example 4

This example demonstrates that coatings of a tabular grain internal latent image-forming emulsion have increased reversal-surface negative image separation when the shell portion of the tabular emulsion contains iodide in increasing molar concentration towards the crystal surface.

Emulsions E and F were each spectrally sensitized with 125 mg/Ag mole anhydro-5,5',6,6'-tetrachloro-1,1'-diethyl-3,3'-di(3-sulfobutyl)benzimidazolcarbocyanine hydroxide and 125 mg/Ag mole anhydro-5,5'-dichloro-3,9-diethyl-3'-(3-sulfopropyl)oxacarbocyanine hydroxide. The emulsions were then coated on polyester film support at 2.15 g/m$^2$ silver and 4.52 g/m$^2$ gelatin. The coatings were exposed for $10^{-2}$ second to a Xenon flash through a continuous density tablet on an Edgerton, Germeshausen, and Grier sensitometer and processed for 4 minutes in an p-methylaminophenol sulfate (Elon®)-hydroquinone developer containing 4-(β-methanesulfonamidoethyl)phenylhydrazine hydrochloride at 2.1 g/l as the nucleating agent and 0.2 g/l 5-methylbenzotriazole. Sensitometric results including the undyed emulsion controls are given below.

| Emulsion | Spectrally Sensitized | $D_{max}$ | Relative Threshold Speed (0.30 below $D_{max}$) | Relative Reversal Speed (D = 0.7) | Relative Rereversal Speed (D = 0.7) | Δ |
|---|---|---|---|---|---|---|
| E | No | 0.52 | 253 | ** | ** | ** |
| E | Yes | 1.64 | 314 | 277 | 155 | 122 |
| F | No | 1.22 | 311 | 286 | * | >286 |
| F | Yes | 1.02 | 331 | 326 | * | >326 |

*Rereversal was not observed over the range of exposures employed.
**Under the condtions of this experiment the maximum density failed to reach 0.7, at which reference density speed was measured.

As can be seen Emulsion F which contained tabular grains of increased iodide content in the shell portion, displayed significantly greater reversal/rereversal separation than Emulsion E which was shelled with pure AgBr. The spectrally sensitized Emulsion F had a reversal/rereversal separation of greater than 3.26 log E units at a density of 0.70 whereas the spectrally sensitized control Emulsion E had a separation of 1.22 log E units. It was also noted that the spectrally sensitized Emulsion F displayed less blue speed desensitization than the spectrally sensitized control Emulsion E.

Example 5

A high aspect ratio tabular grain internal latent image-forming silver bromide emulsion having an average grain diameter of 5.5 microns, an average grain thickness of 0.12 micron, and an average aspect ratio of 46:1 with the tabular grain accounting for 85 percent of the total grain projected area was prepared as follows:

A core emulsion having a grain diameter of 2.8 microns and an average grain thickness of 0.08 micron was precipitated by double-jet addition at pBr 1.3 at 80° C. The AgBr core emulsion was chemically sensitized with 0.9 mg $Na_2S_2O_3.5H_2O$/Ag mole and 0.6 mg $KAuCl_4$/Ag mole for 20 minutes at 80° C. Then the emulsion was precipitated with additional silver bromide at pBr 1.3 at 70° C. The resultant core-shell tabular grain emulsion was not surface sensitized.

The emulsion was coated on a polyester film support at 2.15 g/m$^2$ silver and 10.4 g/m$^2$ gelatin. A second coating was prepared that contained 50 mg/Ag mole 1-(2-propynyl)-2-methylquinolinium bromide. A third coating was prepared that contained 25 mg/Ag mole 1-(2-propynyl)-2-methyl-6-ethoxythioformamidoquinolinium trifluoromethanesulfonate. The coatings were exposed for 1/10 second to a 600 W 5500° K. tungsten light source and processed for 3 minutes at 20° C. in a ®Metol (N-methyl-p-aminophenol sulfate)-hydroquinone developer containing 0.25 g/l 5-methylbenzotriazole.

Sensitometric results revealed that the control coating displayed no reversal image. However, the core-shell tabular grain emulsion coating that contained 1-(2-propynyl)-2-methylquinolinium bromide resulted in a reversal image with a $D_{max}$ of 0.69 and a $D_{min}$ of 0.18.

Similarly, the core-shell tabular grain emulsion coating that contained 1-(2-propynyl)-2-methyl-6-ethoxythioformamidoquinolinium trifluoromethanesulfonate resulted in a reversal image of good discrimination with a $D_{max}$ of 0.95 and a $D_{min}$ of 0.30.

Example 6

Emulsion G

This emulsion was prepared following the procedure described in Maternaghan U.S. Pat. No. 4,184,878 for the preparation of Emulsion A. The emulsion had a mean grain diameter of 1.0 μm and an average aspect ratio of 2.6:1. The emulsion was spectrally sensitized with 150 mg/Ag mole anhydro-5,5'-dichloro-9-ethyl-3,3'-bis(3-sulfobutyl)thiacarbocyanine hydroxide.

Emulsion H

Since Emulsion G exhibited a mean grain diameter of 1.0 μm as compared to the 0.76 μm mean grain diameter reported for Emulsion A by Maternaghan '878, the procedure employed to prepare and sensitize Emulsion 1 was repeated, but the precipitation temperature was reduced to 55° C. during precipitation step A of Maternaghan '878. The mean grain diameter of Emulsion 2 was 0.69 μm and the average aspect ratio 2.7:1.

Emulsion I

This emulsion was a replication of Emulsion B, described above.

Emulsion J

This emulsion was prepared to demonstrate the performance of a high aspect ratio tabular grain emulsion having an average aspect ratio near the minimum 8:1 average aspect ratio required by this invention. The emulsion exhibited a mean grain diameter of 2.1 μm, an average grain thickness of 0.24 μm, and an estimated average aspect ratio of 8.75:1. In the preparation of this emulsion 0.5 mole of Emulsion A of the above-referenced patent application, surface chemically sensitized with 1.5 mg/Ag mole sodium thiosulfate pentahydrate and 2.25 mg/Ag mole potassium tetrachloroaurate for 30 minutes at 80° C., was used as a starting material. Onto a core emulsion corresponding to Emulsion A of the above-referenced patent application 5.5 moles of silver bromide were precipitated by double-jet addition. Four molar silver nitrate and potassium bromide solutions were added at accelerated flow rates over a total of 45 minutes at 80° C. Over the first 13 minutes the pBr was 1.7; over the rest of the run it was 2.8. The emulsion was surface chemically and spectrally sensitized similarly as Emulsion 3.

These emulsions were compared in single color integral imaging receiver (IIR) elements of the following composition. Layers 1 through 8 and 10 are common to all elements. Coverages are in (g/m$^2$) or [mg/Ag mole]. Varied components of Layer 9 are listed in the table following.

Layer 10: Overcoat Layer: Scavenger VIII (0.11), gelatin (0.89), bis(vinylsulfonyl)methane hardener at 0.88 percent of total gelatin weight Layer 9: Red-sensitive Silver Halide Emulsion Layer: Emulsion (see table), nucleating agent VI (see table), scavenger VII [16000], and gelatin (1.34)

Layer 8: Interlayer: Gelatin

Layer 7: Cyan Dye-releaser Layer: RDR III (0.37), gelatin (0.54)

Layer 6: Opaque Layer: Carbon, gelatin

Layer 5: Stripping Layer: Hydroxyethylcellulose

Layer 4: Gelatin Layer

Layer 3: Opaque Layer: Carbon, gelatin

Layer 2: Reflecting Layer: Titanium Dioxide, gelatin

Layer 1: Receiving Layer: Mordant IX, gelatin

The layers were coated on a transparent polyester support in the order of numbering. The addenda identified by Roman numerals correspond to those found in the Appendix below.

These IIR elements were processed according to the conditions described in Example 1A of the above-referenced patent application using samples of the same cover sheets and the processing composition described there with one exception: Because Emulsions G and H were substantially less photosensitive than Emulsions I and J, they were exposed at 1/25 second instead of 1/100 second so that the sensitometric curves would lie more conveniently in scale. In general, Emulsions I and J were of comparable speeds and averaged about 0.9 log E (i.e., about 8 times) faster than Emulsions G and H, which were also of comparable speeds to each other.

The data obtained and the coating parameters pertaining to the emulsions in Layer 9 are tabulated below:

| Emulsion | Ag Average (g/m²) | Nucleating** Agent VI (mg/Ag mole) | Processing Temperature 16° C. D-max/ D-min | 22° C. D-max/ D-min | ΔD-max (%*) |
|---|---|---|---|---|---|
| G (Control) | 1.34 | 4.8 | 1.59/0.19 | 1.14/0.20 | −0.45 (39%) |
| H (Control) | 1.34 | 10.3 | 1.98/0.19 | 1.32/0.20 | −0.66 (50%) |
| I (Invention) | 1.34 | 0.3 | 1.62/0.27 | 1.60/0.30 | −0.02 (1%) |
| J (Invention) | 0.91 | 1.1 | 1.62/0.20 | 1.51/0.20 | −0.11 (7%) |

*Percent change based on D-max at 22° C.

**Nucleating agent levels were chosen to maximize image discrimination while retaining an acceptably low minimum density.

The emulsions of the invention showed much less difference in D-max than those of Maternaghan '878 when the processing temperature was raised from 16° to 22° C.

Appendix

The redox dye-releasers (RDR's) I to IV are of the structures described in *Research Disclosure,* Vol. 182, July 1979, Item 18268, pages 329-31.

Yellow RDR

I.

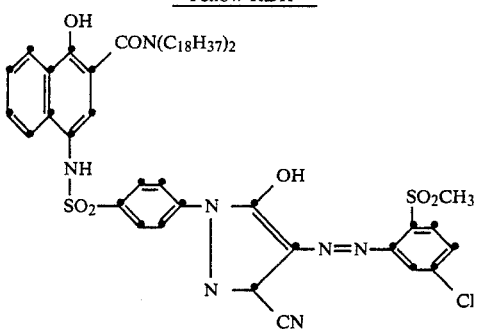

(dispersed in di-n-butylphthalate)

Magenta RDR

II.

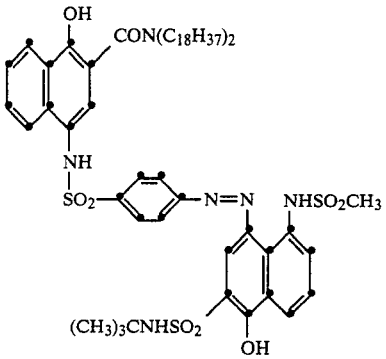

(dispersed in diethyllauramide)

Cyan RDR

-continued

III.

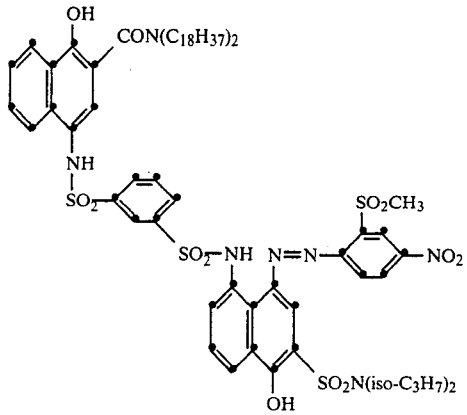

(dispersed in N—n-butylacetanilide)

Cyan RDR

IV.

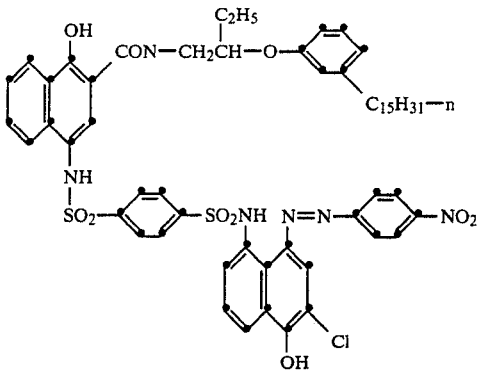

(dispersed in N—n-butylacetanilide)

The nucleating agents V and VI, are of the following structure:

V.

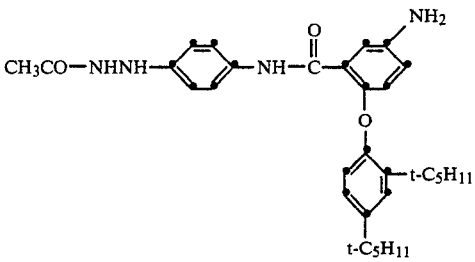

VI.

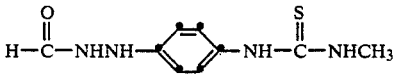

The oxidized developer scavengers are the following:

VII.

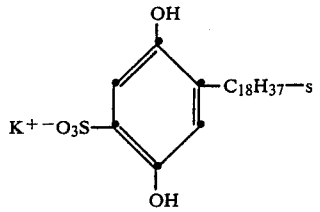

VIII.

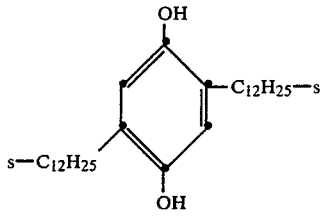

The mordant is as follows:

IX.

poly(styrene-co-1-vinylimidazole-co-3-benzyl-1-vinylimidazolium chloride) (weight ratio approx. 50:40:10)

The invention has been described in detail with particular reference to preferred embodiments thereof, but it will be understood that variations and modifications can be effected within the spirit and scope of the invention.

What is claimed is:

1. A radiation-sensitive emulsion capable of forming a direct-positive image comprised of a dispersing medium, silver halide grains capable of forming an internal latent image, and a nucleating agent, at least 50 percent of the total projected area of said silver halide grains being provided by tabular grains which have an average thickness of less than 0.5 micron and an average aspect ratio of greater than 8:1.

2. A tabular grain silver halide emulsion according to claim 1 wherein said silver halide grains are comprised of bromide.

3. A tabular grain silver halide emulsion according to claim 2 wherein said silver halide grains are additionally comprised of iodide.

4. A tabular grain silver halide emulsion according to claim 1 wherein said dispersing medium is comprised of a peptizer.

5. A tabular grain silver halide emulsion according to claim 4 wherein said peptizer is gelatin or a gelatin derivative.

6. A tabular grain silver halide emulsion according to claim 1 wherein said tabular silver halide grains have an average aspect ratio of at least 10:1.

7. A tabular grain silver halide emulsion according to claim 1 wherein said tabular silver halide grains account for at least 70 percent of the total projected area of said silver halide grains.

8. A tabular grain silver halide emulsion according to claim 1 wherein said tabular silver halide grains account for at least 90 percent of the total projected area of said silver halide grains.

9. A radiation-sensitive emulsion according to claim 1 wherein said emulsion when coated on a transparent film support at a silver coverage of 4 grams per square meter, exposed to a 500 watt tungsten lamp for times ranging from 0.01 to 1 second at a distance of 0.6 meter, developed for 5 minutes at 20° C. in Developer Y below, fixed, washed, and dried, has a maximum density at least five times the maximum density of an identical test portion which has been exposed in the same way and developed for 6 minutes at 20° C. in Developer X below, fixed, washed, and dried:

| Developer X | Grams |
|---|---|
| N—methyl-p-aminophenol sulfate | 2.5 |
| Ascorbic acid | 10.0 |
| Potassium metaborate | 35.0 |
| Potassium bromide | 1.0 |
| Water to 1 liter. | |

| Developer Y | Grams |
|---|---|
| N—methyl-p-aminophenol sulfate | 2.0 |
| Sodium sulfite, desiccated | 90.0 |
| Hydroquinone | 8.0 |
| Sodium carbonate, monohydrate | 52.5 |
| Potassium bromide | 5.0 |
| Potassium iodide | 0.5 |
| Water to 1 liter. | |

10. A radiation-sensitive emulsion according to claim 1 wherein said tabular silver halide grains contain internal physical sensitization sites.

11. A radiation-sensitive emulsion according to claim 1 wherein said tabular silver halide grains contain internal chemical sensitization sites.

12. A radiation-sensitive emulsion according to claim 11 wherein said internal chemical sensitization sites are produced by at least one of iridium and lead dopants.

13. A radiation-sensitive emulsion according to claim 11 wherein said internal chemical sensitization sites are produced by a middle chalcogen incorporated within said tabular grains.

14. A radiation-sensitive emulsion according to claim 13 wherein said tabular grains additionally include gold incorporated therein.

15. A radiation-sensitive emulsion according to claim 1 wherein said tabular grains contain at least one of lead, cadmium, zinc, and erbium in an amount sufficient to reduce rereversal.

16. A radiation-sensitive emulsion according to claim 1 wherein said tabular grains are silver bromoiodide grains and at least one blue spectral sensitizer is present in said emulsion chosen from the class consisting of cyanine, merocyanine, hemicyanine, hemioxonol, and merostyryl sensitizing dyes.

17. A radiation-sensitive emulsion according to claim 1 wherein said nucleating agent is chosen from the class consisting of aromatic hydrazide nucleating agents, N-substituted cycloammonium quaternary salt nucleating agents, and mixtures thereof.

18. A radiation-sensitive emulsion according to claim 1 wherein said nucleating agent is a hydrazide of the formula $$D-\overset{H}{N}-\overset{H}{N}-\phi-M$$

wherein

D is an acyl group;

$\phi$ is a phenylene or a halo-, alkyl-, or alkoxy-substituted phenylene group; and M is a moiety capable of restricting mobility.

19. A radiation-sensitive emulsion according to claim 1 wherein said nucleating agent is a phenylhydrazide of the formula

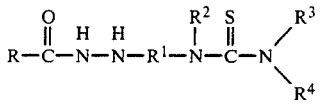

wherein

R is hydrogen or an alkyl, cycloalkyl, haloalkyl, alkoxyalkyl, or phenylalkyl substituent or a phenyl nucleus having a Hammett sigma-value-derived electron-withdrawing characteristic more positive than TM 0.30;

$R^1$ is a phenylene or alkyl, halo-, or alkoxy-substituted phenylene group;

$R^2$ is hydrogen, benzyl, alkoxybenzyl, halobenzyl, or alkylbenzyl;

$R^3$ is a alkyl, haloalkyl, alkoxyalkyl, or phenylalkyl substituent having from 1 to 18 carbon atoms, a cycloalkyl substituent, a phenyl nucleus having a Hammett sigma value-derived electron-withdrawing characteristic less positive than +0.50, or naphthyl, and $R^4$ is hydrogen or independently selected from among the same substituents as $R^3$, or $R^3$ and $R^4$ together form a heterocyclic nucleus forming a 5- or 6-membered ring, wherein the ring atoms are chosen from the class consisting of nitrogen, carbon, oxygen, sulfur, and selenium atoms;

the alkyl moieties, except as otherwise noted, in each instance include from 1 to 6 carbon atoms and the cycloalkyl moieties have from 3 to 10 carbon atoms and at least one of $R^2$ and $R^3$ must be hydrogen.

20. A radiation-sensitive emulsion according to claim 1 wherein said nucleating agent is a hydrazide or hydrazone of the formula

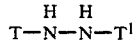

or

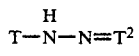

wherein

T is a phenyl or naphthyl substituent;

$T^1$ is an acyl radical; and $T^2$ is an alkylidene substituent having from 1 to 22 carbon atoms.

21. A radiation-sensitive emulsion capable of forming a direct-positive reversal dye image comprised of gelatin or a gelatin-derived peptizer, surface chemically sensitized silver bromide or bromoiodide grains capable of forming an internal latent image, a dye image former, and a nucleating agent, at least 70 percent of the total projected area of said grains being provided by tabular grains which have an average diameter of at least 1.0 micron, an average thickness of less than 0.3 micron, and an average aspect ratio of at least 10:1, and said emulsion when coated on a transparent film support at a silver coverage of 4 grams per square meter, exposed to a 500 watt tungsten lamp for times ranging from 0.01 to 1 second at a distance of 0.6 meter, developed for 5 minutes at 20° C. in Developer Y below, fixed, washed, and dried, having a maximum silver density at least five times the maximum density of an identical test portion which has been exposed in the same way and developed for 6 minutes at 20° C. in Developer X below, fixed, washed, and dried:

| Developer X | Grams |
|---|---|
| N—methyl-p-aminophenol sulfate | 2.5 |
| Ascorbic acid | 10.0 |
| Potassium metaborate | 35.0 |
| Potassium bromide | 1.0 |
| Water to 1 liter. | |

| Developer Y | Grams |
|---|---|
| N—methyl-p-aminophenol sulfate | 2.0 |
| Sodium sulfite, desiccated | 90.0 |
| Hydroquinone | 8.0 |
| Sodium carbonate, monohydrate | 52.5 |
| Potassium bromide | 5.0 |
| Potassium iodide | 0.5 |
| Water to 1 liter. | |

22. A radiation-sensitive emulsion according to claim 21 wherein said tabular grains contain iridium as an internal dopant in a concentration of from about $10^{-8}$ to $10^{-4}$ mole per silver mole.

23. A radiation-sensitive emulsion according to claim 21 wherein said tabular grains contain lead as an internal dopant in a concentration of from about $10^{-4}$ to $5\times10^{-2}$ mole per silver mole.

24. A radiation-sensitive emulsion according to claim 21 wherein said tabular grains are internally sensitized with sulfur optionally in combination with gold.

25. A radiation-sensitive emulsion according to claim 21 wherein said tabular grains are comprised of a core and at least one shell containing cadmium, lead, or mixtures thereof in a concentration below about $5\times10^{-4}$ mole per mole of silver.

26. A radiation-sensitive emulsion according to claim 21 wherein said tabular grains are comprised of silver bromoiodide.

27. A radiation-sensitive emulsion according to claim 26 wherein an outer region contains at least 2 mole percent more iodide than a central region of said tabular grains.

28. A radiation-sensitive emulsion according to claim 27 wherein said tabular grains contain a core and at least one shell and iodide is present in said shell in a concentration of at least 6 mole percent more than present in said core.

29. In a photographic element comprised of a support and at least one radiation-sensitive emulsion layer, the improvement wherein said emulsion layer is comprised of an emulsion according to claim 1, 2, 3, 4, 5, 6, 7, 8, 9, 10, 11, 12, 13, 14, 15, 16, 17, 18, 19, 20, 21, 22, 23, 24, 25, 26, 27, or 28.

30. In a multicolor direct reversal photographic element comprised of a support and, located thereon, emulsion layers for separately recording blue, green, and red light each comprised of a dispersing medium, internal latent image-forming silver halide grains, and a nucleating agent, said green and red recording emulsion layers containing green and red spectral sensitizing dyes, respectively, the improvement comprising in at least one of said green and red recording emulsion layers at least 50 percent of the total projected area of said silver halide grains being provided by internal latent image-forming tabular silver halide grains having an average thickness of less than 0.3 micron, an average diameter of at least 0.6 micron, and average aspect ratio of greater than 8:1.

31. An improved multicolor photographic element according to claim 30 wherein one of said emulsion layers containing said tabular silver halide grains is positioned to receive exposing radiation prior to remaining emulsion layers of said multicolor photographic element.

32. An improved multicolor photographic element according to claim 30 wherein one of said emulsion layers containing said tabular silver halide grains is positioned to receive specularly transmitted light and overlies at least one other emulsion layer of said multicolor photographic element.

33. An improved multicolor photographic element according to claim 32 wherein said tabular silver halide grains of said one emulsion layer have an average diameter of at least 2 microns.

34. An improved multicolor photographic element according to claim 30 wherein said blue recording emulsion layer is comprised of internal latent image-forming tabular silver halide grains having an average thickness of less than 0.5 micron and an average diameter of at least 0.6 micron, accounting for at least 50 percent of the total projected area of said silver halide grains present in the same emulsion layer.

35. An improved multicolor photographic element according to claim 30 wherein at least one of said green and red recording emulsion layers containing tabular grains is comprised of silver bromide or bromoiodide.

36. In a multicolor direct reversal photographic element comprised of a film support and, located thereon, color-forming layer units for separately recording blue, green, and red light containing yellow, magenta, and cyan dye-forming couplers, respectively, said color-forming layer units being chosen so that when said photographic element is exposed at a color temperature of 5500° K. through a spectrally nonselective step wedge and processed said photographic element exhibits, in relation to blue contrast and speed, green and red contrast variations of less than 20 percent and green and red speed variations of less than 0.3 log E, each of said color-forming layer units including at least one emulsion layer comprised of a dispersing medium, silver halide grains, and a nucleating agent, said silver halide grains of at least a triad of said emulsion layers for separately recording blue, green, and red light being positioned to receive exposing radiation prior to any remaining emulsion layers and having an average diameter of at least 2.0 microns, the improvement wherein at least 70 percent of the total projected area of internal latent image-forming tabular silver bromide or bromoiodide grains in at least one of said green and red recording emulsion layers have an average thickness of less than 0.2 micron, an average diameter of at lest 0.6 micron, and an average aspect ratio of at least 10:1, said internal latent image-forming tabular grains in said green and red recording emulsion layers being both internally and surface chemically sensitized.

37. A multicolor photographic element according to claim 36 in which said element is substantially free of yellow filter material interposed between exposing radiation incident upon said element and at least one of said tabular grain containing emulsion layers.

38. A multicolor photographic element according to claim 36 in which at least one of said layers containing tabular grains is positioned to receive exposing radiation prior to said blue recording emulsion layer.

39. A multicolor photographic element according to claim 36 in which at least one of said layers containing said tabular grains is positioned to receive exposing radiation prior to all other silver halide emulsion layers of said photographic element.

40. A multicolor photographic element according to claim 36 in which said tabular grains are present in said green recording emulsion layer.

41. A multicolor photographic element according to claim 36 in which said tabular grains are present in said red recording emulsion layer.

42. A multicolor photographic element according to claim 36 in which said tabular grains are present in each of said green and red recording emulsion layers.

43. In a photographic image transfer film unit comprising a support, at least one emulsion layer located on said support containing a dispersing medium, radiation-sensitive internal latent image-forming silver halide grains, and a nucleating agent, a dye-image-providing material present in said emulsion layer or a layer adjacent thereto, and a receiving layer for providing a viewable transferred dye image following imagewise exposure and processing of said emulsion layer, the improvement, wherein internal latent image-forming tabular silver halide grains in at least said one emulsion layer having an average thickness of less than 0.5 micron, an average diameter of at least 0.6 micron, and an average aspect ratio of greater than 8:1 account for at least 50 percent of the total projected area of said radiation-sensitive silver halide grains present in said emulsion layer.

44. A photographic image transfer film unit according to claim 43 in which said receiving layer is positioned adjacent a second support.

45. A photographic image transfer film unit according to claim 44 in which said second support is a reflective support.

46. A photographic image transfer film unit according to claim 44 in which said second support is transparent.

47. A photographic image transfer film unit according to claim 43 wherein said receiving layer is positioned between said support and said emulsion layers.

48. A photographic image transfer film unit according to claim 43 in which said tabular silver halide grains account for at least 70 percent of the total projected area of said radiation-sensitive grains present in the same emulsion layer.

49. A photographic image transfer film unit according to claim 43 in which the halide of said silver halide grains consists essentially of bromide optionally in combination with iodide.

50. A photographic image transfer film unit according to claim 43 in which said tabular silver halide grains have an average aspect ratio of at least 10:1.

51. In a dye image transfer film unit comprising a transparent support, at least one emulsion layer located on said support containing a dispersing medium, radiation-sensitive internal latent image-forming silver halide grains, and a nucleating agent, a dye-image-providing material located in said emulsion layer or in a layer adjacent thereto, a transparent cover sheet, a dye receiving layer located on said cover sheet, an alkaline processing solution, and means for releasing said alkaline processing solution into contact with said emulsion layers, the improvement wherein at least 70 percent of the total projected area of said radiation-sensitive silver halide grains is provided by internal latent image-forming tabular silver halide grains having an average thickness of less than 0.5 micron, an average diameter of at least 0.6 micron, and an average aspect ratio of at least 10:1 .

52. A dye image transfer film unit according to claim 51 additionally including means for terminating silver halide development positioned adjacent one of said support and said cover sheet.

53. A dye image transfer film unit according to claim 51 additionally including a reflective layer positioned adjacent said receiving layer and between said receiving layer and said one emulsion layer.

54. A dye image transfer film unit according to claim 51 in which said tabular silver halide grains have an average thickness of less than 0.3 micron.

55. In a multicolor dye image transfer film unit comprising a support, dye-providing layer units located on said support each comprised of at least one dye-image-providing material and at least one silver halide emulsion containing a dispersing medium, radiation-sensitive internal latent image-forming silver halide grains, and a nucleating agent, said dye-providing layer units including a dye-providing layer unit containing a red-sensitive emulsion and a cyan-dye-image-providing material, a dye-providing layer unit containing a green-sensitive emulsion and a magenta-dye-image-providing material, and a dye-providing layer unit containing a blue-sensitive emulsion and a yellow-dye-image-providing material, and a receiving layer for providing a viewable transferred multicolor dye image following imagewise exposure and processing, the improvement wherein at least 70 percent of the total projected area of said radiation-sensitive grains in at least one of said emulsions is provided by internal latent image-forming tabular silver halide grains having an average thickness of less than 0.5 micron, an average diameter of at least 1.0 micron, and an average aspect ratio of at least 10:1.

56. A multicolor dye image transfer film unit according to claim 55 in which said tabular silver halide grains account for at least 90 percent of the total grain area of at least said one emulsion.

57. A multicolor dye image transfer film unit according to claim 55 in which said emulsion containing said tabular grains is a red-sensitive or green-sensitive silver bromide emulsion optionally containing silver iodide and is positioned to receive exposing radiation prior to the remaining silver halide emulsions of said film unit.

58. A multicolor dye image transfer film unit according to claim 55 wherein said dye-image-providing materials are negative-working redox dye-releasers.

59. A multicolor dye image transfer film unit according to claim 55 wherein said tabular grains contain at least one of lead, cadmium, zinc, and erbium in an amount sufficient to reduce rereversal.

60. A multicolor dye image transfer film unit according to claim 55 wherein said nucleating agent is a hydrazide of the formula $$D-\overset{H}{N}-\overset{H}{N}-\phi-M$$

wherein

D is an acyl group;

$\phi$ is a phenylene or halo-, alkyl-, or a alkoxy-substituted phenylene group; and M is a moiety capable of restricting mobility.

* * * * *